US006341203B1

(12) United States Patent
Nakazato et al.

(10) Patent No.: US 6,341,203 B1
(45) Date of Patent: Jan. 22, 2002

(54) IMAGE FORMING APPARATUS AND METHOD WITH ADJUSTABLE IMAGE DENSITY FACTOR

(75) Inventors: Hiroshi Nakazato; Yoshio Nakazawa; Takashi Hama, all of Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/624,487

(22) Filed: Jul. 24, 2000

(30) Foreign Application Priority Data

| | | |
|---|---|---|
| Jul. 28, 1999 | (JP) | 11-213653 |
| Jul. 28, 1999 | (JP) | 11-213654 |
| Jul. 28, 1999 | (JP) | 11-213655 |
| Sep. 6, 1999 | (JP) | 11-252259 |
| Jun. 5, 2000 | (JP) | 12-167282 |

(51) Int. Cl.[7] ..... G03G 15/00
(52) U.S. Cl. ..... 399/49; 399/50; 399/53
(58) Field of Search ..... 399/38, 46, 49, 399/50, 53, 279, 51, 55; 430/107, 109, 110

(56) References Cited

U.S. PATENT DOCUMENTS

| | | | | |
|---|---|---|---|---|
| 5,351,107 A | * | 9/1994 | Nakane et al. | 399/49 |
| 6,002,903 A | * | 12/1999 | Hayase et al. | 399/279 |
| 6,104,890 A | * | 8/2000 | Kim | 399/46 |
| 6,118,557 A | * | 9/2000 | Sugiyama et al. | 399/49 X |

FOREIGN PATENT DOCUMENTS

| | | |
|---|---|---|
| JP | 63-142370 | 6/1988 |
| JP | 2-93667 | 4/1990 |
| JP | 3-279971 | 12/1991 |
| JP | 4-96076 | 3/1992 |
| JP | 5-40397 | 2/1993 |
| JP | 5-94073 | 4/1993 |
| JP | 5-257352 | 10/1993 |
| JP | 5-333648 | 12/1993 |
| JP | 6-43734 | 2/1994 |
| JP | 6-51599 | 2/1994 |
| JP | 6-51604 | 2/1994 |
| JP | 7-20669 | 1/1995 |
| JP | 7-20670 | 1/1995 |
| JP | 7-333922 | 12/1995 |
| JP | 8-292615 | 11/1996 |
| JP | 9-50155 | 2/1997 |
| JP | 9-146313 | 6/1997 |
| JP | 9-233235 | 9/1997 |
| JP | 9-244472 | 9/1997 |
| JP | 10-55081 | 2/1998 |
| JP | 10-142857 | 5/1998 |
| JP | 10-228142 | 8/1998 |
| JP | 10-239924 | 9/1998 |
| JP | 10-326031 | 12/1998 |
| JP | 11-15217 | 1/1999 |
| JP | 11-133682 | 5/1999 |
| JP | 11-258872 | 9/1999 |
| JP | 2000-66550 | 3/2000 |

* cited by examiner

*Primary Examiner*—Sophia S. Chen
*Assistant Examiner*—Hoan Tran
(74) *Attorney, Agent, or Firm*—Oblon, Spivak, McClelland, Maier & Neustadt, P.C.

(57) ABSTRACT

In an apparatus, first and second processing modes are prepared to determine an optimal development bias. Either one of the first processing mode and the second processing mode is selected as a processing mode in accordance with an operation status of the apparatus. Hence, it is possible to select and execute the most appropriate processing mode in accordance with an operation status to thereby efficiently and highly accurately determine an optimal value of a development bias which is one density controlling factor.

26 Claims, 43 Drawing Sheets

FIG. 12A
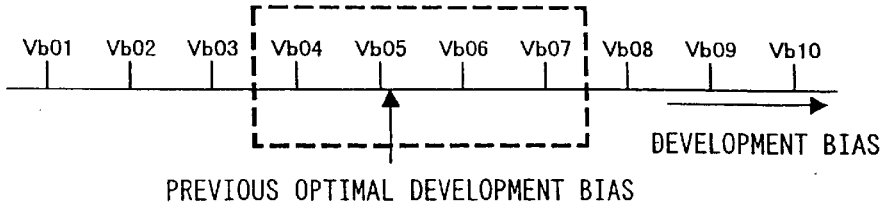
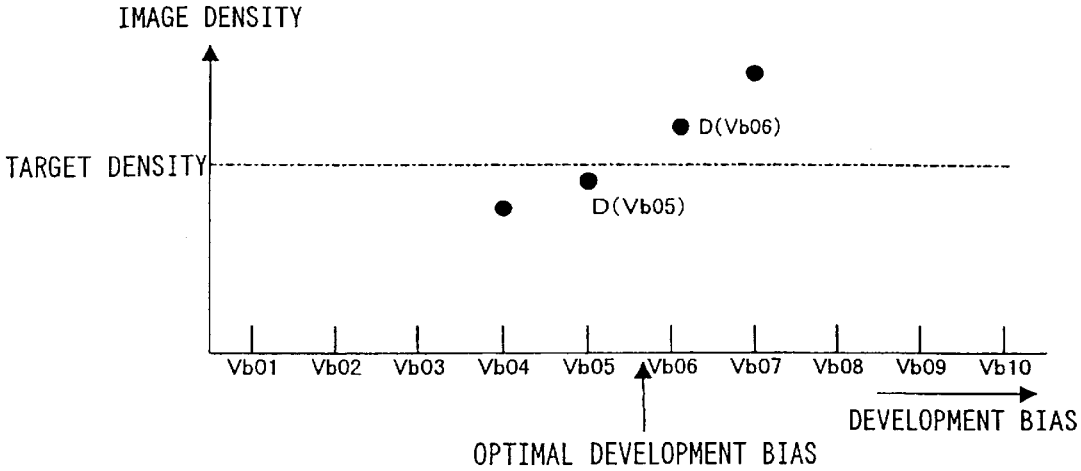
FIG. 12B

IMAGE FORMING APPARATUS AND METHOD WITH ADJUSTABLE IMAGE DENSITY FACTOR

BACKGROUND OF THE INVENTION

1. Field of the Invention

The present invention relates to an image forming apparatus and an image forming method, in which an image density of a toner image is adjusted based on detected image densities of patch images.

2. Description of the Related Art

This type of an image forming apparatus often sees a change in an image density due to the following factors: fatigue, degradation with age or the like of a photosensitive member and a toner; a change in a temperature, a humidity or the like around the apparatus; and other causes. Noting this, a number of techniques have been proposed which aim at stabilizing an image density through appropriate adjustment of a density control factor which influences an image density of a toner image such as an electrifying bias, a development bias, a light exposure dose, etc. For example, the invention described in the Japanese Patent Application Laid-Open Gazette No. 10-239924 requires to properly adjust an electrifying bias and a development bias in an effort to stabilize an image density. That is, according to this conventional technique, reference patch images are formed on a photosensitive member while changing an electrifying bias and/or a development bias and an image density of each reference patch is detected. An optimal electrifying bias and an optimal development bias are thereafter determined based on the detected image densities, and a density of a toner image is accordingly adjusted. For the convenience of description, in the following, the term a "processing mode" will refer to a series of processing in which a plurality of patch images are formed, densities of the patch images are detected, and an optimal value of a density controlling factor, which is necessary to adjust an image density of a toner image to a target density, is determined based on the detected image densities.

The processing mode is executed at the following timing. Specifically, after turning on a main power source of the image forming apparatus, a density is adjusted upon arriving at a state where the apparatus is ready to form an image, which is when a fixing temperature reaches a predetermined temperature or immediately after that, for example. Where a timer is built within the image forming apparatus, the density adjustment is executed at regular intervals, e.g., for every two hours.

By the way, in a real image forming apparatus, a state of an engine part (image forming means) is largely different depending on an operation status of the apparatus. For instance, a change in a state of the engine part is relatively small while images are formed continuously, whereas it is relatively likely that a state of the engine part changes largely upon turning on of a power source.

Hence, execution of a processing mode tuned to the state of the engine part makes it possible to adjust a density efficiently at a high accuracy. For instance, while an optimal electrifying bias and an optimal development bias change due to fatigue, degradation with age or the like of a photosensitive member and a toner, the changes possess a continuity to a certain extent. Hence, when repeated density adjustment is desired, if a density is adjusted using a density controlling factor obtained from immediately previous density adjustment as a reference, the density adjustment is accurate. On the contrary, it is difficult to predict a state of the engine part upon power turn-on, and therefore, it is necessary to change the density controlling factor in a relatively wide range to determine an optimal value of the density controlling factor.

However, in conventional techniques, since only one type of a processing mode is available and the available processing mode is fixed, there is much to improve in terms of efficiency and accuracy.

The conventional technique described above requires to identify an electrifying bias/development bias characteristic before forming reference patch images, and to set an electrifying bias and a development bias for creation of reference patch images, such that the characteristic is satisfied. In order to stabilize an image density based on a calculated optimal electrifying bias and development bias, it is necessary to identify an electrifying bias/development bias characteristic of each image forming apparatus, which is troublesome.

Further, an electrifying bias/development bias characteristic does not always stay constant but may change with time. If the characteristic changes, it is difficult to accurately calculate an optimal electrifying bias or an optimal development bias. While appropriate updating of the electrifying bias/development bias characteristic solves this problem, the updating is bothersome and disadvantageous in terms of maintainability.

Meanwhile, other technique for stabilizing an image density is the invention described in Japanese Patent Application Laid-Open Gazette No. 9-50155. According to the described invention, a reference patch image, which is a patch image obtained by outputting groups of three-dot lines for every three dots, is formed on a photosensitive drum, and a sensor reads patch images thus created, whereby a line width is detected. A laser power is controlled based on the detected line width, a light exposure dose is accordingly adjusted so that a desired line width will be obtained, and an ideal line image is obtained.

However, a line image is basically a one-dot line which is drawn with one laser beam, and therefore, simply controlling a line width of a multi-dot line as in the conventional technique can not realize a precise adjustment of a line image.

SUMMARY OF THE INVENTION

The present invention aims at providing an image forming apparatus and an image forming method with which it is possible to determine an optimal value of a density controlling factor, which is needed to adjust an image density of a toner image to a target density, efficiently at a high accuracy.

Other object of the present invention is to provide an image forming apparatus and an image forming method with which it is possible to stabilize an image density of a line image.

In fulfillment of the foregoing object, an image forming apparatus and method are provided and are particularly well suited to density adjustment of a toner image based on image densities of a plurality of patch images.

According to the present invention, control means has a plurality of processing modes which are different from each other. Each of the plurality of processing modes is a mode in which a plurality of patch images are formed by the image forming means while changing a density controlling factor which influences an image density of an image and an optimal value of a density controlling factor, which is necessary to adjust an image density of an image to the target density, is determined based on the densities of the patch images. One of the processing modes is selected as a processing mode in accordance with an operation status of the apparatus. Hence, it is possible to select and execute the most appropriate processing mode in accordance with an operation status to thereby efficiently and highly accurately determine an optimal value of the density controlling factor.

BRIEF DESCRIPTION OF THE DRAWINGS

FIGS. 12A and 12B are schematic diagrams showing the operation of the processing of FIG. 11;

DETAILED DESCRIPTION OF THE PREFERRED EMBODIMENTS

A. Overall Structure of Image Forming Apparatus

Figure 1:
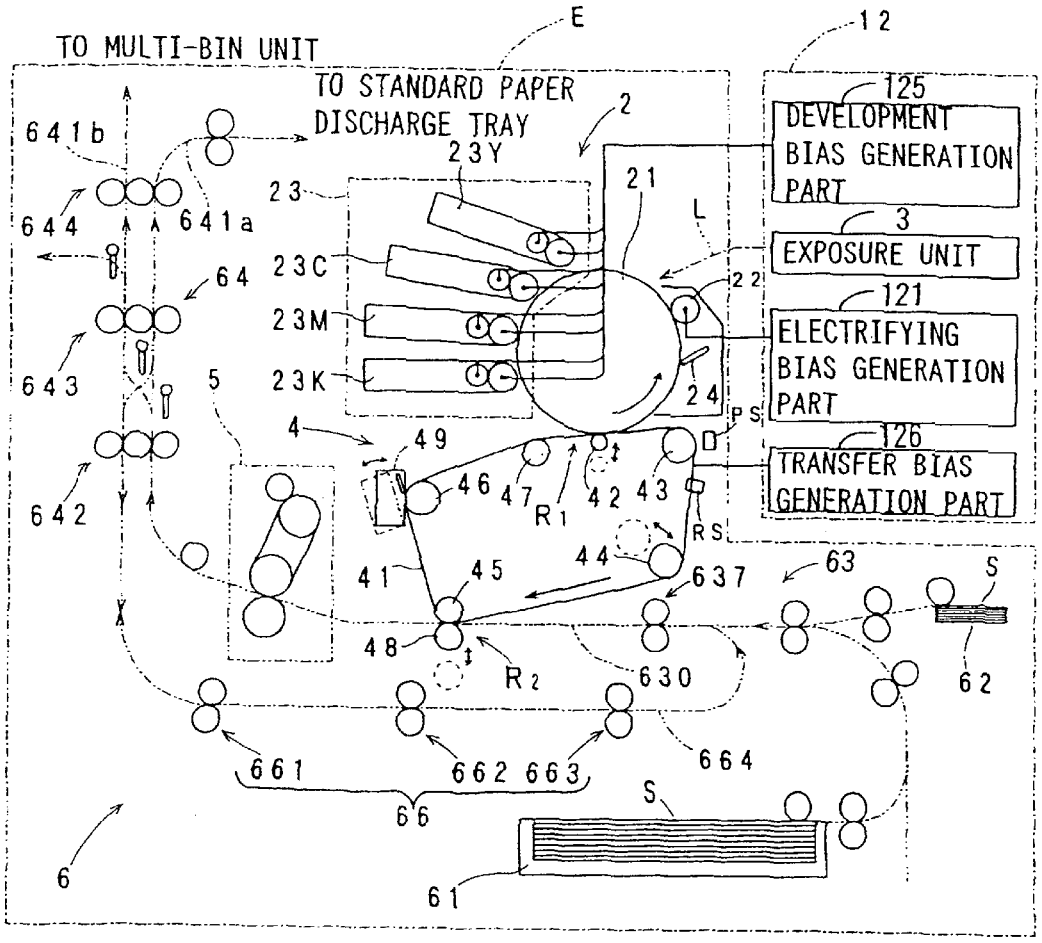
FIG. 1 is a drawing showing a preferred embodiment of an image forming apparatus according to the present invention.
Figure 2:
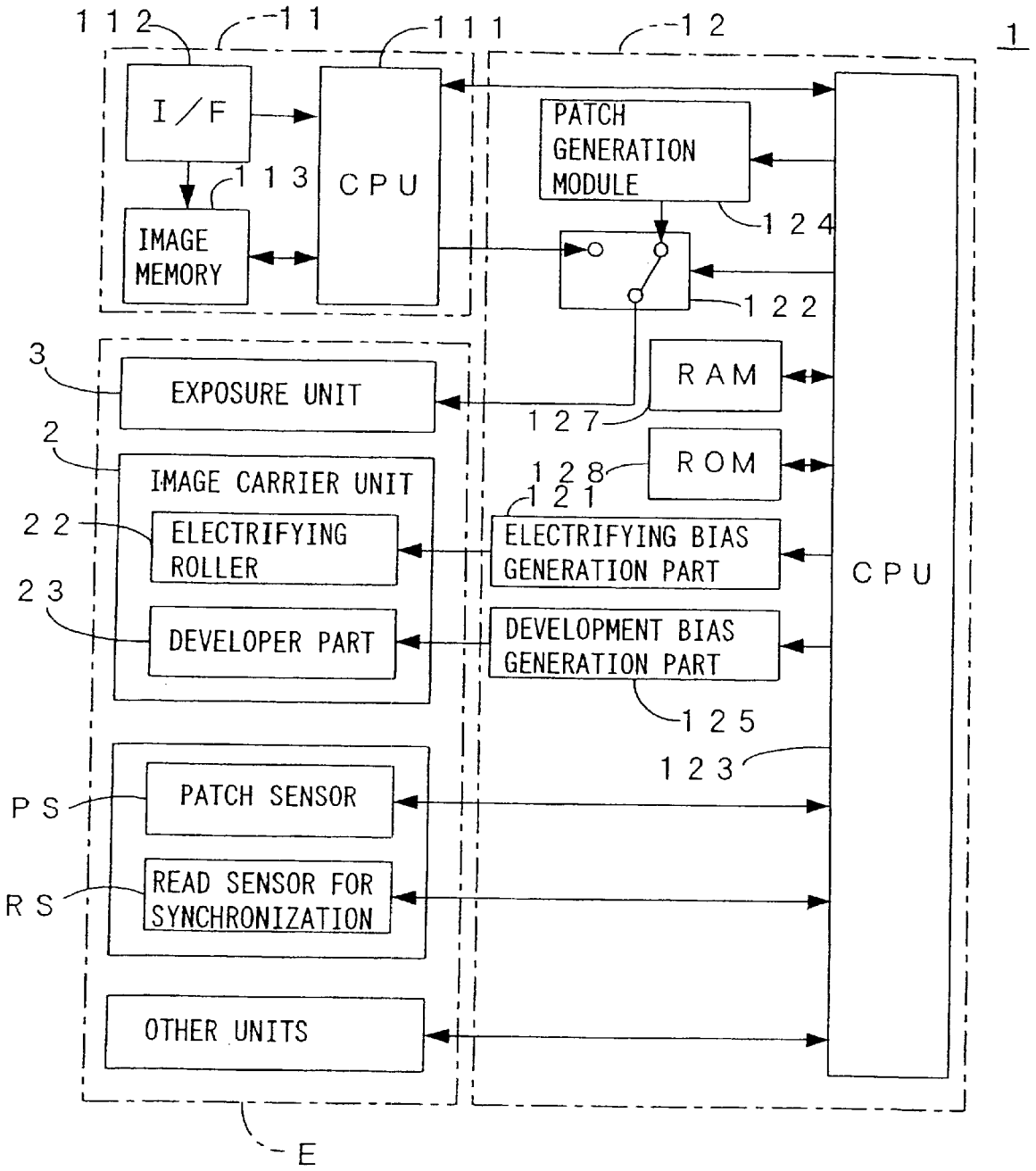
FIG. 2 is a block diagram showing an electric structure of the image forming apparatus of FIG. 1.

FIG. 1 is a drawing showing a preferred embodiment of an image forming apparatus according to the present invention. FIG. 2 is a block diagram showing an electric structure of the image forming apparatus of FIG. 1. The image forming apparatus is an apparatus which overlaps toner images in four colors of yellow (Y), cyan (C), magenta (M) and black (K) to thereby form a full-color image or uses only a black (K) toner to thereby form a monochrome image. When an image signal is supplied to a main controller 11 of a control unit 1 from an external apparatus such as a host computer, an engine controller 12 controls respective portions of an engine part E in accordance with an instruction from the main controller 11, whereby the image forming apparatus forms an image which corresponds to the image signal on a sheet S.

The engine part E is capable of forming a toner image on a photosensitive member 21 of an image carrier unit 2. That is, the image carrier unit 2 comprises the photosensitive member 21 which is rotatable in the direction of an arrow in FIG. 1. Disposed around the photosensitive member 21 and in the rotation direction of the photosensitive member 21 in FIG. 1 are an electrifying roller 22 which serves as electrifying means, developers 23Y, 23C, 23M and 23K which serve as developing means, and a cleaning part 24. Applied with a high voltage from an electrifying bias generation part 121 and in contact with an outer peripheral surface of the photosensitive member 21, the electrifying roller 22 uniformly electrifies the outer peripheral surface of the photosensitive member 21.

An exposure unit 3 irradiates laser light L toward the outer peripheral surface of the photosensitive member 21 which is electrified by the electrifying roller 22. The exposure unit 3, as shown in FIG. 2, is electrically connected with an image signal switching part 122. In accordance with an image signal which is supplied through the image signal switching part 122, the laser light L scans over the photosensitive member 21 and consequently exposes the photosensitive member 21, whereby an electrostatic latent image corresponding to the image signal is formed on the photosensitive member 21. For example, when the image signal switching part 122 is in conduction with a patch generation module 124, based on an instruction from a CPU 123 of the engine controller 12, a patch image signal outputted from the patch generation module 124 is fed to the exposure unit 3 so that a patch latent image is formed. On the other hand, when the image signal switching part 122 is in conduction with a CPU 111 of the main controller 11, the laser light L scans over and consequently exposes the photosensitive member 21 in accordance with an image signal which is supplied through an interface 112 from an external apparatus such as a host computer, so that an electrostatic latent image corresponding to the image signal is formed on the photosensitive member 21.

The electrostatic latent image which is formed in this manner is developed by a developer part 23. In other words, according to the preferred embodiment, disposed as the developer part 23 are the developer 23Y for yellow, the developer 23C for cyan, the developer 23M for magenta and the developer 23K for black which are arranged in this order around the photosensitive member 21. The developers 23Y, 23C, 23M and 23K are each structured so as to freely separate from and come close to the photosensitive member 21. In accordance with an instruction given from the engine controller 12, one of the four developers 23Y, 23C, 23M and 23K selectively contacts the photosensitive member 21. A development bias generation part 125 thereafter applies a high voltage to the photosensitive member 21, and the toner in the selected color moves to the surface of the photosensitive member 21, thereby visualizing the electrostatic latent image on the photosensitive member 21. The voltages supplied to the respective developers may be simply D.C. voltages, or alternatively, A.C. voltages superimposed over D.C. voltages.

The toner image developed by the developer part 23 is primarily transferred onto an intermediate transfer belt 41 of a transfer unit 4 in a primary transfer region R1 which is located between the black developer 23K and the cleaning part 24. A structure of the transfer unit 4 will be described in detail later.

The cleaning part 24 is disposed at a position further ahead in a circumferential direction (the direction of the arrow in FIG. 1) from the primary transfer region R1, such that a toner remaining on the outer peripheral surface of the photosensitive member 21 after the primary transfer treatment is scraped off.

Next, the structure of the transfer unit 4 will be described. According to the preferred embodiment, the transfer unit 4 comprises rollers 42 through 47, the intermediate transfer belt 41 which is spun around the rollers 42 through 47, and a secondary transfer roller 48 which secondarily transfers an intermediate toner image transferred to the intermediate transfer belt 41 onto a sheet S. A transfer bias generation part 126 applies a primary transfer voltage upon the intermediate transfer belt 41. Toner images in the respective colors formed on the photosensitive member 21 are laid one atop the other on the intermediate transfer belt 41 into a color image, while the sheet S is taken out from a cassette 61, a hand-feeding tray 62 or an additional cassette (not shown) by a paper feed part 63 of a paper feed/discharge unit 6 and conveyed to a secondary transfer region R2. The color image is thereafter secondarily transferred onto the sheet S, thereby obtaining a full-color image. Meanwhile, when a monochrome image is to be transferred onto a sheet S, only a black toner image on the photosensitive member 21 is formed on the intermediate transfer belt 41, and transferred onto a sheet S conveyed to the secondary transfer region R2 to thereby obtain a monochrome image, as in the case of forming a color image.

After secondary transfer treatment, a toner remaining on and sticking to an outer peripheral surface of the intermediate transfer belt 41 is removed by a belt cleaner 49. The belt cleaner 49 is disposed opposite to the roller 46 across the intermediate transfer belt 41, and a cleaner blade contacts the intermediate transfer belt 41 at appropriate timing and scrapes off a toner from the outer peripheral surface of the intermediate transfer belt 41.

Further, disposed in the vicinity of the roller 43 is a patch sensor PS which detects a density of a patch image which is formed on the outer peripheral surface of the intermediate transfer belt 41 as described later, and so is a read sensor for synchronization RS which detects a reference position of the intermediate transfer belt 41.

Referring to FIG. 1 again, the description on the structure of the engine part E will be continued. The sheet S now seating the toner image transferred by the transfer unit 4 is conveyed by the paper feed part 63 of the paper feed/discharge unit 6 to a fixing unit 5 which is disposed on the downstream side to the secondary transfer region R2 along a predetermined paper feed path (dot-dot-dash line), and the toner image on the conveyed sheet S is fixed on the sheet S. The sheet S is thereafter conveyed to a paper discharge part 64 along the paper feed path 630.

The paper discharge part 64 has two paper discharge paths 641*a* and 641*b*. The paper discharge path 641*a* extends from the fixing unit 5 to a standard paper discharge tray, while the paper discharge path 641*b* extends approximately parallel to the paper discharge path 641*a* between a paper re-feed part 66 and a multi-bin unit. Three roller pairs 642 through 644 are disposed along the paper discharge paths 641*a* and 641*b*, so as to discharge the sheets S toward the standard paper discharge tray or the multi-bin unit and convey the sheets S toward the paper re-feed part 66 for the purpose of forming images on non-printing surfaces of the sheets S.

Aiming at conveying a sheet S which was inverted and fed from the paper discharge part 64 as described above to a gate roller pair 637 of the paper feed part 63 along a paper re-feed path 664 (dot-dot-dash line), the paper re-feed part 66 is formed of three paper re-feed roller pairs 661 through 663 which are disposed along the paper re-feed path 664 as shown in FIG. 1. In this manner, the sheet S sent from the paper discharge part 64 is returned to the gate roller pair 637 along the paper re-feed path 664 and a non-printing surface of the sheet S is directed toward the intermediate transfer belt 41 within the paper feed part 63, which makes it possible to secondarily transfer the image onto the non-printing surface.

In FIG. 2, denoted at 113 is an image memory which is disposed in the main controller 11 such that the image memory stores image data supplied from an external apparatus such as a host computer through the interface 112, denoted at 127 is a RAM which temporarily stores control data for controlling the engine part E, a calculation result obtained by the CPU 123, etc., and denoted at 128 is a ROM which stores a calculation program which is executed by the CPU 123.

B. Density Adjustment by Image Forming Apparatus

Now, a description will be given on how the image forming apparatus having such a structure as described above adjusts a density of an image.

Figure 3:
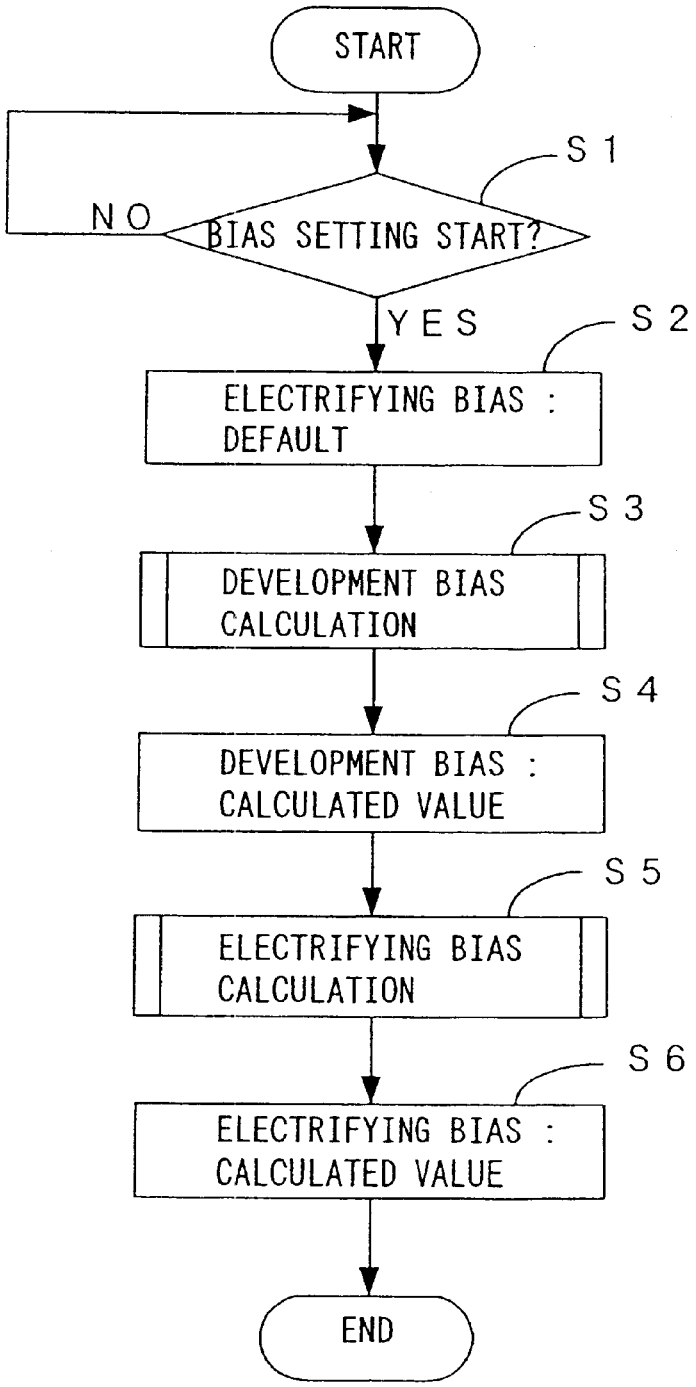
FIG. 3 is a flow chart showing a density adjustment operation in the image form apparatus of FIG. 1.

FIG. 3 is a flow chart showing a density adjustment operation in the image forming apparatus of FIG. 1. In the image forming apparatus, as shown in FIG. 3, it is determined at a step S1 whether the density adjustment operation should be executed to thereby update an electrifying bias and a development bias. For example, the image forming apparatus may start setting the biases when the image forming apparatus becomes ready to form an image after a main power source of the image forming apparatus is turned on. Alternatively, the image forming apparatus may set the biases every few hours while a timer (not shown) disposed in the image forming apparatus measures hours of continuous use.

When it is determined YES at the step S1 and setting of the biases is accordingly started, steps S2 and S3 are executed to calculate an optimal development bias, and the calculated bias is set as the development bias (step S4). Following this, a step S5 is executed to calculate an optimal electrifying bias, and the calculated bias is set as the electrifying bias (step S6). The electrifying bias and the development bias are optimized in this manner. In the following, a detailed description will be given on an operation of each one of the development bias calculation (step S3) and the electrifying bias calculation (step S5).

B-1. Development Bias Calculation

Figure 4:
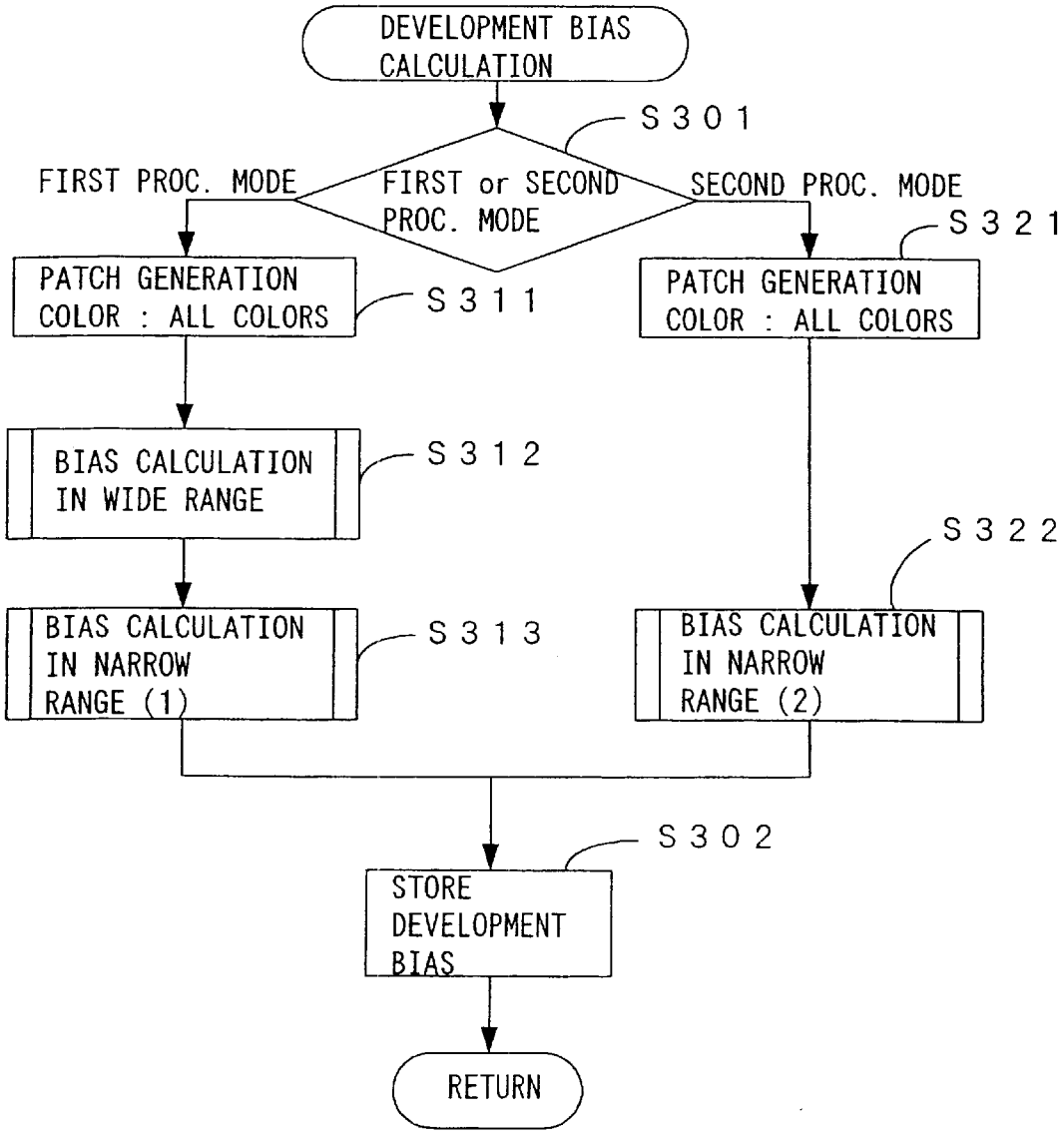
FIG. 4 is a flow chart showing an operation of development bias calculation of FIG. 3.

FIG. 4 is a flow chart showing an operation of the development bias calculation shown in FIG. 3. In the development bias calculation (step S3), either one of a first processing mode and a second processing mode is selected as a processing mode, in accordance with an operation status of the apparatus (step S301). In the first processing mode, a two-stage development bias calculation is carried out. The first stage (step S312) is for calculating an interim value of an optimal development bias while changing a development bias within a wide range (which is the entire programmable range of development biases). The second stage (step S313) is for determining the optimal development bias while changing a development bias based on the interim value within a narrow range (which is approximately ⅓ of the programmable range), as described later. As such, the first processing mode is suitable to where it is not possible to predict a state of the engine part E. Meanwhile, in the second processing mode, a single-stage development bias calculation is carried out. The bias calculation (step S322) is for determining an optimal development bias while changing a development bias within the narrow range (which is approximately ⅓ of the programmable range) which contains a precedent optimal development bias, as described later. Therefore, the second processing mode is suitable to where a change in a state of the engine part E is small. In the preferred embodiment, selection at the step S301 is specifically executed in accordance with the following criteria.

(1) Power turn-on: First processing mode

Since it is totally impossible to predict a state of the engine part E at turning on of the power source, an optimal development bias is determined while changing a development bias within the entire programmable range of development biases.

(2) Return from sleeping after a sleep period not exceeding a predetermined period: Second processing mode Upon return from sleeping, it is possible that a state of the engine part E has largely changed. However, since the change in the state of the engine part E is assumed small when the sleep period was short, an optimal development bias is determined while changing a development bias within the narrow range (which is approximately ⅓ of the programmable range) which contains a precedent optimal development bias.

(3) Return from sleeping with a fixing temperature of the fixing unit 5 is the predetermined temperature or higher: Second processing mode Upon return from sleeping, it is possible that a state of the engine part E has largely changed. However, since the change in the state of the engine part E is assumed small when a fixer, a heat source or the like disposed within the fixing unit 5 is maintained at a high temperature, an optimal development bias is determined while changing a development bias within the narrow range (which is approximately ⅓ of the programmable range) which contains a precedent optimal development bias.

(4) Return from sleeping (excluding (2) and (3) above): First processing mode

Since a state of the engine part E may have largely changed upon return from sleeping except for the situations (2) and (3) above, an optimal development bias is determined while changing a development bias within the entire programmable range of development biases.

(5) Images are formed continuously: Second processing mode

When images are formed continuously, it is unlikely that a state of the engine part E changes largely from that during previous density adjustment. Hence, an optimal development bias is determined while changing a development bias within the narrow range (which is approximately ⅓ of the programmable range) which contains a precedent optimal development bias.

When the first processing mode is selected based on the criteria as described above, first development bias calculation (steps S311 through S317 and S302) is executed to determine an optimal development bias. On the contrary, when the second processing mode is selected, second development bias calculation (steps S321, S322 and S302) is executed to determine an optimal development bias. Now, this will be described separately in the following.

B-1-1. First Development Bias Calculation (First Processing Mode)

In the first development bias calculation, as shown in FIG. 4, after setting up such that patch images will be created in all colors (which are the four colors of yellow (Y), cyan (C), magenta (M) and black (K) in this preferred embodiment) (step S311), a plurality of patch images are formed while gradually changing the development bias at relatively long intervals within a relatively wide range at an immediately subsequent step S312. In this manner, a development bias, which is necessary to obtain an optimal image density, is tentatively calculated as an interim development bias based on densities of the respective patch images. Now, an operation of this processing will be described in detail with reference to FIGS. 5 and 6A through 6D.

Figure 5:
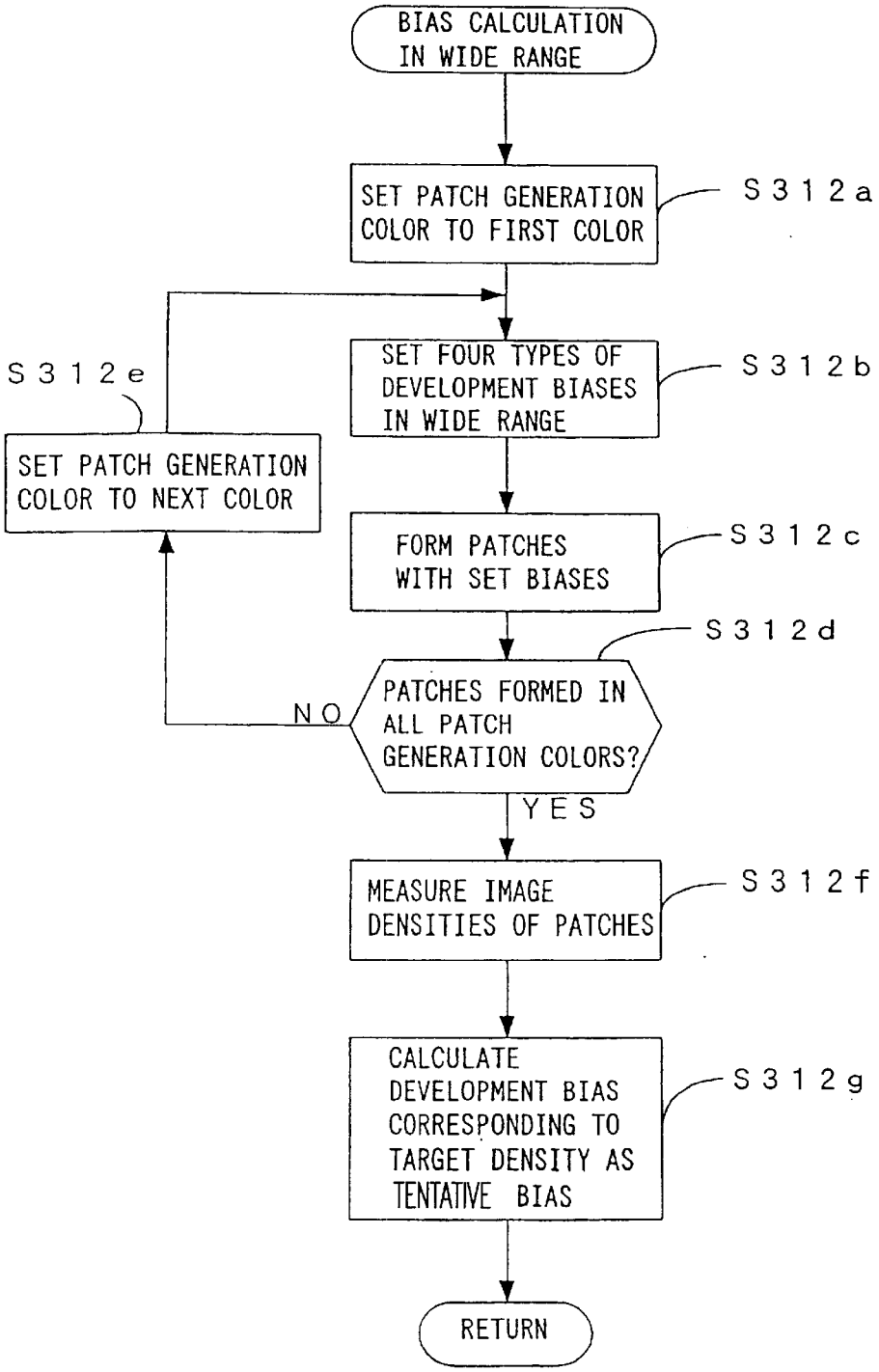
FIG. 5 is a flow chart showing an operation of the bias calculation of FIG. 4 in a wide range.

FIG. 5 is a flow chart showing an operation of the bias calculation of FIG. 4 within a wide range. FIGS. 6A through 6D are schematic diagrams showing an operation of the processing of FIG. 5 and an operation of the bias calculation within narrow range which will be described later. During this calculation, a color in which patch images are to be generated is set as the first color, e.g., yellow (step S312*a*). With the electrifying bias set to a default value which is set in advance at the step S2, the development bias is set to four different values which are apart at relatively long intervals (first intervals) within the wide range (step S312*b*). For instance, in this preferred embodiment, the wide range is the entirety of a programmable range (Vb01–Vb10) of development bias which can be supplied to the developer part 23 from the development bias generation part 125, and four points Vb01, Vb04, Vb07 and Vb10 within the wide range (Vb01–Vb10) are set as development biases. In this manner, according to this preferred embodiment, the first intervals W1 are:

$$W1=Vb10-Vb07=Vb07-Vb04=Vb04-Vb01$$

Figure 7:
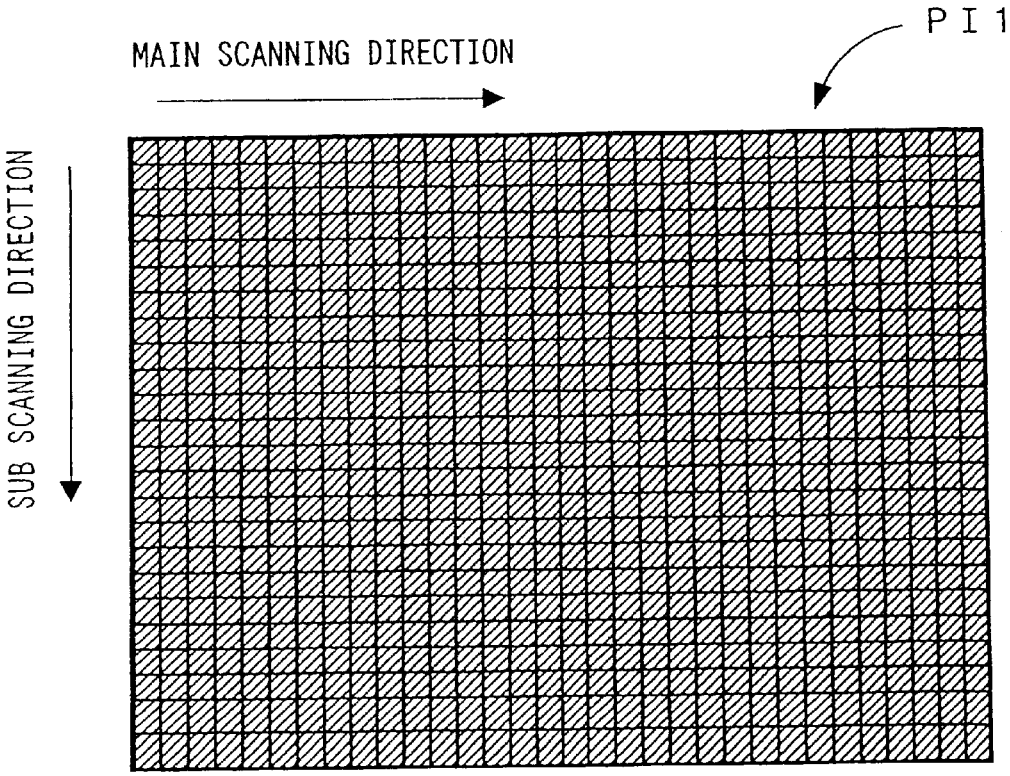
FIG. 7 is a drawing showing a first patch image.
Figure 8A:
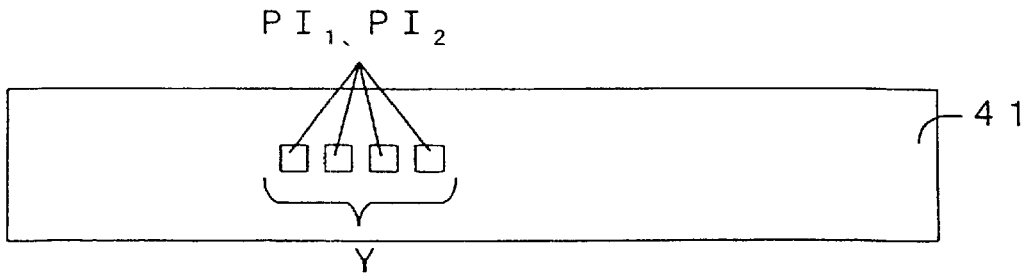
FIGS. 8A through 8D are drawings showing an order of forming patch images.

Four yellow solid images (FIG. 7) are sequentially formed on the photosensitive member 21 with this bias setup, and the solid images are transferred onto the outer peripheral surface of the intermediate transfer belt 41 in a predetermined arrangement order as shown in FIG. 8A to thereby form first patch images PI1 (step S312*c*). The first patch images PI1 are solid images in this preferred embodiment. The reason of this will be described in detail later.

Figure 8B:
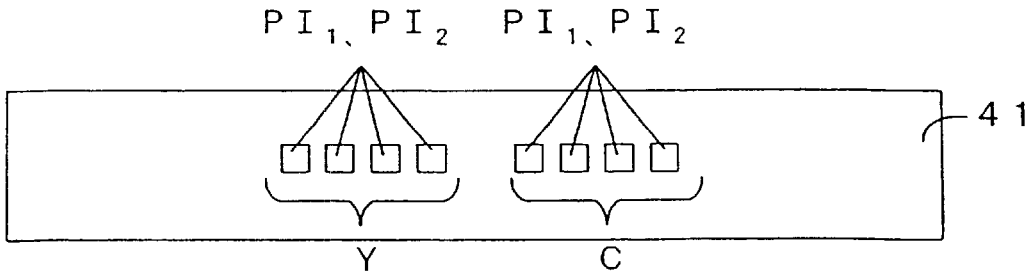
Figure 8C:
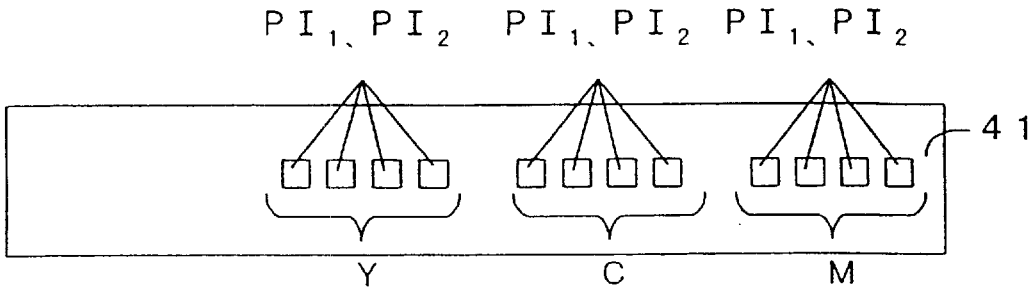
Figure 8D:
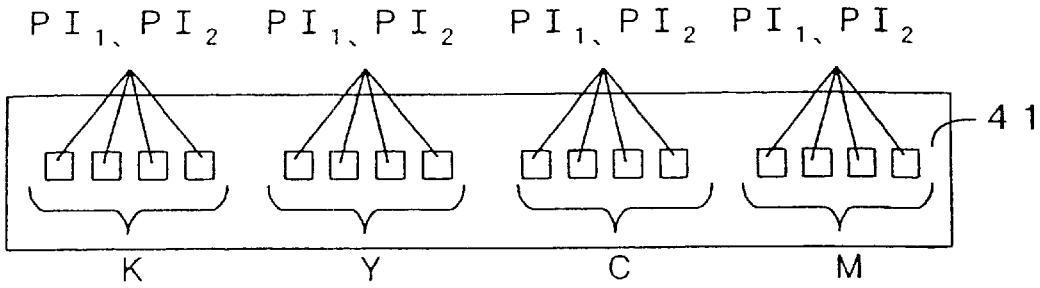

At a subsequent step S312*d*, whether patch images are formed in all of patch generation colors is determined. While a result of the judgement stays NO, the next color is set as a patch generation color (step S312*e*) and the steps S312*b* and S312*c* are repeated. This adds further first patch images PI1 on the outer peripheral surface of the intermediate transfer belt 41, in the order of cyan (C), magenta (M) and black (K), as shown in FIGS. 8B through 8D.

On the contrary, when it is determined YES at the step S312*d*, image densities of the sixteen (=4 types×4 colors) patch images PI1 are measured on the basis of a signal outputted from the patch sensor PS (step S312*f*). While the image densities of the patch images PI1 are measured one by one starting with the patch image PI1 at the head position (which is the black (K) patch image in this preferred embodiment) after forming the patch images PI1 in all of the patch generation colors in this preferred embodiment, the image densities of the patch images PI1 may be measured sequentially color by color every time the patch images PI1 in one patch generation color are formed. This applies to the later bias calculation (FIGS. 9, 11, 13, 14, 17 and 47) as well.

Figure 6A:
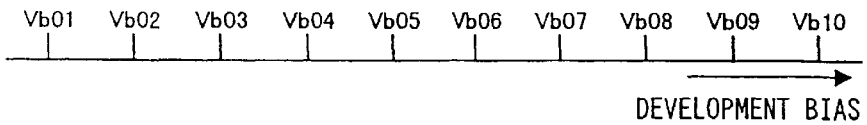
FIGS. 6A through 6D are schematic diagrams showing an operation of the processing of FIG. 5 and an operation of the bias calculation in a narrow range.
Figure 6B:
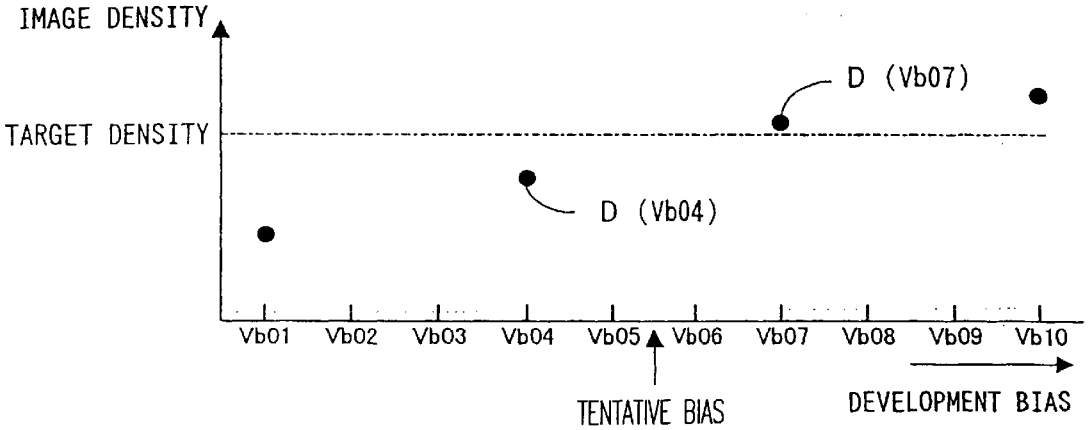

Following this, a development bias corresponding to a target density is calculated at a step S312*g*, and the calculated bias is stored temporarily in the RAM 127 as an interim bias. When a measurement result (image density) matches with the target density, a development bias corresponding to this image density may be used as the interim bias. When the two density values fail to match, as shown in FIG. 6B, it is possible to calculate an interim bias through linear interpolation, averaging or other appropriate methodology in accordance with data D (Vb04) and data D (Vb07) which are on the both sides of the target density.

Figure 6C:
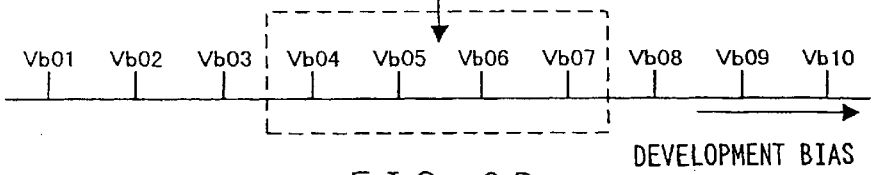
Figure 9:
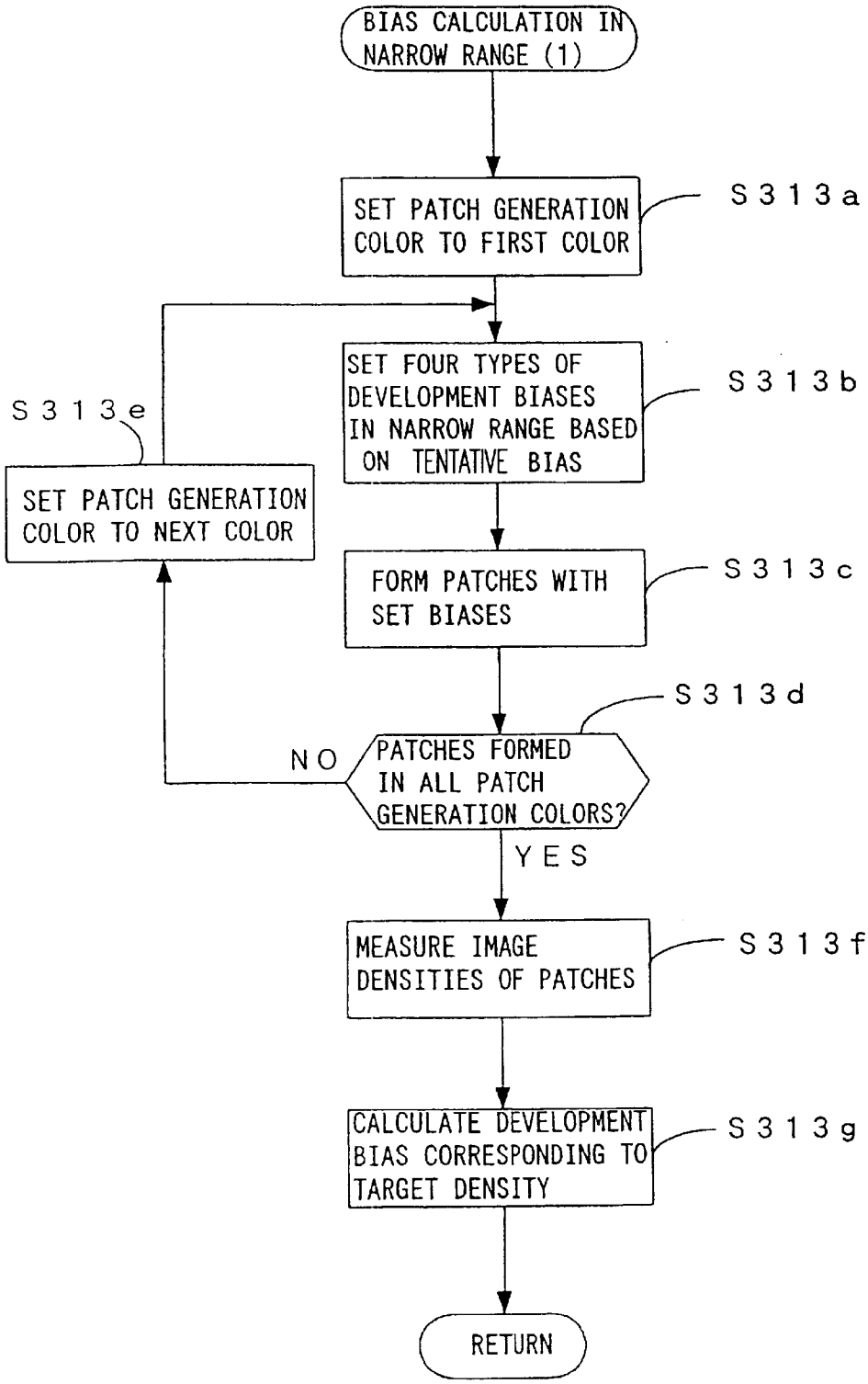
FIG. 9 is a flow chart showing an operation of bias calculation (1) of FIG. 4 in the narrow range.

Once the interim bias is determined in this manner, the bias calculation (1) in the narrow range shown in FIG. 4 is executed. FIG. 9 is a flow chart showing an operation of the bias calculation (1) of FIG. 4 in the narrow range. During this calculation, a color in which patch images are to be generated is set as the first color, e.g., yellow (step S313*a*), as in the earlier calculation (step S312). With the electrifying bias set to the default value which is set in advance at the step S2, the development bias is set to four different values which are apart at narrower intervals (second intervals) than the first intervals W1 within a narrow range which includes the interim bias (step S313*b*). For instance, in this preferred embodiment, the narrow range is approximately ⅓ of the programmable range (Vb01–Vb10) of development bias. When the interim bias is between development biases Vb05 and Vb06 as shown in FIG. 6B, four points Vb04, Vb05, Vb06 and Vb07 are set as development biases (FIG. 6C). In this manner, according to this preferred embodiment, the second intervals W2 are:

$$W2=Vb07-Vb06=Vb06-Vb05=Vb05-Vb04$$

Four yellow solid images (FIG. 7) are sequentially formed on the photosensitive member 21 with this bias setup, and the solid images are transferred onto the outer peripheral surface of the intermediate transfer belt 41 as shown in FIG. 8A to thereby form first patch images PI1 (step S313*c*). As in the earlier calculation (step S312), the next color is set as a patch generation color (step S313*e*) and the steps S313*b* and S313*c* are repeated until it is determined at a step S313*d* that patch images are formed in all of patch generation colors. As a result, first patch images PI1 are further formed on the outer peripheral surface of the intermediate transfer belt 41, in the order of cyan (C), magenta (M) and black (K).

Figure 6D:
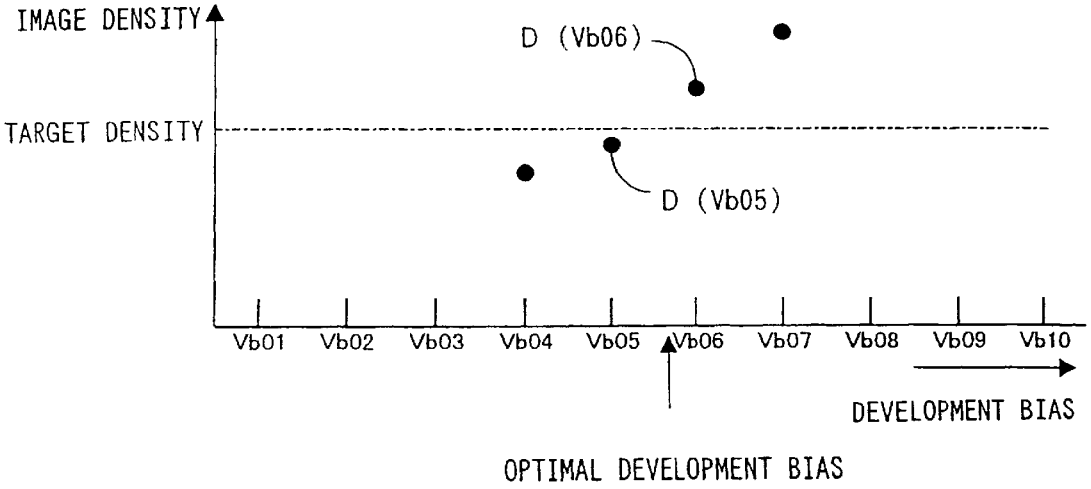

Once sixteen (=4 types×4 colors) patch images PI1 are formed on the intermediate transfer belt 41 in this manner, the patch sensor PS measures image densities of the patch images PI1 one by one starting with the patch image PI1 at the head position (which is a black (K) patch image in this preferred embodiment) (step S313*f*). Following this, at a step S313*g*, a development bias corresponding to a target density is calculated. When a measurement result (image density) matches with the target density, a development bias corresponding to this image density may be used as an optimal development bias. When the two density values fail to match, as shown in FIG. 6D, it is possible to calculate an optimal development bias through linear interpolation, averaging or other appropriate methodology in accordance with data D (Vb05) and data D (Vb06) which are on the both sides of the target density.

When optimal development biases are determined with respect to all of the patch generation colors, that is, when it is determined YES at the step S314 shown in FIG. 4, the sequence proceeds to the step S302 to allow the RAM 127 to store the optimal development biases calculated in this manner. Thereafter, the stored bias is read out as the development bias during calculation of the electrifying bias which will be described later or while an image is formed in a normal manner.

Thus, the first development bias calculation (first processing mode) carries out a two-stage bias calculation. In the first stage, patch images PI1 are formed at the first intervals W1 in the wide range to calculate a development bias, which is necessary to obtain an image having a target density, as an interim development bias. In the second stage, patch images PI1 are formed at the narrower intervals (i.e., the second intervals) W2 in the narrow range which includes the interim bias to calculate a development bias which is necessary to achieve the target density. Finally, the calculated bias is set as an optimal development bias. This realizes the following effects.

For example, upon turning on of the main power source of the image forming apparatus, it is totally impossible to predict a state of the engine part E as described earlier, it is necessary to determine an optimal development bias while changing a development bias within the entire programmable range of development biases. Therefore, the optimal development bias can be obtained by the following approach: The approach requires to divide the programmable range (Vb01–Vb10) of development biases into a plurality of narrow ranges and to execute similar processing to the bias calculation (1) described above in each one of the narrow ranges. However, this comparative approach has a problem that the number of steps to be executed increases in proportion to the number of the divided ranges and calculation of an optimal development bias therefore takes time. Conversely, if the programmable range is divided into a smaller number of narrow ranges, although the problem described earlier is solved, bias intervals within each divided range become wider than the second bias intervals W2. This creates another problem that an accuracy of calculating an optimal development bias drops down and an image density therefore can not be accurately adjusted to the target density.

In contrast, according to the above embodiment, a development bias is tentatively calculated through the bias calculation processing (step S312) in the wide range, and the development bias is changed at the narrower intervals (i.e., the second intervals) W2 in the narrow range in the vicinity of the interim bias, so that an optimal development bias is finally calculated. Hence, it is possible to more accurately calculate an optimal development bias in a shorter period of time than in the comparative approach above.

Further, a quantity of a toner relative to a development bias, namely, a development γ-characteristic which expresses a change in an image density, largely changes depending on an environmental condition, a durability condition or the like and in addition, is non-linear. Hence, the first development bias calculation (first processing mode) described above achieves the following excellent effect.

Figure 10:
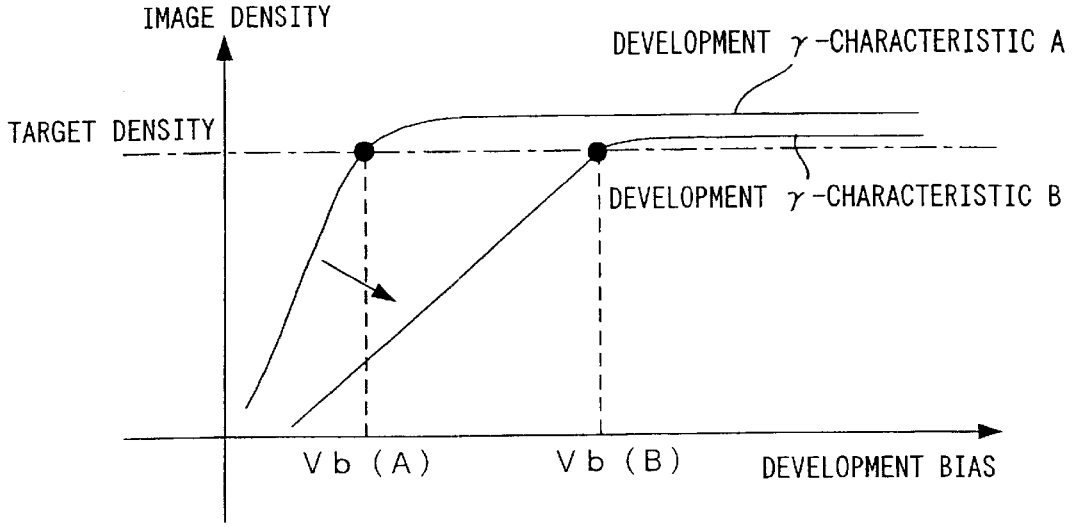
FIG. 10 is a graph showing a change in a development γ-characteristic in accordance with a change in an environmental conditional or the like in the image forming apparatus of FIG. 1.

FIG. 10 is a graph showing a typical example of a development γ-characteristic. As shown in FIG. 10, even though an image forming apparatus has a development γ-characteristic A under a certain environmental condition or the like, as the environmental condition or the like changes, the development γ-characteristic of the image forming apparatus accordingly changes from the initial development γ-characteristic A to a development γ-characteristic B. The gradient of the development γ-characteristic is susceptive to an influence of the environmental condition or the like and tends to change largely.

Thus, although an optimal development bias of the image forming apparatus has a value Vb(A) when the development γ-characteristic of the apparatus stays the development γ-characteristic A, if the development γ-characteristic changes to the development γ-characteristic B due to even a slightest change in the environmental condition or the like, the optimal development bias largely changes into a value Vb(B). Hence, considering the development γ-characteristic of such a nature, it is inevitably necessary to ensure a wide programmable range of development biases. It then follows that it is more preferable to apply the first processing mode according to the present invention to calculation of an optimal development bias as described above.

The effect of the first processing mode described above is more prominent in an image forming apparatus which uses a mono-component non-magnetic toner, for the following reason described in detail. Over the recent years, a mono-component non-magnetic toner has come into a use considering controllability of a toner temperature against a carrier, etc. An image forming apparatus which uses such a mono-component toner is characterized in that a quantity of electrification of the toner is more inclined to change depending on an environmental condition and a durability condition as compared to an image forming apparatus which uses a two-component toner. This is because the two-component toner contacts in a large area with a carrier which is mixed with the toner, and hence, tends to be electrified in a relatively stable quantity. In contrast, a mono-component toner does not contain a carrier which controls a quantity of electrification, and therefore, is electrified only with an electrification mechanism which is disposed inside the developer. Due to this, a mono-component toner contacts in a dominantly smaller area with an electrification mechanism than a two-component toner contacts with a carrier. Thus, it is more preferable to apply the present invention to an image forming apparatus which uses a mono-component non-magnetic toner.

Further, an external additive is added in a larger quantity than usual to a toner, e.g., 1.5% or more in some cases, in an effort to improve the transferability of the toner. In this case as well, the usefulness of the present invention is remarkable. This is because the external additive is also susceptible to an influence by an environment. When the quantity of the external additive is 1.5% or more, due to an environmental influence, a development γ-characteristic changes largely. Therefore, it is more preferable to apply the present invention to an image forming apparatus which uses such a toner. In the case of an image forming apparatus of the intermediate transfer method such as the image forming apparatus according to the preferred embodiment described above, an improved transferability is strongly demanded. This has led to a tendency to use more external additive than in an image forming apparatus of other methods, which makes the present invention even more useful.

Considering the foregoing comprehensively, when applied to an image forming apparatus and an image forming method which use a mono-component non-magnetic toner which contains an external additive in the quantity of 1.5% or more, the present invention more remarkably attains the excellent effect that it is possible to efficiently and highly accurately determine an optimal value of a density controlling factor which is needed to adjust an image density of a toner image to a target density.

B-1-2. Second Development Bias Calculation (Second Processing Mode)

The preferred embodiment described above requires to execute the second development bias calculation to determine an optimal development bias when the second processing mode is selected at the step S301 in FIG. 4, on the ground that a change in a state of the engine part E is assumed to be small in a situation which meets the criterion (2), (3) or (5) described earlier. In other words, while an optimal electrifying bias and an optimal development bias change due to fatigue, degradation with age or the like of a photosensitive member and a toner, the changes possess a continuity to a certain extent. Hence, it is possible to estimate an optimal development bias based on a result of immediately precedent measurement of an image density of electrifying biases (step S313*f*, step S322*g* which will be described later) in a situation which meets the criterion (2), (3) or (5) described earlier. Noting this, during the development bias calculation (step S3) according to the preferred embodiment, when it is judged that the criterion (2), (3) or (5) described earlier is met, the processing is simplified as described below to thereby accurately calculate an optimal development bias in a short period of time.

During the second development bias calculation, after setting up such that patch images will be created in all colors (which are the four colors of yellow (Y), cyan (C), magenta (M) and black (K) in this preferred embodiment) (step S321), the sequence proceeds to the step S322 at which the bias calculation (2) within the narrow range is executed, whereby an optimal development bias is calculated without calculating an interim bias. In the following, an operation of the processing will be described with reference to FIG. 11.

Figure 11:
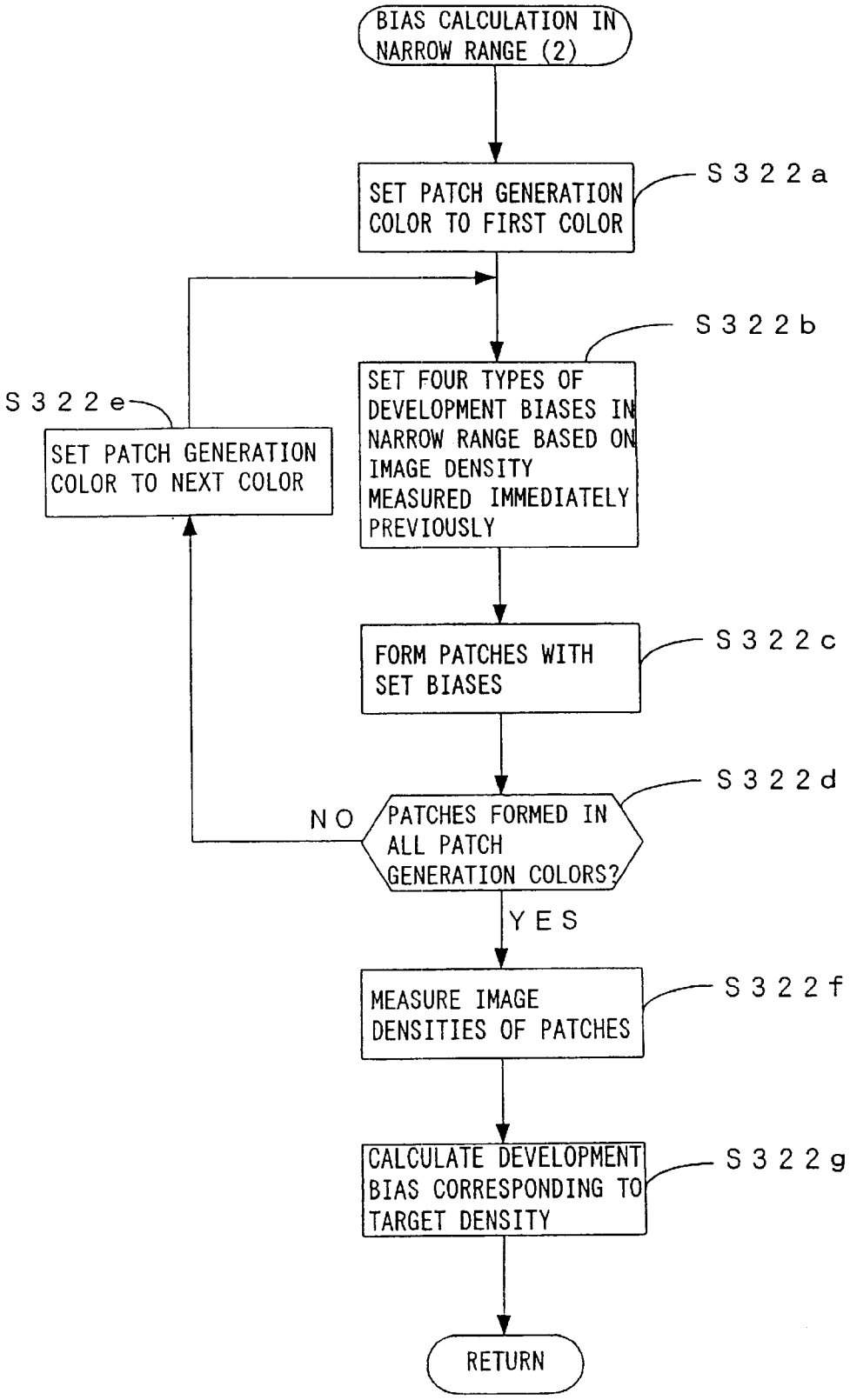
FIG. 11 is a flow chart showing an operation of bias calculation (2) of FIG. 4 in the narrow range.

FIG. 11 is a flow chart showing an operation of the bias calculation (2) of FIG. 4 within the narrow range. FIGS. 12A and 12B are schematic diagrams showing the operation of the processing shown in FIG. 11. This calculation processing is largely different from the bias calculation (1) within the narrow range described earlier in regard to the following. During the calculation (1) shown in FIG. 9, the electrifying bias set to the default value, and four different types of development biases are set based on an interim bias (step S313*b*). Meanwhile, during the bias calculation (2), the electrifying bias is the optimal electrifying bias which is calculated through immediately preceding measurement and stored in the RAM 127, and four different types of development biases are set within the narrow range based on the optimal development bias which is stored in the RAM 127 (step S322*b*). The bias calculation (2) is structured otherwise the same as the bias calculation (1), and therefore, a redundant description will be simply omitted.

In this manner, during the second processing mode (step S322), the four different types of development biases are set. The four biases are apart at the second intervals within the narrow range using the development bias which is calculated immediately previously (preceding optimal development bias) without calculating an interim bias, the patch images are formed in the respective colors, and the optimal development bias is calculated. Hence, as compared to the first processing mode (step S312+step S313), it is possible to calculate an optimal development bias in a further shorter time.

In addition, as compared with the conventional technique (which is described in Japanese Patent Application Laid-Open Gazette No. 10-239924), the present invention realizes a unique effect that it is possible to calculate an optimal development bias at a high accuracy. The reason of this will now be described. According to the conventional technique, three pairs of an electrifying bias and a development bias are stored in advance, and patch images are formed using the three development biases, respectively. Hence, in order to cover a range of possible changes in the development biases, namely, a range which is approximately the same as the programmable range of development bias, it is necessary to set the three development biases at relatively long intervals.

In contrast, according to this preferred embodiment, the development bias is changed within the narrow range including the immediately preceding optimal development bias out of the programmable range (Vb01–Vb10) of development bias. That is, this preferred embodiment requires only approximately ⅓ of the programmable range of development bias, and the intervals of the development biases according to this preferred embodiment (second intervals) are narrower than those used in the conventional technique. Due to this, the present invention allows to calculate an optimal development bias at a better accuracy. It is to be noted that a simple reduction of the range in which a development bias is to be changed causes an optimal development bias to be calculated to deviate from the reduced range and only makes it difficult to accurately calculate an optimal development bias. However, according to this preferred embodiment, since the narrow range is set around an immediately preceding optimal development bias, it is extremely unlikely to see such a problem.

The engine controller 12 writes the optimal development bias which is calculated in this manner over the preceding optimal development bias which is already stored in the RAM 127, thereby updating the optimal development bias (step S302 in FIG. 4). The sequence thereafter returns to FIG. 3 which requires to read the optimal development bias from the RAM 127 and set the retrieved optimal development bias as the development bias. An optimal electrifying bias is thereafter calculated (step S5) and set as the electrifying bias (step S6).

B-2. Optimal Electrifying Bias Calculation

Figure 13:
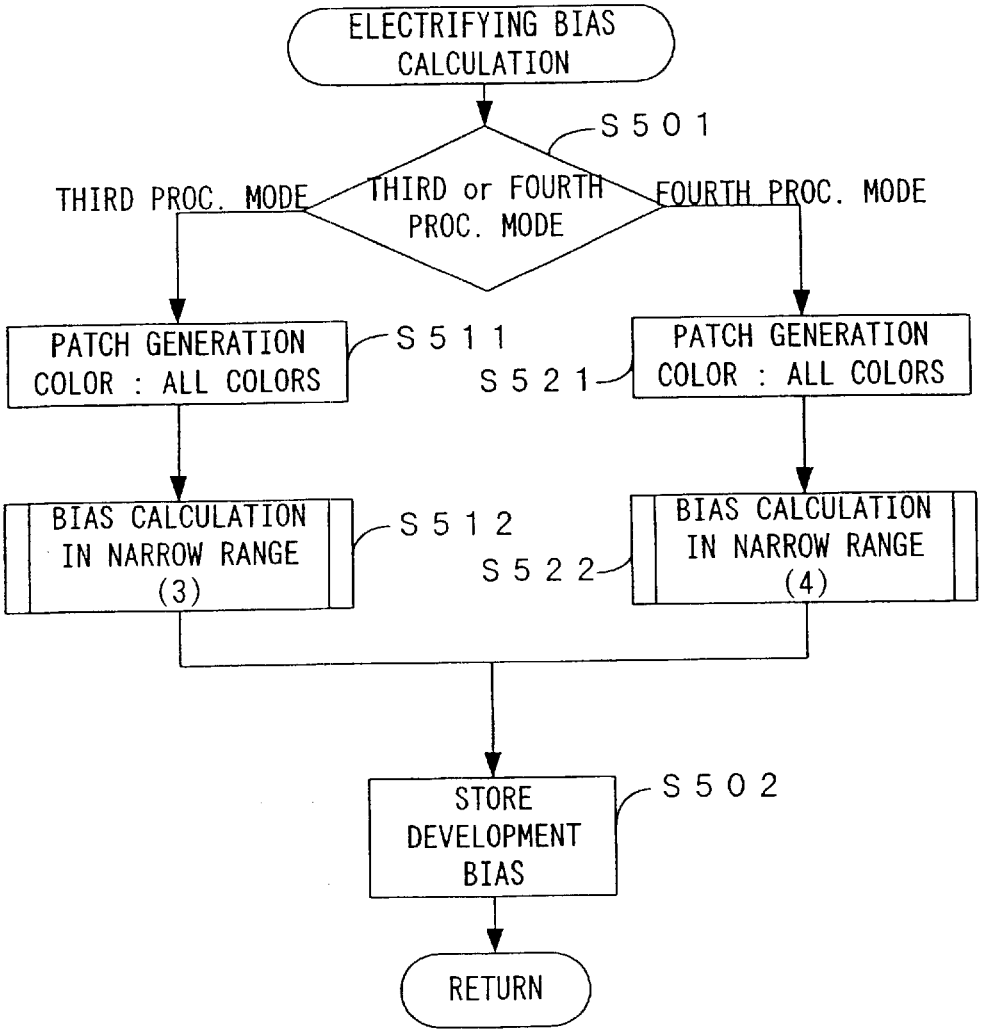
FIG. 13 is a flow chart showing an operation of the electrifying bias calculation of FIG. 3.

FIG. 13 is a flow chart showing an operation of the electrifying bias calculation of FIG. 3. During the electrifying bias calculation (step S5), as in the development bias calculation, either one of a third processing mode and a fourth processing mode is selected as a processing mode, in accordance with an operation status of the apparatus (step S501). The third processing mode is for forming a plurality of patch images while changing an electrifying bias within the narrow range (which is approximately ⅓ of the programmable range) which contains a predetermined default value. As such, the third processing mode is suitable to where it is not possible to predict a state of the engine part E. Meanwhile, the fourth processing mode is for determining an optimal electrifying bias while changing an electrifying bias within the narrow range (which is approximately ⅓ of the programmable range) which contains a precedent optimal electrifying bias, as described later. Therefore, the fourth processing mode is suitable to where a change in a state of the engine part E is small. In the preferred embodiment, selection at the step S501 is specifically executed in accordance with the following criteria.

(1) Power turn-on: Third processing mode

Since it is totally impossible to predict a state of the engine part E at turning on of the power source, an optimal electrifying bias is determined while changing an electrifying bias within the narrow range (which is approximately ⅓ of the programmable range) which contains the predetermined default value.

(2) Return from sleeping after a sleep period not exceeding a predetermined period: Fourth processing mode Upon return from sleeping, it is possible that a state of the engine part E has largely changed. However, since the change in the state of the engine part E is assumed small when the sleep period was short, an optimal electrifying bias is determined while changing an electrifying bias within the narrow range (which is approximately ⅓ of the programmable range) which contains a precedent optimal electrifying bias.

(3) Return from sleeping with a fixing temperature of the fixing unit 5 is the predetermined temperature or higher: Fourth processing mode Upon return from sleeping, it is possible that a state of the engine part E has largely changed. However, since the change in the state of the engine part E is assumed small when a fixer, a heat source or the like disposed within the fixing unit 5 is maintained at a high temperature, an optimal electrifying bias is determined while changing an electrifying bias within the narrow range (which is approximately ⅓ of the programmable range) which contains a precedent optimal electrifying bias.

(4) Return from sleeping (excluding (2) and (3) above): Third processing mode

Since a state of the engine part E may have largely changed upon return from sleeping except for the situations (2) and (3) above, an optimal electrifying bias is determined while changing an electrifying bias within the narrow range (which is approximately ⅓ of the programmable range) which contains the predetermined default value.

(5) Images are formed continuously: Fourth processing mode

When images are formed continuously, it is unlikely that a state of the engine part E changes largely from that during previous density adjustment. Hence, an optimal electrifying bias is determined while changing an electrifying bias within the narrow range (which is approximately ⅓ of the programmable range) which contains a precedent optimal electrifying bias.

When the third processing mode is selected based on the criteria as described above, first electrifying bias calculation (steps S511, S512, S502) is executed to determine an optimal electrifying bias. On the contrary, when the fourth processing mode is selected, second electrifying bias calculation (steps S521, S522, S502) is executed to determine an optimal electrifying bias. Now, this will be described separately in the following.

B-2-1. First Electrifying Bias Calculation (Third Processing Mode)

In the first electrifying bias calculation, as shown in FIG. 13, after setting up such that patch images will be created in all colors (which are the four colors of yellow (Y), cyan (C), magenta (M) and black (K) in this preferred embodiment) (step S511), the sequence proceeds to the step S512. At the step S512, a plurality of patch images are formed while changing an electrifying bias to four different values which are apart at relatively short intervals within the narrow range containing the predetermined default value. Thereafter, an electrifying bias, which is needed to obtain a target density, is calculated based on densities of the respective patch images. Now, an operation of the processing will be described with reference to FIGS. 14 through 16.

Figure 14:
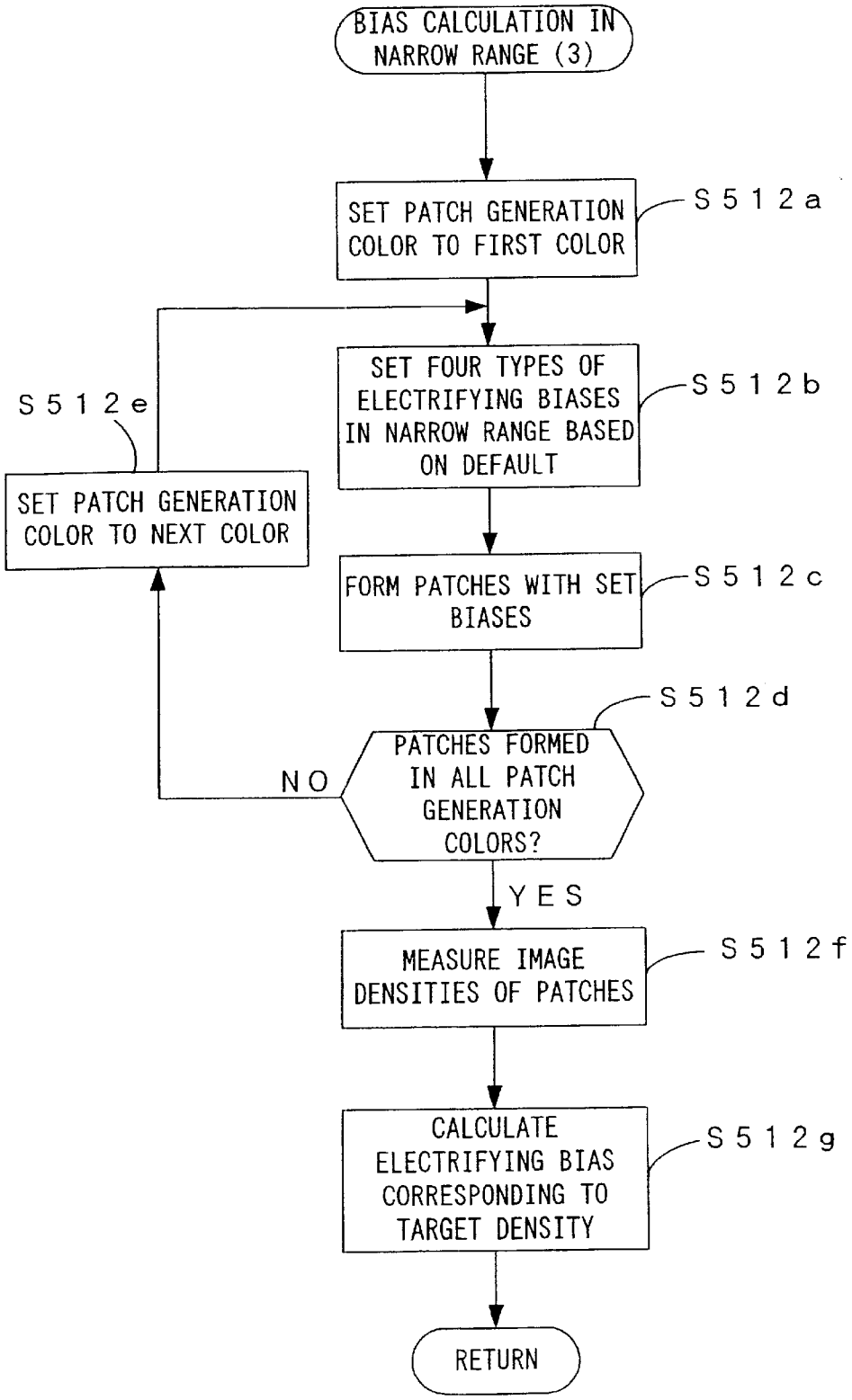
FIG. 14 is a flow chart showing an operation of bias calculation (3) of FIG. 13 in the narrow range.
Figure 15A:
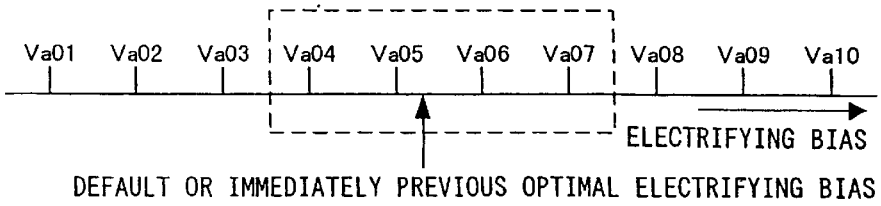
FIGS. 15A and 15B are schematic diagrams showing the operation of the processing of FIG. 14.
Figure 15B:
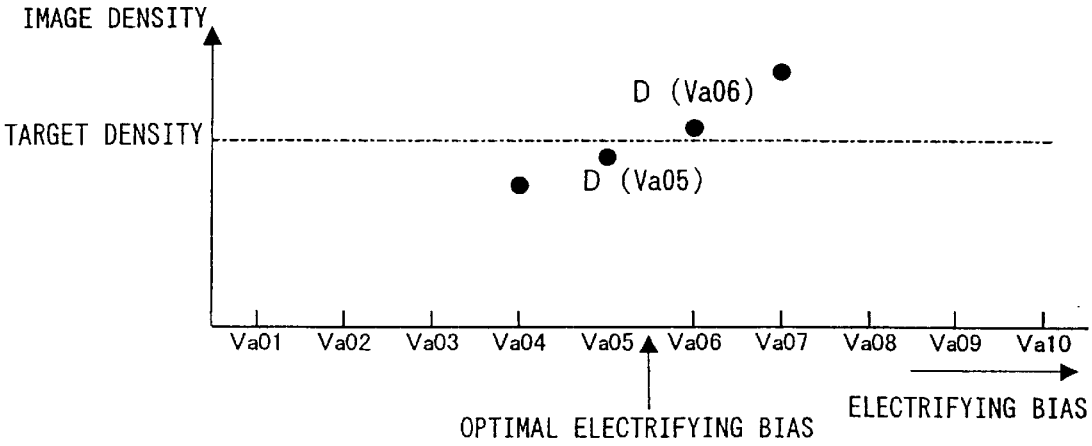
Figure 16:
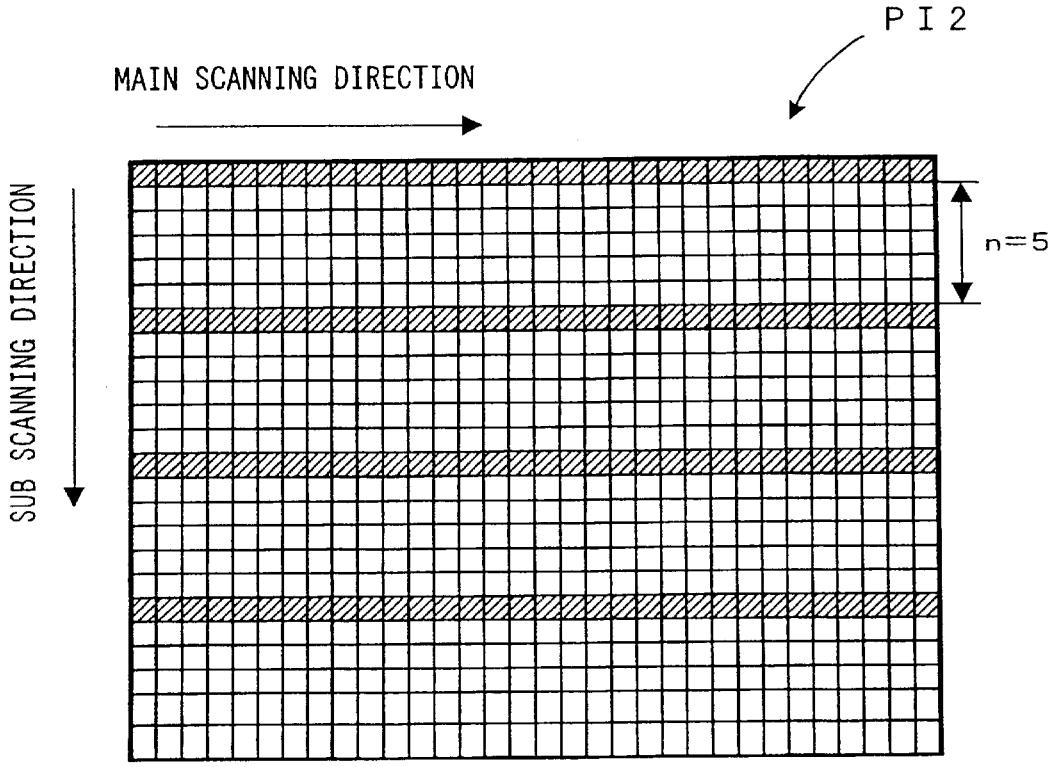
FIG. 16 is a drawing showing a second patch image.

FIG. 14 is a flow chart showing the operation of the processing at the step S512, i.e., bias calculation (3) of FIG. 13 in the narrow range. FIGS. 15A and 15B are schematic diagrams showing the operation of the processing shown in FIG. 14. During the calculation, a color in which patch images are to be generated is set as the first color, e.g., yellow (step S512*a*). The electrifying bias is set to four different values. The four biases are apart at relatively narrow intervals (third intervals) within the narrow range which includes the default value (step S512*b*). In this manner, unlike the development bias calculation, the electrifying bias calculation executes only narrow-range calculation without calculating within the wide range. In this preferred embodiment, the narrow range is approximately ⅓ of a programmable range (Va01–Va10) of electrifying bias. When the default value or an immediately preceding optimal electrifying bias is between electrifying biases Va05 and Vb06 as shown in FIG. 15A, four points Va04, Va05, Va06 and Va07 are set as electrifying biases. That is, according to this preferred embodiment, the third intervals W3 are:

$$W3=Va07-Va06=Va06-Va05=Va05-Va04$$

Once four types of electrifying biases are set up for the yellow color in this manner, while gradually increasing the electrifying bias from the lowest value Va04, respective yellow halftone images (See FIG. 16) are sequentially formed on the photosensitive member 21 and transferred onto the outer peripheral surface of the intermediate transfer belt 41, whereby second patch images PI2 are formed (FIG. 8A: step S512*c*). The electrifying bias is increased stepwise because when an electrifying bias is to be changed stepwise, increasing the electrifying bias achieves a superior response of the power source as compared to decreasing the electrifying bias. In the preferred embodiment above, the second patch images PI2 are halftone images which are defined by a plurality of one-dot lines which are arranged parallel to each other but apart from each other at the intervals of five lines (n=5). The reason of this will be described in detail later together with the reason why the first patch images are solid images.

At a subsequent step S512*d*, whether the second patch images are formed in all of patch generation colors is judged. While a result of the judgement stays NO, the next color is set as a patch generation color (step S512*e*) and the steps S512*b* through S512*d* are repeated. This adds further second patch images PI2 on the outer peripheral surface of the intermediate transfer belt 41, in the order of cyan (C), magenta (M) and black (K), as shown in FIGS. 8B through 8D.

On the contrary, when it is determined YES at the step S512*d*, image densities of the sixteen (=4 types×4 colors) patch images PI2 are measured on the basis of a signal outputted from the patch sensor PS (step S512*f*). Following this, an electrifying bias corresponding to a target density is calculated (step S512*g*). When a measurement result (image density) matches with the target density, an electrifying bias corresponding to this image density may be used as an optimal electrifying bias. When the two density values fail to match, as shown in FIG. 15B, it is possible to calculate an optimal electrifying bias through linear interpolation, averaging or other appropriate methodology in accordance with data D (Va05) and data D (Va06) which are on the both sides of the target density.

Once optimal electrifying biases are determined with respect to all of the patch generation colors in this manner, the sequence proceeds to the step S502 at which the RAM 127 stores the optimal electrifying biases calculated in the manner described above. The RAM 127 reads out the optimal electrifying biases and set them as an electrifying bias while an image is formed in a normal manner.

B-2-2. Second Electrifying Bias Calculation (Fourth Processing Mode)

In the preferred embodiment, for a similar reason to that described in relation to the development bias calculation, when the fourth processing mode is selected at the step S501 in FIG. 13, the second electrifying bias calculation is executed to determine an optimal electrifying bias.

During the second electrifying bias calculation, after setting up such that patch images will be created in all colors (which are the four colors of yellow (Y), cyan (C), magenta (M) and black (K) in this preferred embodiment) (step S521), the sequence proceeds to the step S522 to execute bias calculation (4) in the narrow range and calculate an optimal electrifying bias (step S522).

Figure 17:
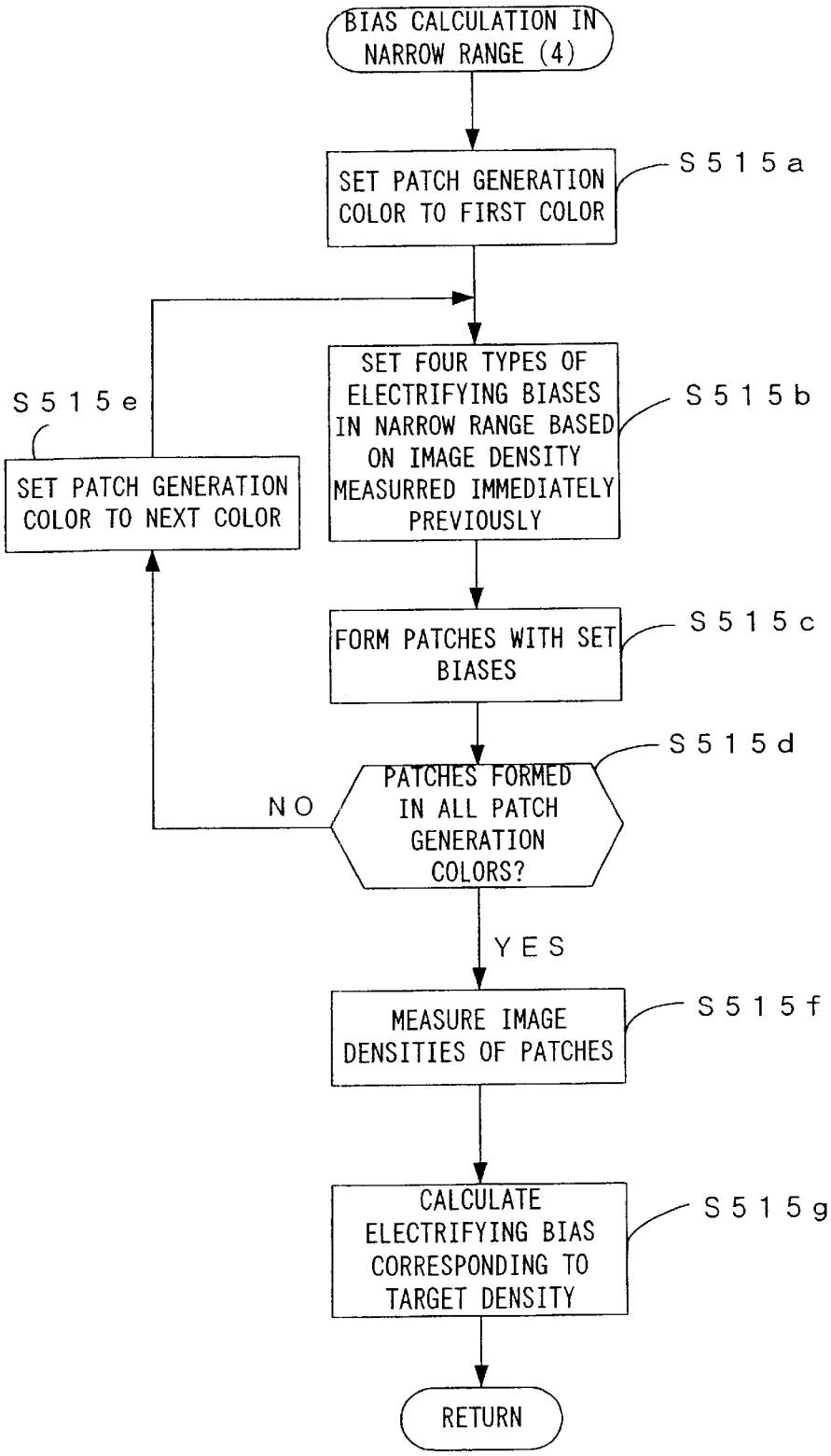
FIG. 17 is a flow chart showing an operation of bias calculation (4) of FIG. 13 in the narrow range.

FIG. 17 is a flow chart showing an operation of the bias calculation (4) of FIG. 13 in the narrow range. This calculation processing is largely different from the bias calculation (3) described earlier in that four types of electrifying biases are set in the narrow range based on electrifying biases found and stored in the RAM 127 (step S515*b*), unlike in the calculation (3) shown in FIG. 14 where four types of electrifying biases are set in the narrow range based on the default value (step S512*b*). The bias calculation (4) is otherwise the same in structure as the calculation (3), and therefore, the identical structure will not be described.

After calculating optimal electrifying biases with respect to all of the patch generation colors, the sequence proceeds to the step S502 at which the RAM 127 stores the optimal electrifying biases calculated as described above. The RAM 127 reads out the optimal electrifying biases and set them as an electrifying bias while an image is formed in a normal manner.

B-3. Effect of Preferred Embodiment

As described above, according to this preferred embodiment, since the first and the second processing modes are prepared to determine an optimal development bias and either one of the first processing mode and the second processing mode is selected as a processing mode in accordance with an operation status of the apparatus, it is possible to select and execute the most appropriate processing mode in accordance with an operation status. Hence, it is possible to efficiently and highly accurately determine an optimal value of a development bias which is one density controlling factor.

This similarly applies to electrifying biases. That is, since the third and the fourth processing modes are prepared to determine an optimal electrifying bias and either one of the third processing mode and the fourth processing mode is selectively executed as a processing mode in accordance with an operation status of the apparatus, it is possible to select and execute the most appropriate processing mode in accordance with an operation status. Hence, it is possible to efficiently and highly accurately determine an optimal value of an electrifying bias which is one density controlling factor.

According to this preferred embodiment, it is possible to calculate an optimal electrifying bias and an optimal development bias without using an electrifying bias/development bias characteristic which is essential in the conventional technique to adjust an image density. Hence, it is possible to adjust an image density to a target density and accordingly stabilize the image density in a simple manner. Further, even despite a change with time in an electrifying bias/development bias characteristic, this preferred embodiment allows to accurately calculate an optimal electrifying bias and an optimal development bias without an influence of the change.

Further, as described above, since calculation of an optimal development bias is achieved in the two stages of bias calculation in the wide range (step S312) and bias calculation in the narrow range (step S313), it is possible to calculate the optimal development bias at a high accuracy in a short period of time.

Further, this preferred embodiment makes it possible to calculate an optimal electrifying bias and an optimal development bias, adjust an image density to a target density, and stabilize the image density. According to this preferred embodiment, in particular, each patch image PI2 is formed by a plurality of one-dot lines which are arranged apart from each other. Since an image density of each such patch image PI2 is detected and an image density of a toner image is adjusted to a target density based on the detected image densities of the patch images PI2, it is possible to stabilize an image density of not only a line image which is formed by a P-dot ($P \geqq 2$) line but of a line image which is formed by a one-dot line, and hence, to stably form a fine image with an appropriate image density.

Further, with respect to calculation of an optimal electrifying bias, since the electrifying bias calculation is executed with an optimal development bias calculated through immediately preceding calculation set as a development bias, it is possible to accurately calculate an optimal electrifying bias.

C. Patch Images

By the way, the following is the reason why solid images are used as the first patch images for calculation of a development bias, while for calculation of an electrifying bias, used as the second patch images are halftone images in which a plurality of one-dot lines are arranged parallel to each other but apart from each other at intervals of n lines.

Figure 18A:
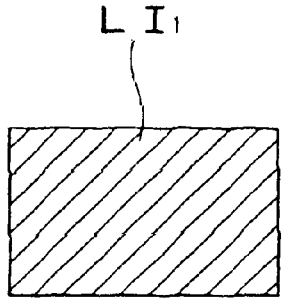
FIGS. 18A and 18B are drawings showing a relationship between the first patch images, a surface potential and a development bias potential.
Figure 18B:
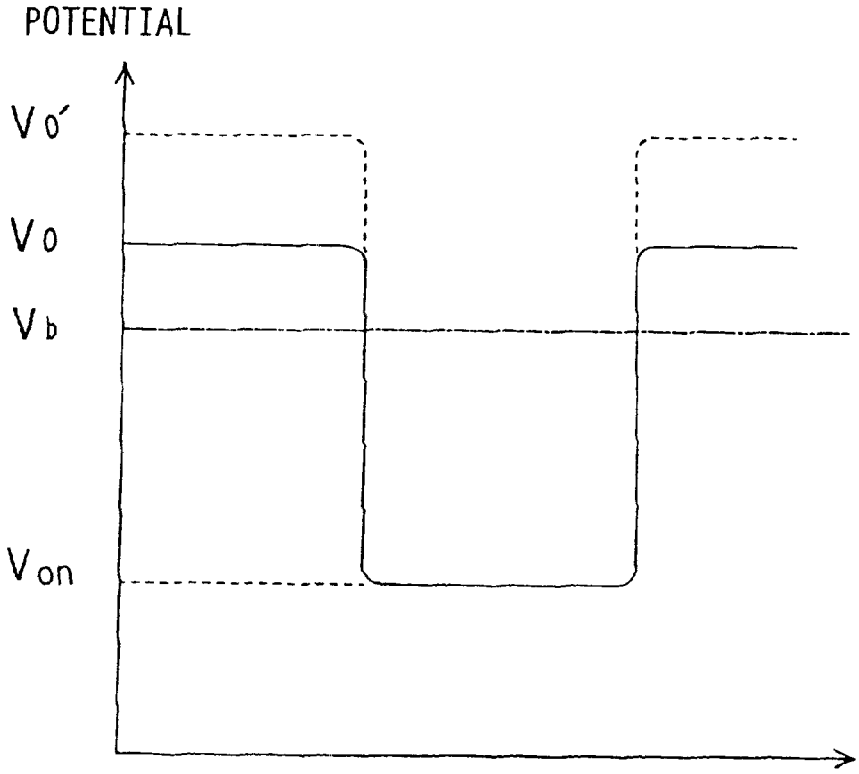

As an electrostatic latent image LI1 of a solid image (first patch image) PI1 (See FIG. 7) is formed on the surface of the photosensitive member 21 which is electrified uniformly at a surface potential V0, a surface potential corresponding to the electrostatic latent image LI1 largely drops down to a potential (exposed area potential) Von as shown in FIGS. 18A and 18B, whereby a well potential is developed. Now, even if the electrifying bias is increased to raise the surface potential of the photosensitive member 21 from the potential V0 up to a potential V0', the exposed area potential will not depart largely from the potential Von. Hence, a toner density is determined only in accordance with the development bias Vb despite any small change in the electrifying bias.

Figure 19A:
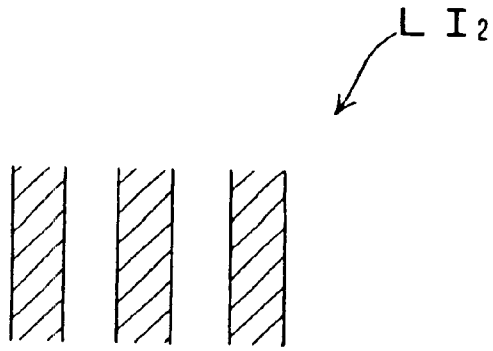
FIGS. 19A and 19B are drawings showing a relationship between the second patch images, a surface potential and a development bias potential.
Figure 19B:
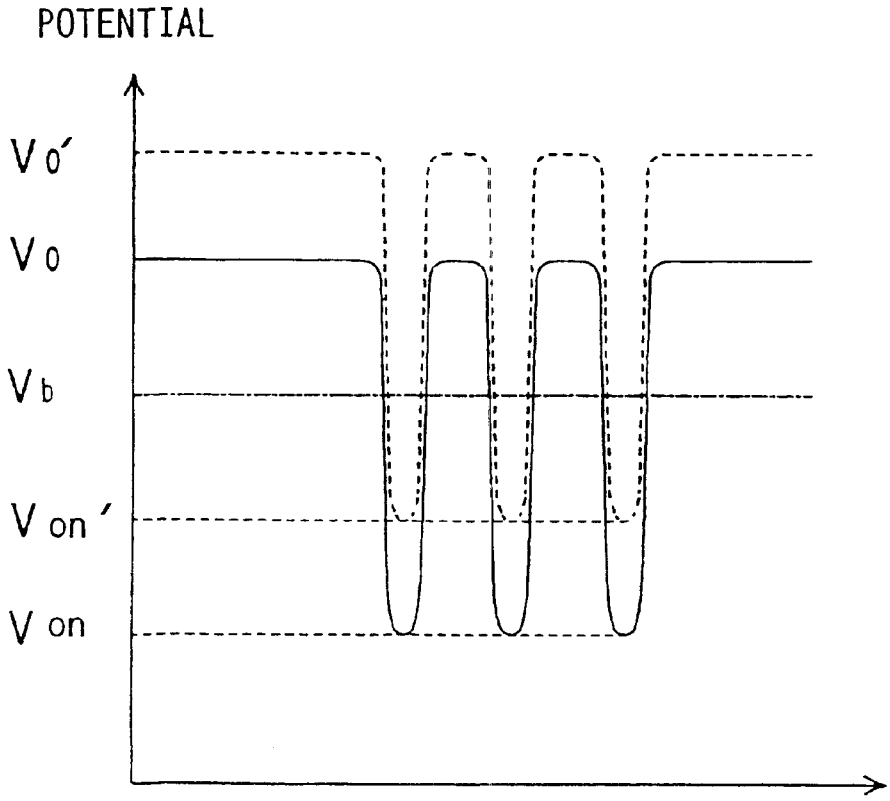

Meanwhile, a halftone image (second patch image) PI2 (See FIG. 16) contains one-dot lines DL formed at predetermined intervals. As an electrostatic latent image LI2 of the halftone image is formed on the surface of the photosensitive member 21 which is electrified uniformly at a surface potential V0, surface potentials corresponding to the positions of the lines largely drop down to the potential (exposed area potential) Von, as shown in FIGS. 19A and 19B. As a result, a comb-shaped well potential is developed. If the electrifying bias is increased in a similar manner to described above to raise the surface potential of the photosensitive member 21 from the potential V0 up to the potential V0', the exposed area potential corresponding to each line changes greatly from the potential Von to a potential Von'. Hence, as the electrifying bias changes, a toner density corresponding to the development bias Vb changes with the change in the electrifying bias. A relationship between such bias setup (the optimal development bias and the optimal electrifying bias) and a toner density will be described in detail in "D. Setting of Electrifying Bias in Development Bias Calculation" below.

From the above, it is found that use of a solid image reduces the influence of the electrifying bias over the toner density, and therefore, it is possible to adjust an image density of the solid image by means of adjustment of the development bias. In short, when the development bias calculation is executed using solid images as the first patch images as in the preferred embodiment above, it is possible to accurately calculate an optimal development bias regardless of the value of the electrifying bias.

Further, to form an image in a stable manner, adjustment at a maximum gradation (maximum density) alone is not sufficient. Density adjustment of a line image is necessary as well. However, when halftone images of line images are used, as shown in FIGS. 19A and 19B, the set development bias and the set electrifying bias strongly influence an eventual image. To deal with this, the preferred embodiment above requires to calculate an optimal development bias first. While changing the electrifying bias with the development bias set to the optimal development bias, the second patch images of halftone images are formed. As a result, therefore, the optimal electrifying bias needed to obtain an image density which meets the target density is calculated.

Figure 20:
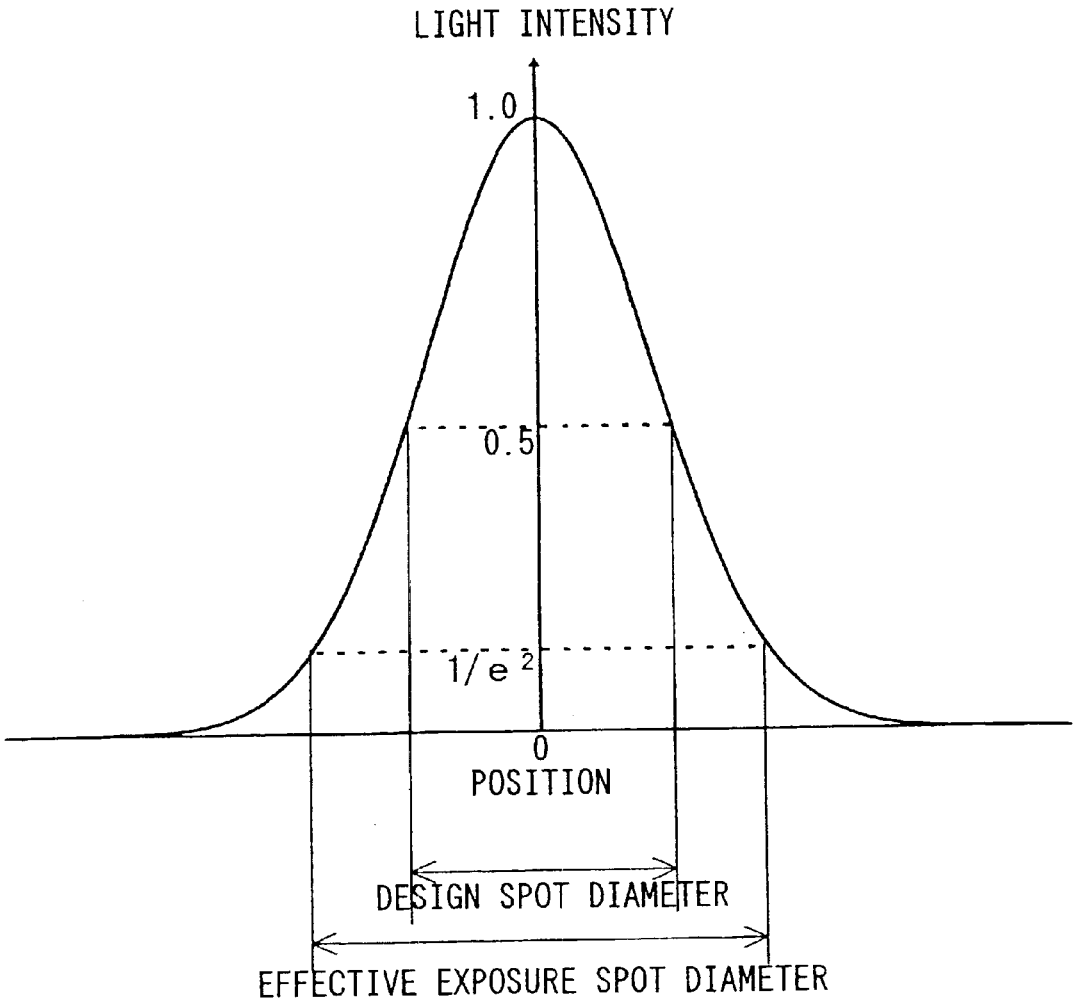
FIG. 20 is a graph showing a light intensity distribution of laser light which is irradiated onto a surface of a photosensitive member.

In addition, a line image (second patch image PI2) is formed by a halftone image which is obtained by arranging a plurality of one-dot lines parallel to each other but apart from each other at intervals of n lines, for the following reason. That is, although one approach to adjust an image density of a one-dot line is to form the second patch image PI2 as a single one-dot line and detect a density of the one-dot line with the patch sensor PS, since an image density of a one-dot line is extremely low, it is difficult to detect an image density of a one-dot line with the patch sensor PS. Noting this, the present invention requires to form a patch image with a plurality of one-dot lines to solve this problem.

Where a patch image is formed by a plurality of one-dot lines, the issue is how to arrange the one-dot lines for the following reason. Laser light L irradiated toward the photosensitive member 21 from the exposure unit 3 has a light intensity distribution of a Gaussian type as that shown in FIG. 20, for example. In a normal apparatus design, in most cases, a design spot diameter is set which is needed to attain a design resolution. An apparatus is designed such that a spot diameter approximately at 50% of a maximum light intensity matches a design resolution. However, an effective exposure spot diameter corresponding to $1/e^2$ which is effective as an exposure power is larger than the design spot diameter. Hence, when a line interval between adjacent one-dot lines DL is narrow, a toner adheres between the lines. In other words, if the line interval n between the adjacent one-dot lines DL (FIG. 19A) is one line, adjacent effective exposure spots partially overlap with each other, a surface potential at the overlap position changes, and a toner adheres. Because of this, it is necessary that a line interval between adjacent one-dot lines DL is at least two lines or more.

Conversely, the following problem occurs if the line intervals are too wide. That is, a sensitivity of the patch sensor PS to detect an image density is closely related with the number of one-dot lines DL which are contained in a detect area of the patch sensor PS. Where a density change of each one-dot line DL is X and the number of lines covered by the detect area is m, an image density change Δ detected by the patch sensor PS is:

$$\Delta = m \cdot X$$

Figure 21A:
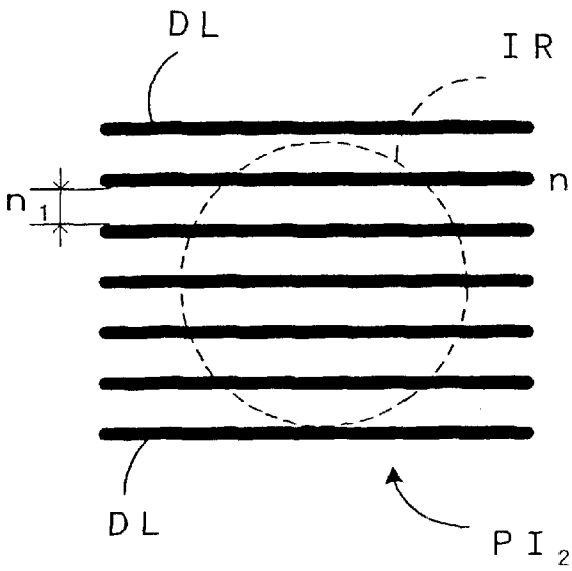
FIGS. 21A and 21B are schematic diagrams showing a relationship between one-dot lines and a detect area which a patch sensor detects, with a change in line intervals.

Thus, the larger the number of lines contained in the detect area is, the higher the detect sensitivity is. For instance, as shown in FIG. 21A, with line intervals of n1, when the number of lines contained in the detect area IR of the patch sensor PS is five, an image density change Δa is:

$$\Delta a = 5 \cdot X$$

Figure 21B:
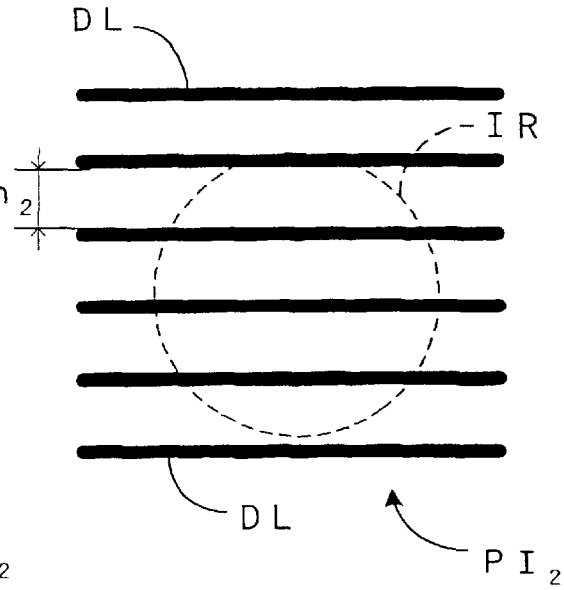

On the other hand, as shown in FIG. 21B, with line intervals n2 (>n1), the number of lines contained in the detect area IR of the patch sensor PS decreases to four, and therefore, an image density change Δb is:

$$\Delta b = 4 \cdot X$$

thereby decreasing the detect sensitivity.

While results of various experiments have identified that it is necessary to improve the detect sensitivity of the patch sensor PS approximately one digit in order to ensure sufficient density adjustment, the number of lines contained in the detect area IR must be set to ten or larger for that purpose. Now, where the size of the detect area IR is ϕ (mm) and the design resolution of the apparatus, namely, the number of dots contained in a unit length (1 mm) is R, if the line intervals are n, the number of lines m within the detect area IR is:

$$m = \phi \cdot R/(1+n)$$

For the number of lines m to be ten or larger, the following must be satisfied:

$$\phi \cdot R/(1+n) \geqq 10$$

Modifying the inequality, $$n \leqq (\phi \cdot R - 10)/10 \quad (1)$$

Thus, if the line intervals n are set so as to satisfy the inequality (1) above, it is possible to detect image densities of the patch images PI2 at an excellent detect sensitivity.

Figure 22A:
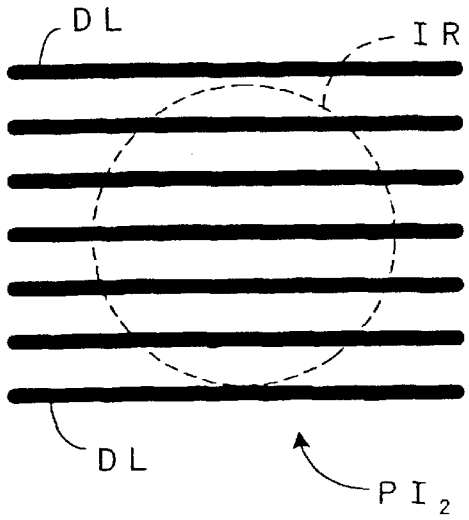
FIGS. 22A and 22B are views for describing a detect deviation which occurs as positions of the detect area of the patch sensor and one-dot lines change relative to each other.
Figure 22B:
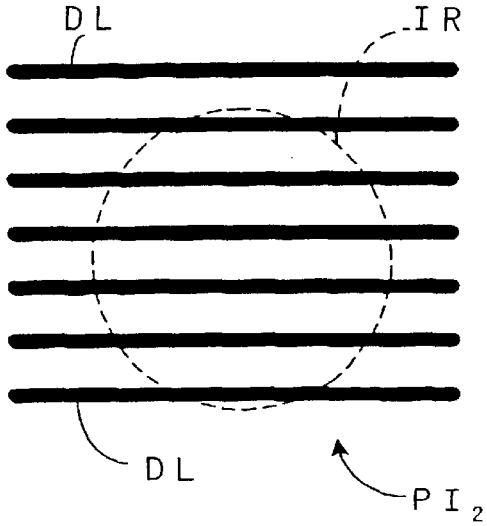

While where the patch sensor PS is to read image densities, repeated reading while changing a read position aims at improving the detect accuracy. If images to be detected are patch images in which one-dot lines are arranged parallel to each other but apart from each other at predetermined intervals, due to positional differences between the detect area of the patch sensor PS and the patch images relative to each other, the number of one-dot lines contained in the detect area differs maximum one line. When the detect area IR of the patch sensor PS and the patch image PI2 are positioned relative to each other as shown in FIG. 22A, for example, the number of one-dot lines DL contained in the detect area IR is five, whereas the relative positions are as shown in FIG. 22B, the number of the lines is six. Hence, even though the patch sensor PS reads the same patch image PI2, the patch sensor PS detects different image densities in the two different situations, and the detect deviation between the two different situations is:

$$\text{Detect deviation } (\%) = (1/m) \times 100$$

where m denotes the number of the lines contained in the detect area IR. Thus, the larger the number of the lines m contained in the detect area IR becomes, the smaller the detect deviation becomes. This makes it possible to improve the accuracy of measurement.

For highly accurate control of densities, it is necessary to suppress the detect deviation to 5% or smaller, and therefore, it is desirable to set the number of the lines m to twenty or larger. In short, the inequality below must be satisfied:

$$\phi \cdot R/(1+n) \geqq 20$$

Modifying the inequality, $$n \leqq (\phi \cdot R-20)/20 \quad (2)$$

Thus, if the line intervals n are set so as to satisfy the inequality (2) above, it is possible to suppress the detect deviation and detect image densities of the patch images PI2 at an even better detect accuracy.

An actual example as described below was tried to verify the condition above regarding the line intervals. In the actual example, patch images were created while changing the line intervals n under the following conditions and voltages detected by the patch sensor PS were measured, thereby obtaining a graph as that shown in FIG. 23:

Design resolution R:23.6 lines/mm (600 DPI); and

Size of detect area IR of patch sensor PSϕ:8 mm

The result in the graph well matches with the condition described above regarding the line intervals.

Figure 23:
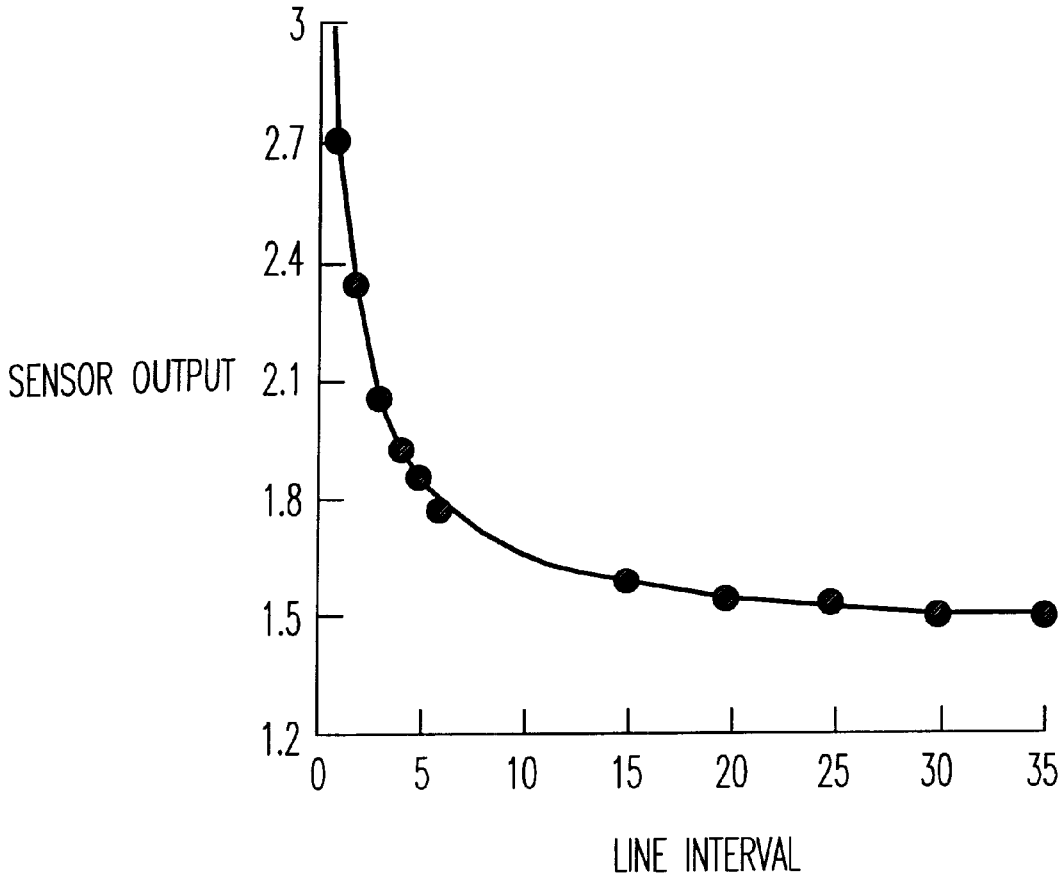
FIG. 23 is a graph showing a change in an output from the patch sensor with a change in line intervals.

That is, while it is necessary to set the line intervals n to two or larger in order to avoid a mutual influence between adjacent one-dot lines, as clearly seen in FIG. 23, if the line intervals n are set to 1, it is not possible to distinguish from solid images.

On the contrary, it is desirable to set the line intervals n such that the inequality (1) above is satisfied in order to obtain a sufficient detect sensitivity. Therefore, in the actual example, it is desirable to set the line intervals n to seventeen or smaller, i.e., satisfy the following:

$$n \leqq (8 \times 23.6-10)/10=17.88(\text{lines})$$

In this respect, as clearly seen in FIG. 23, if the line intervals n are 18 or larger, it is not possible to distinguish from a blank image, and hence, it is difficult to accurately detect image densities.

Further, it is desirable to satisfy the inequality (2) described above for highly accurate detection with a suppressed detect deviation. Therefore, in the actual example, it is desirable to set the line intervals n to eight or smaller, i.e., satisfy the following:

$$n \leqq (8 \times 23.6-20)/20=8.44(\text{lines})$$

Thus, it is most desirable to set the line intervals n to five in the actual example.

Figure 24:
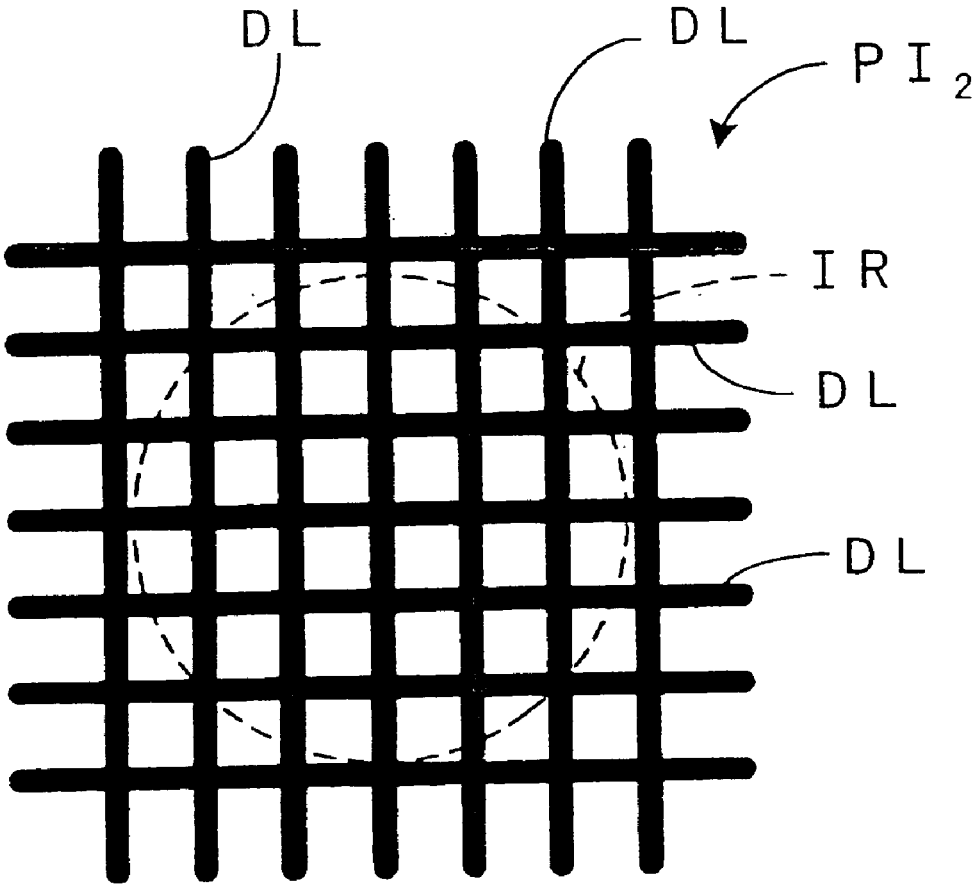
FIG. 24 is a schematic diagram of other preferred embodiment of a patch image.

In addition, although the patch images PI2 are images which are obtained by arranging a plurality of one-dot lines DL parallel to each other but apart from each other at the predetermined intervals n in the preferred embodiment above, as shown in FIG. 24, for instance, perpendicular lattice images PI2' may be used which are obtained by arranging a plurality of one-dot lines DL in the configuration of a lattice. In this case, the detect area IR of the patch sensor PS covers more lines, and hence, the detect sensitivity is better and a larger improvement is made to the accuracy as compared to where the patch images PI2 are formed by one-dot lines which are arranged parallel to each other (See FIG. 16). Moreover, it is possible to widen the line intervals n, owing to the increased number of lines. Widening the line intervals particularly in the sub-scanning direction reduces an influence by an uneven density in the drive direction, which in turn allows to control while detecting more stable images. Of course, a lattice structure of patch images is not limited to a perpendicular lattice, but may be various types of lattices in which case as well a similar effect is obtained.

D. Setting of Electrifying Bias in Development Bias Calculation

By the way, when second patch images are formed while changing an electrifying bias, an exposed area potential (bright part potential) Von of a latent image sometimes largely changes as the electrifying bias changes.

Figure 25:
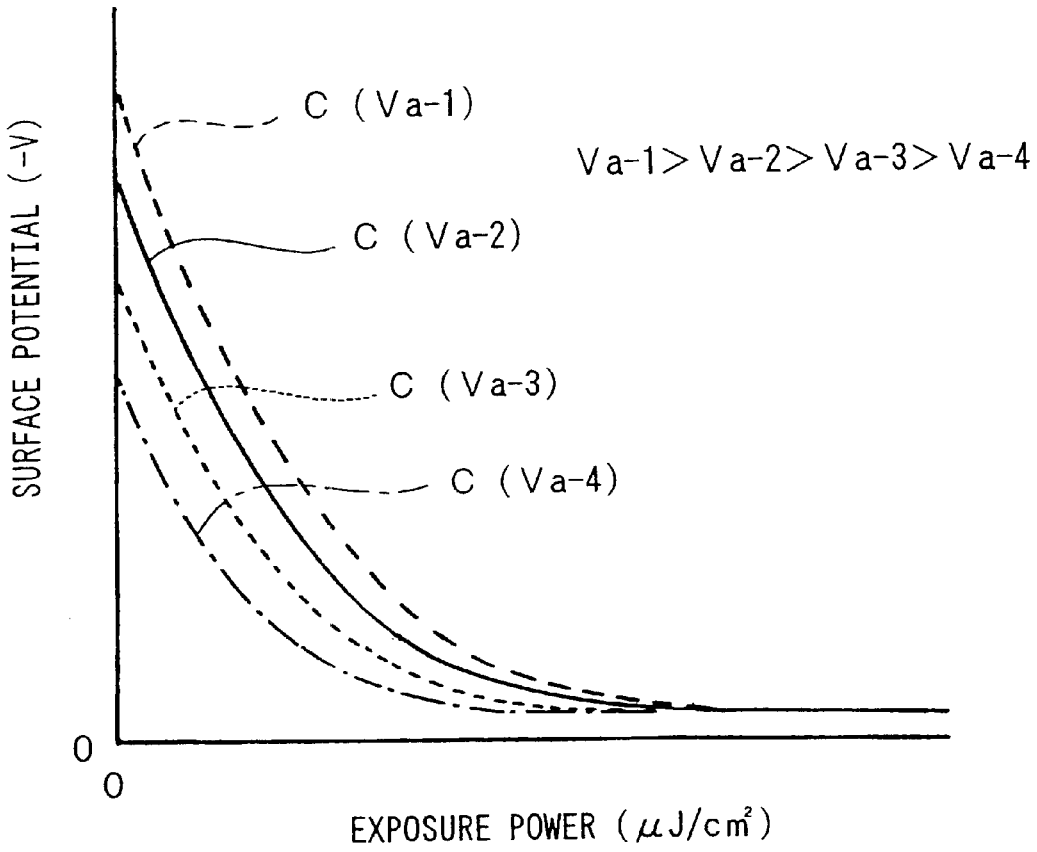
FIG. 25 is a graph showing attenuation of a surface potential as photosensitive member is exposed at various exposure powers.

FIG. 25 is a graph showing attenuation of a surface potential as a photosensitive member is exposed at various exposure powers, in which curves C(Va-1), C(Va-2), C(Va-3) and C(Va-4) express attenuation of a surface potential caused by electrification at electrifying biases Va-1 through Va-4 which are different from each other. In FIG. 25, "EXPOSURE POWER" denotes a dose of exposure applied upon a photosensitive member 21 per unit area from the exposure unit 3. As clearly shown in FIG. 25, a surface potential in a surface area of the exposed photosensitive member 21, namely, the exposed area potential changes in accordance with the electrifying bias and the exposure power supplied to the exposed photosensitive member 21 from the exposure unit 3. The exposed area potential is approximately the same between the attenuation curves regardless of a value of the electrifying bias when the exposure power is relatively large. On the other hand, the exposed area potential is different in accordance with the electrifying bias when the exposure power is relatively small. Such a tendency is as already described with reference to FIGS. 15A, 15B, 16A and 16B.

Hence, when the exposure power is set relatively high, even if the electrifying bias set during the development bias calculation is largely deviated from the optimal electrifying bias, a contrast potential (=development bias−surface potential) during the development bias calculation matches with a contrast potential after setting of the optimal electrifying bias. Therefore, it is possible to stably form an image at a target density by means of the optimal development bias and the optimal electrifying bias which are calculated according to the preferred embodiment above.

Conversely, when the exposure power is set relatively small, since the surface potential differs depending on the electrifying bias, it is sometimes impossible to stably form an image at a target density even despite setting the optimal development bias and the optimal electrifying bias which are calculated according to the preferred embodiment above. This is because when the electrifying bias set during the development bias calculation is largely deviated from the optimal electrifying bias, the contrast potential (=development bias−surface potential) during the development bias calculation becomes different from the contrast potential after setting of the optimal electrifying bias. With the contrast potential varied in such a manner, it is difficult to stabilize an image density.

Noting this, in a preferred embodiment described below, the electrifying bias is changed in accordance with a change in the development bias during the development bias calculation processing, to thereby solve the problem above which occurs when the exposure power is relatively small. First, a relationship between the development bias Vb and the contrast potential will be described before describing how the electrifying bias is specifically changed.

Figure 26:
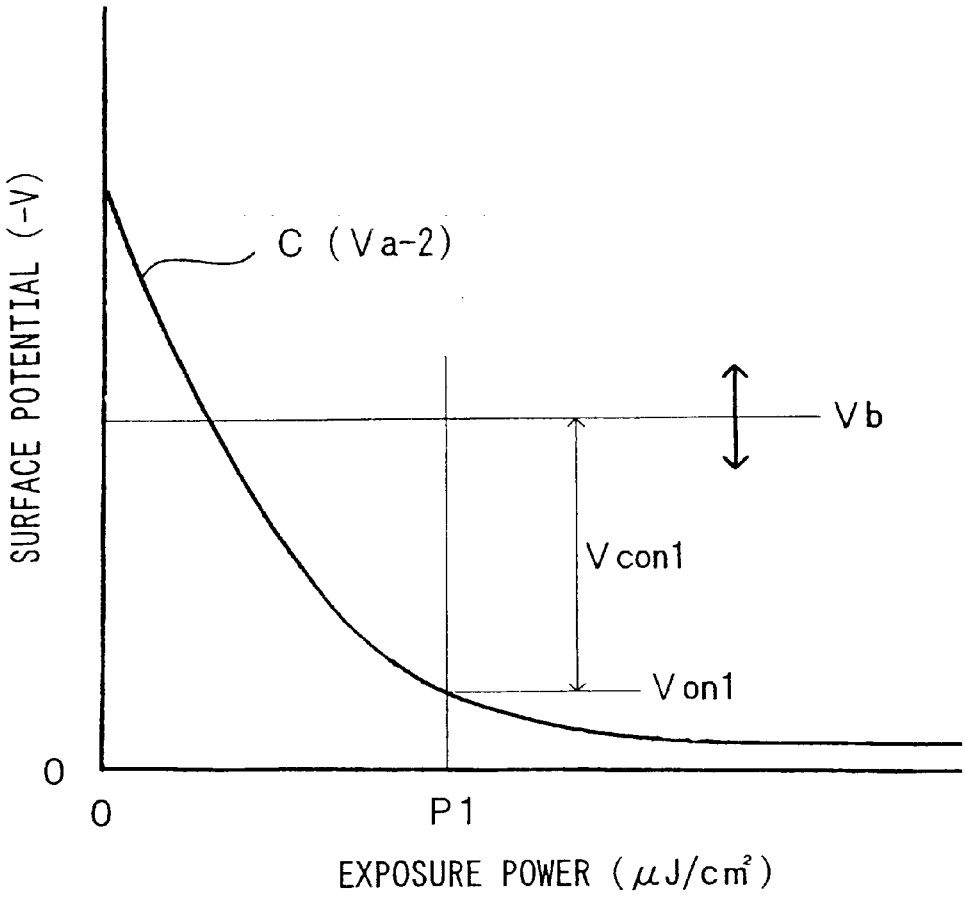
FIG. 26 is a drawing showing a relationship between a development bias and a contrast potential when the development bias is changed with an electrifying bias fixed.

During the development bias calculation processing, as shown in FIG. 26 for instance, if the electrifying bias is fixed at a bias Va-2 and latent images of first patch images are formed by exposing light at an exposure power P1, the exposed area potential of the latent images become a potential Von1. As the development bias Vb is changed in this condition, a contrast potential Vcon1 changes in accordance with the change in the development bias Vb, thereby changing densities of the first patch images. Hence, during the development bias calculation according to the preferred embodiment described above, a plurality of first patch images is formed while changing only the development bias Vb and the optimal development bias is thereafter determined.

Figure 27:
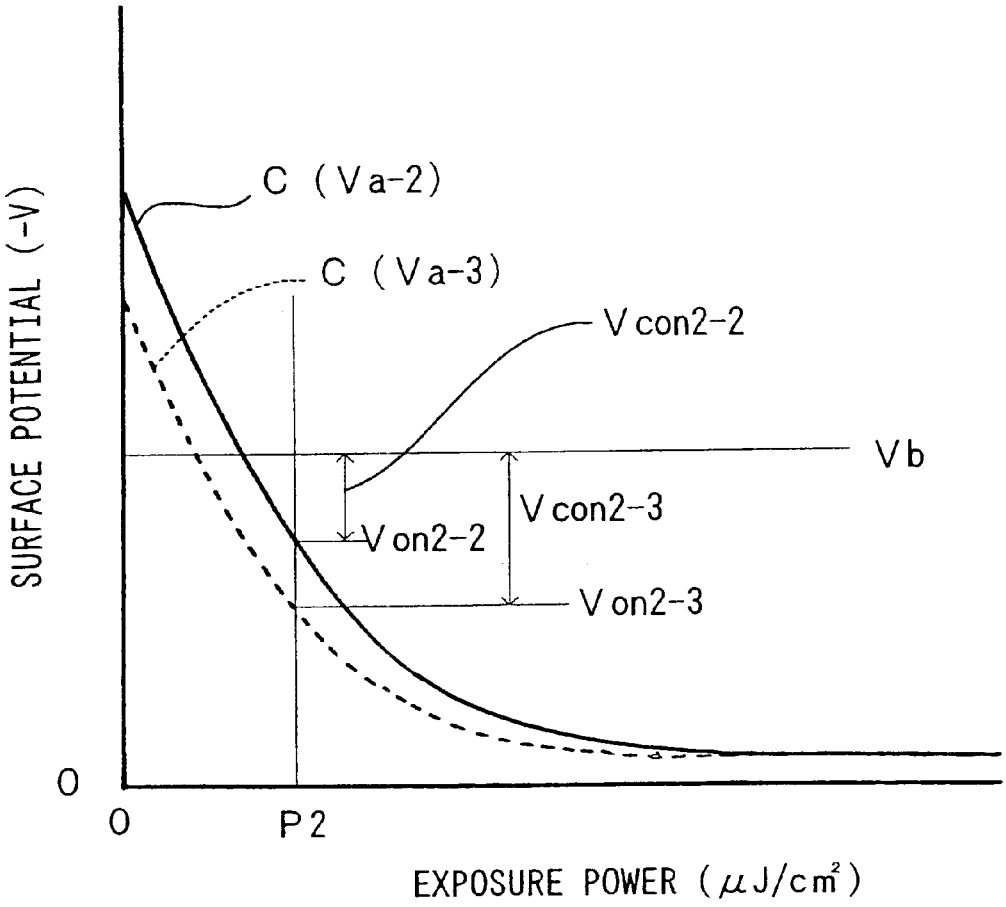
FIG. 27 is a drawing showing a relationship between an electrifying bias and a contrast potential when the electrifying bias is changed with a development bias fixed.

On the other hand, during the electrifying bias calculation processing, as shown in FIG. 27 for example, the electrifying bias is set to various levels while fixing the development bias to the optimal development bias Vb, and latent images of second patch images are formed by exposing light at an exposure power P2. The exposed area potential of the latent images becomes largely different between the different electrifying bias levels. Since second patch images are halftone images as those shown in FIG. 16A. Hence, even though the latent images are formed with an exposure beam having the exposure power P1, an effective exposure power for exposure with an isolated beam is smaller than the exposure power P1. As a result, the lowest potential level of a comb-shaped well potential is not as low as the lowest potential level that is observed during solid exposure. Noting a macro surface potential of halftone latent images, this is the same as solid exposure at the exposure power P2 that is smaller than the exposure power P1. Therefore, considering that the latent images of the second patch images are images solidly exposed at the exposure power P2, the exposed area potential of these latent images becomes largely different depending on the electrifying bias.

For instance, the exposed area potential becomes a potential Von2-2 to generate the contrast potential Vcon2-2 when the electrifying bias has the level Va-2, whereas when the electrifying bias has the level Va-3, the exposed area potential becomes a potential Von2-3 to generate the contrast potential Vcon2-3. In this manner, the contrast potential Vcon2 changes as the electrifying bias Va changes, and a density of the second patch image accordingly changes. For this reason, the electrifying bias calculation according to the preferred embodiment described above requires to form a plurality of second patch images while changing only the electrifying bias Va in order to determine an optimal electrifying bias.

If the optimal electrifying bias resulting from such electrifying bias calculation processing is different from the electrifying bias set during the development bias calculation (i.e., the electrifying bias Va-2 in FIG. 26), the contrast potential Vcon1 determined through the development bias calculation is changed. Hence, despite application of the optimal development bias, an image density may deviate from a target density. The possibility of this is high particularly when the exposure power drops.

Figure 28:
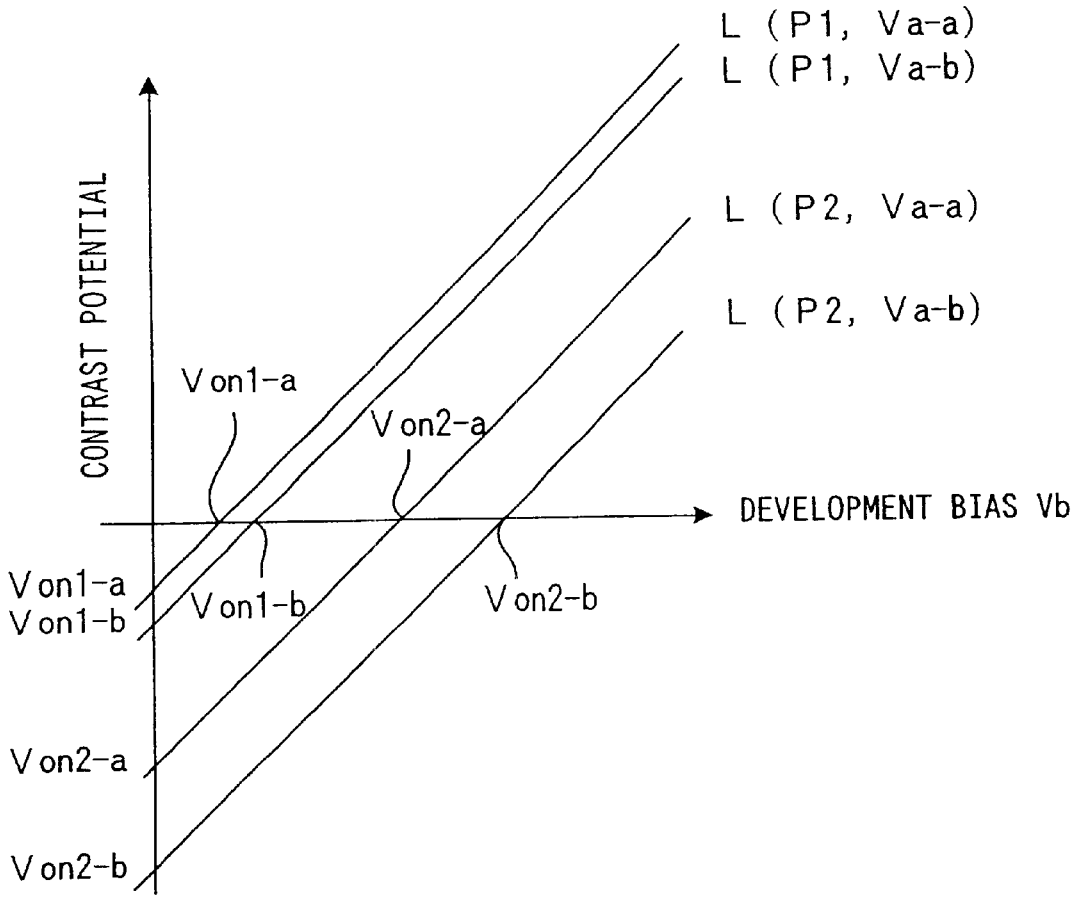
FIG. 28 is a drawing showing the relationship between the development bias and the contrast potential.
Figure 29:
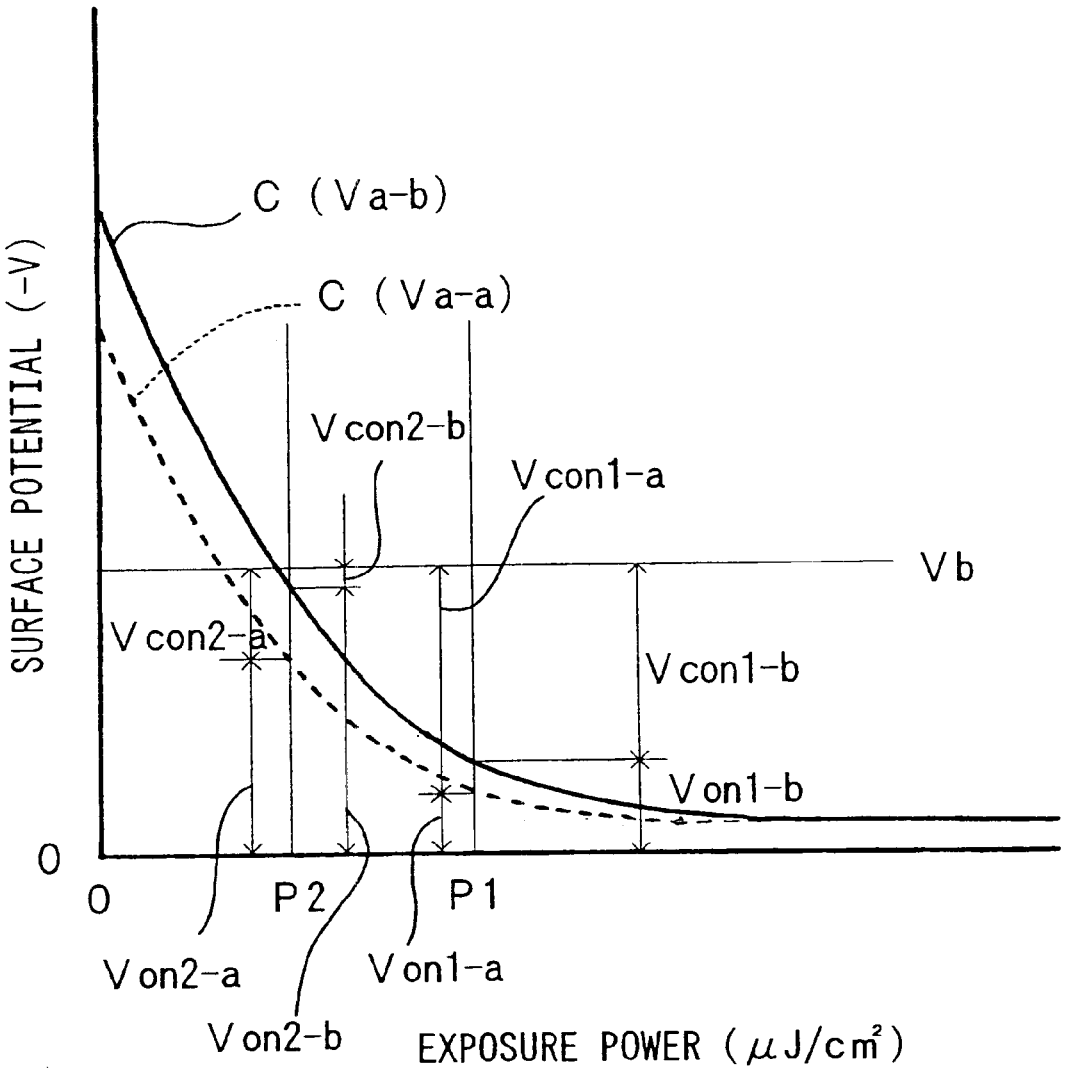
FIG. 29 is a drawing showing variations in the contrast potential and the exposed area potential in accordance with a change in the electrifying bias.

FIG. 28 shows a relationship between the development bias Vb and the contrast potential that is identified based on the optimal attenuation curves C(Va-a) and C(Va-b). In FIG. 28, the horizontal axis denotes the development bias Vb while the vertical axis denotes the contrast potential. Further, straight lines L(P1, Va-a), L(P1, Va-b), L(P2, Va-a) and L(P2, Va-b) respectively denote contrast potentials Vcon1-a, Vcon1-b, Vcon2-a and Vcon2-b which are shown in FIG. 29.

When first patch images are formed with the electrifying bias Va-a, changing the development bias Vb causes proportional change in the contrast potential Vcon1-a as denoted at the straight line L(P1, Va-a) shown in FIG. 28. Meanwhile, when first patch images are formed with the electrifying bias Va-b, changing the development bias Vb causes proportional change in the contrast potential Vcon1-b as denoted at the straight line L(P1, Va-b) shown in FIG. 28. When second patch images are formed with the electrifying bias Va-a, changing the development bias Vb causes proportional change in the contrast potential Vcon2-a as denoted at the straight line L(P2, Va-a) shown in FIG. 28. Further, when second patch images are formed with the electrifying bias Va-b, changing the development bias Vb causes proportional change in the contrast potential Vcon2-b as denoted at the straight line L(P2, Va-b) shown in FIG. 28. A development bias/contrast potential characteristic is determined based on the optimal attenuation curves in this manner.

In FIG. 28, a target contrast potential Vcon01 corresponds to the target density during the development bias calculation processing and a target contrast potential Vcon02 corresponds to the target density during the electrifying bias calculation processing. In order to even more accurately adjust a density, it is necessary to set the optimal development bias Vb and the optimal electrifying bias Va such that these two contrast potentials Vcon01 and Vcon02 are simultaneously satisfied.

Figure 30:
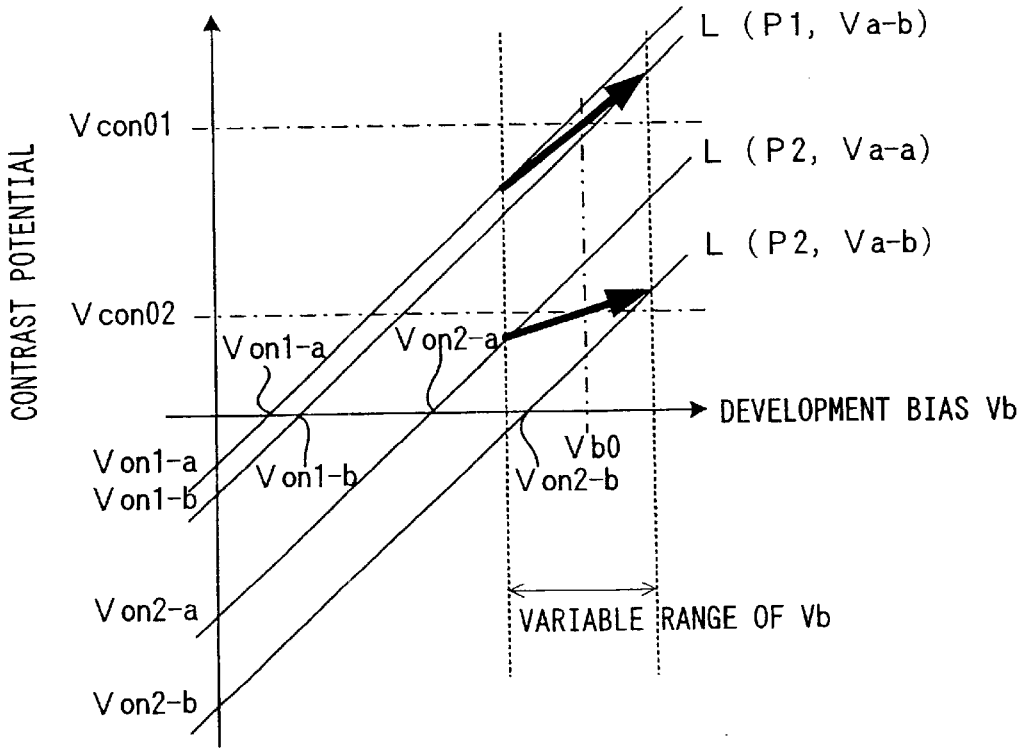
FIG. 30 is a drawing showing a relationship between the development bias and the contrast potential as the electrifying bias is set according to a first variation.

According to this embodiment, during the development bias calculation processing, as shown in FIG. 30, the development bias Vb is varied in its programmable range while at the same time changing the electrifying bias from the level Va-a to the level Va-b. As the electrifying biases Va-a and Va-b are set so that the two target contrast potentials Vcon01 and Vcon02 are simultaneously satisfied with approximately the same development bias Vb0, the optimal development bias Vb and the optimal electrifying bias Va are set at a high accuracy.

Now, as variations of the electrifying bias during the development bias calculation processing, five variations will be described. In each one of the five variations below, the electrifying bias increases as the development bias increases.

Figure 31:
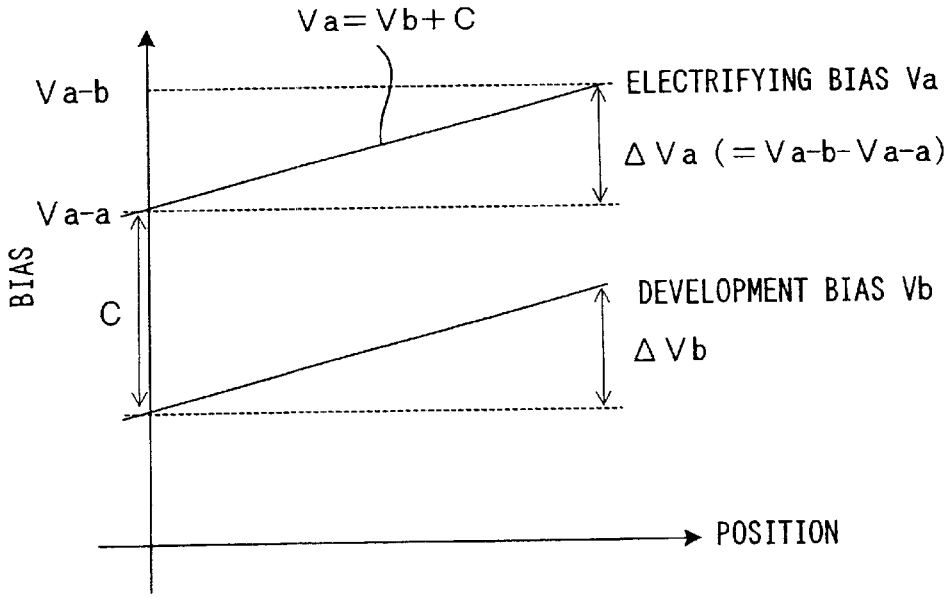
FIG. 31 is a drawing showing a relationship between the electrifying bias and the development bias in the first variation.
Figure 32:
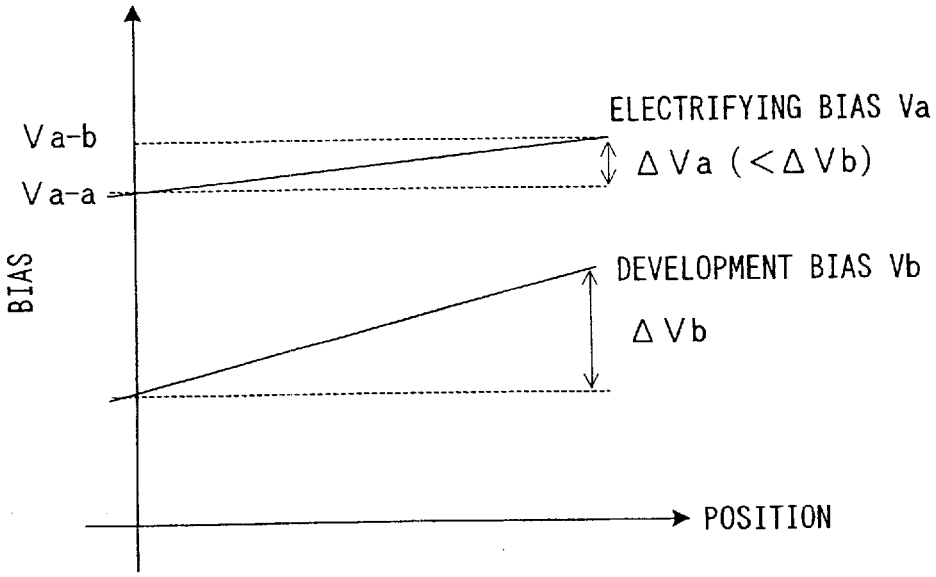
FIG. 32 is a drawing showing a relationship between the electrifying bias and the development bias in a second variation.

(1) First variation: FIG. 31

FIG. 31 is a drawing showing a first variation of the development bias and the electrifying bias during the development bias calculation processing. In the first variation, a quantity of change ΔVa (=Va-b−Va-a) in the electrifying bias is set equal to a quantity of change ΔVb in the development bias, and the electrifying bias Va is set to a value which is expressed as below:

$$Va=Vb+C$$

where C is a constant that is determined in accordance with a structure, operations and the like of an image forming apparatus.

Figure 37:
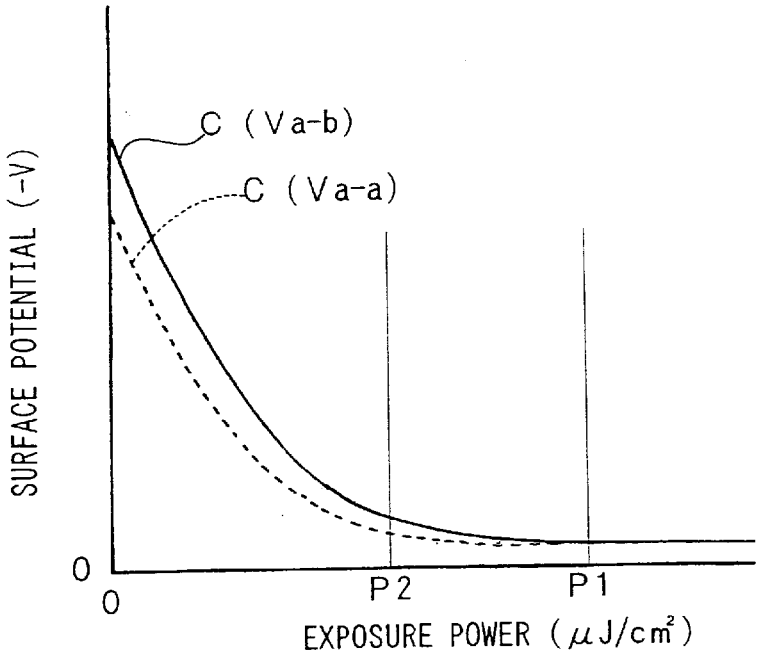
FIG. 37 is a drawing showing a relationship between an exposure power and a surface potential.

(2) Second variation: FIG. 37

Figure 33:
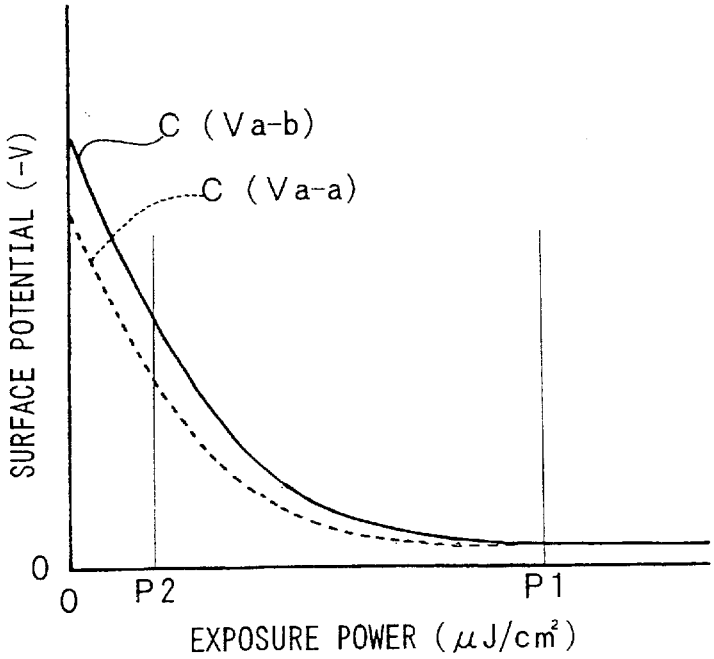
FIG. 33 is a drawing showing a relationship between an exposure power and a surface potential.
Figure 34:
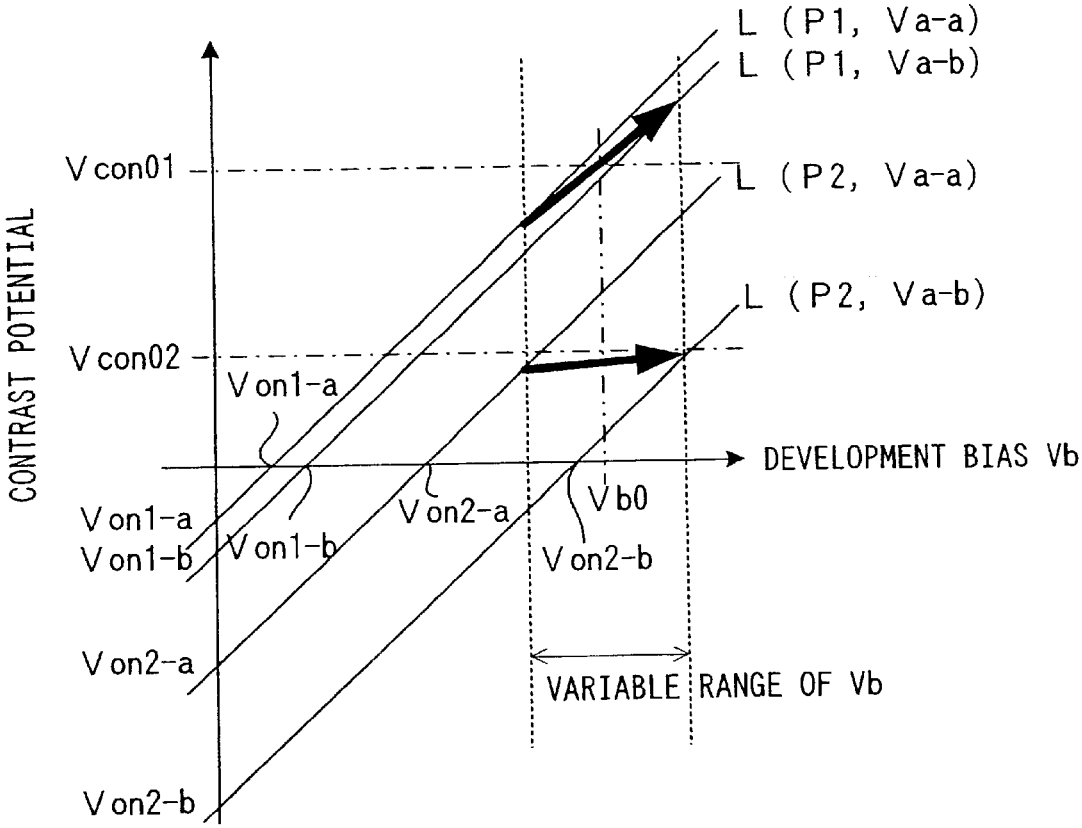
FIG. 34 is a drawing showing a relationship between the development bias and the contrast potential at the exposure power shown in FIG. 33.

FIG. 37 is a drawing showing a second variation of the development bias and the electrifying bias during the development bias calculation processing. In the second variation, a quantity of change ΔVa (=Va-b−Va-a) in the electrifying bias is set smaller than a quantity of change ΔVb in the development bias. Such setup is suitable to a situation where, as shown in FIG. 33, the exposure power P1 during the development bias calculation processing is relatively high thereby accompanying a small change in the exposed area potential Von1 with a change in the electrifying bias, whereas the exposure power P2 during the electrifying bias calculation processing is relatively low thereby accompanying a large change in the potential Von2 with a change in the electrifying bias. The reason of this will now be described with reference to FIGS. 33 through 35.

Where an attenuation characteristic is as shown in FIG. 33, the straight line L(P2, Va-a) and the straight line L(P2, Va-b) shown in FIG. 34 are apart relatively far from each other. Because of this, even when the electrifying bias is changed from the level Va-a to the level Va-b, the contrast potential Vcon2 shows only a small change, thereby making it impossible sometimes to calculate appropriate values which are necessary to obtain the target contrast potential Vcon02.

Figure 35:
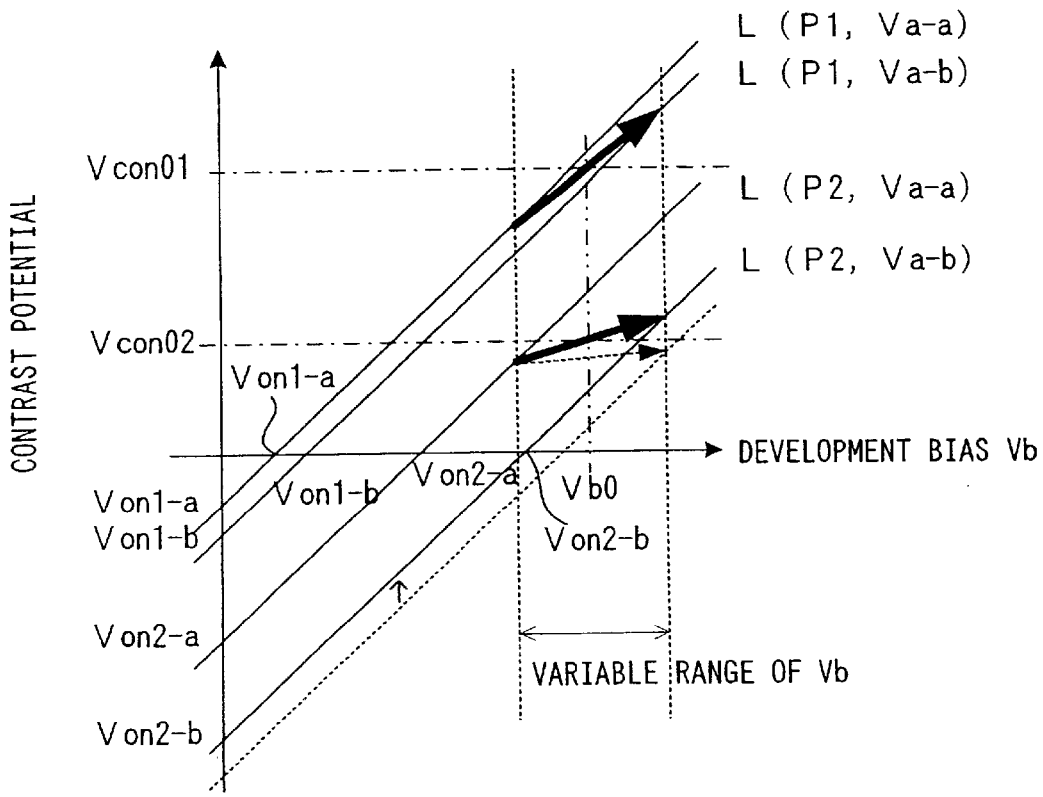
FIG. 35 is a drawing showing a relationship between the development bias and the contrast potential as the electrifying bias is set according to the second variation.

To deal with this, the second variation requires to set an electrifying bias change ΔVa smaller than a quantity of change ΔVb in the development bias Vb. Hence, the straight line L(P2, Va-b) shifts closer to the straight line L(P2, Va-a) as shown in FIG. 35, accompanying a large change in the contrast potential Vcon2. As a result, it is possible to reliably calculate appropriate values (the optimal development bias and the optimal electrifying bias) which are necessary to obtain the target contrast potential Vcon02.

Figure 36:
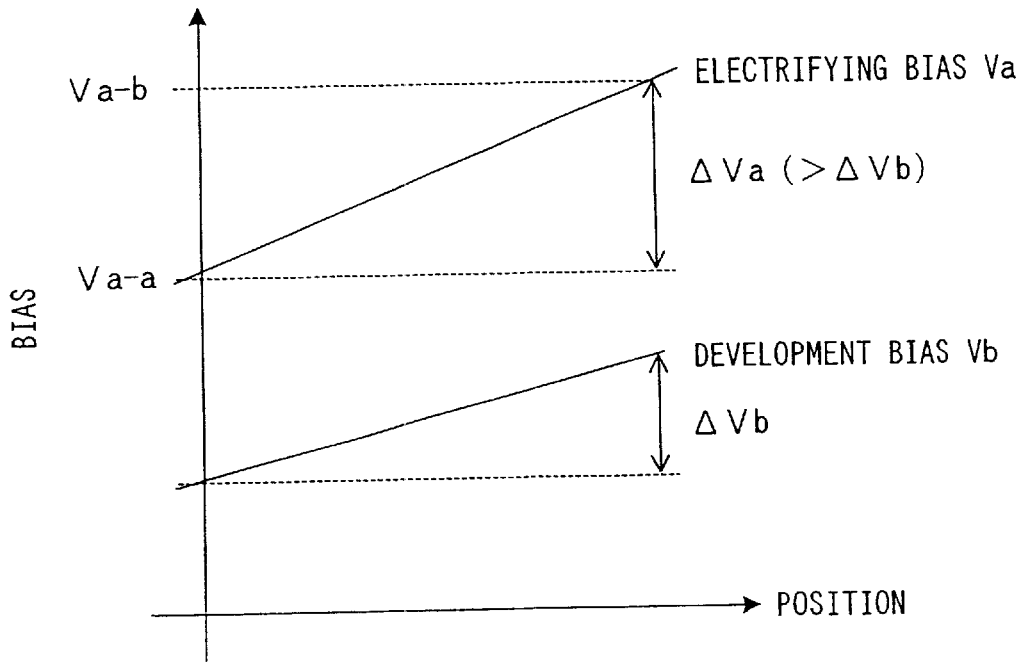
FIG. 36 is a drawing showing a relationship between the electrifying bias and the development bias in a third variation.

(3) Third variation: FIG. 36

Figure 38:
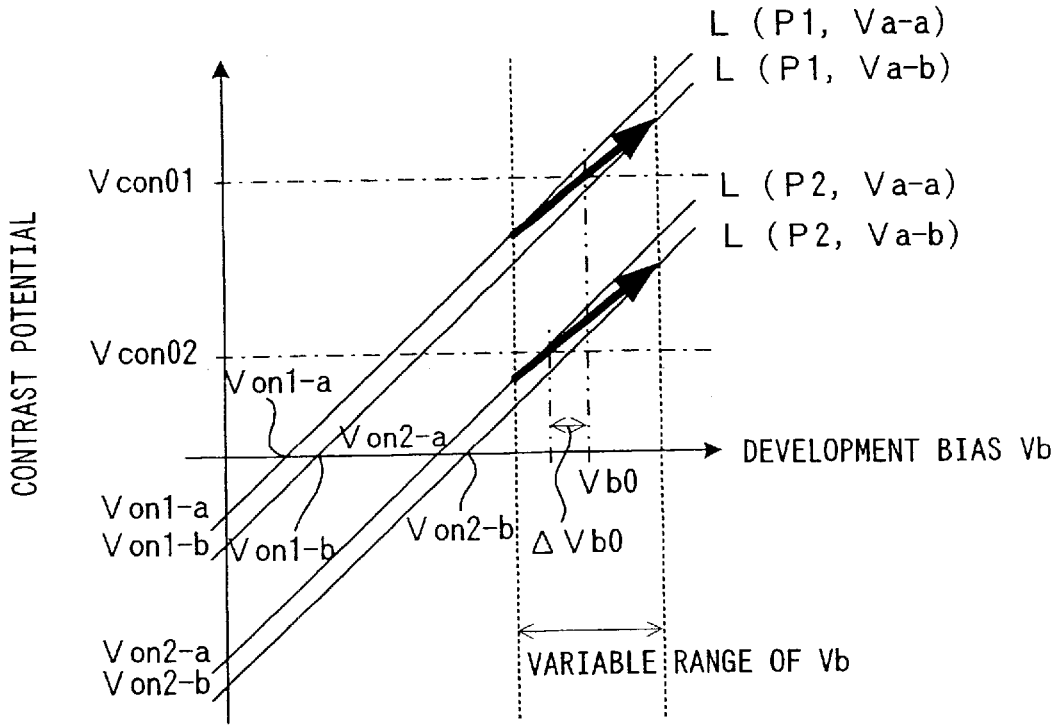
FIG. 38 is a drawing showing a relationship between the development bias and the contrast potential at the exposure power shown in FIG. 37.

FIG. 36 is a drawing showing a third variation of the development bias and the electrifying bias during the development bias calculation processing. In the third variation, a quantity of change ΔVa (=Va-b−Va-a) in the electrifying bias is set larger than a quantity of change ΔVb in the development bias. Such setup is suitable to a situation where, as shown in FIG. 37, the exposure power P1 during the development bias calculation processing is relatively high thereby accompanying a small change in the exposed area potential Von1 with a change in the electrifying bias, and the exposure power P2 during the electrifying bias calculation processing is also relatively high thereby accompanying a small change in the potential Von2 with a change in the electrifying bias. The reason of this will now be described with reference to FIGS. 37 through 39.

Where an attenuation characteristic is as shown in FIG. 37, the straight line L(P2, Va-a) and the straight line L(P2, Va-b) shown in FIG. 38 are apart relatively close to each other. In this condition, even when the electrifying bias is changed from the level Va-a to the level Va-b, the exposed area potentials Von2-a, Von2-b of second patch images shows only a small change, which arrives at virtually one optimal solution (the optimal electrifying bias). Because of this, as shown in FIG. 38, the target contrast potential Vcon01 of first patch images and the target contrast potential Vcon02 of second patch images sometimes become inconsistent to each other. In short, a deviation ΔVb0 is sometimes created between the optimal development bias Vb0 of first patch images and the optimal development bias of second patch images.

Figure 39:
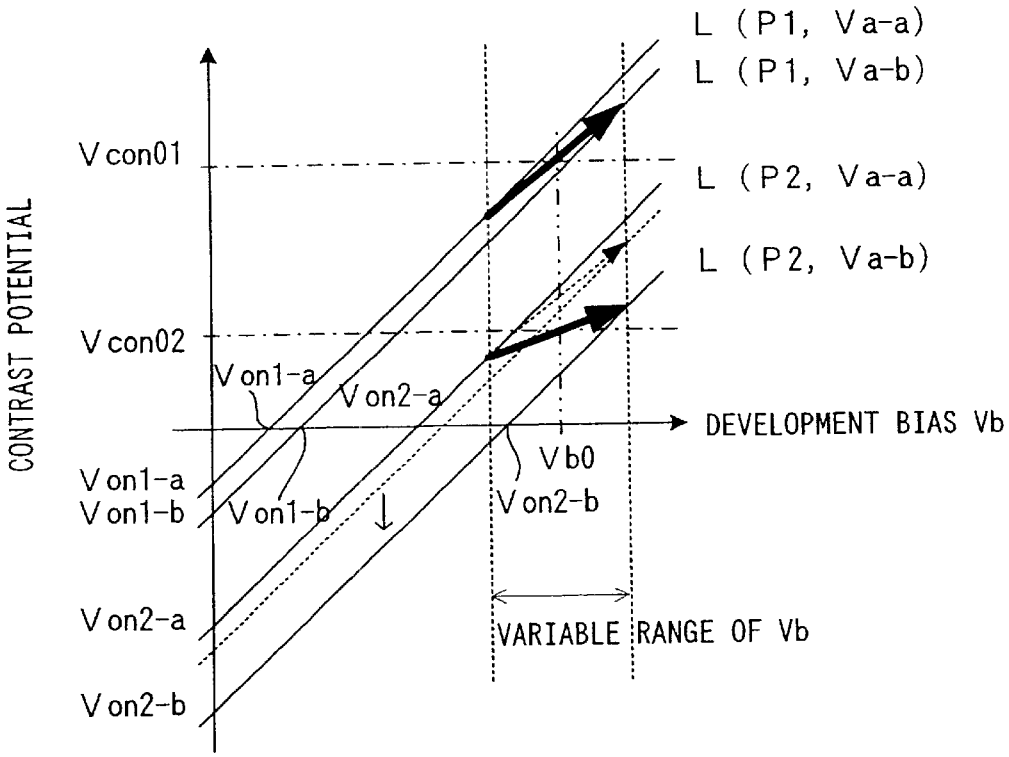
FIG. 39 is a drawing showing a relationship between the development bias and the contrast potential as the electrifying bias is set according to the third variation.

To deal with this, the third variation requires to set the electrifying bias change ΔVa larger than a quantity of change ΔVb in the development bias Vb (FIG. 36). Hence, the straight line L(P2, Va-b) is far from the straight line L(P2, Va-a) as shown in FIG. 39, thereby expanding a range of an optimal solution. This ensures consistency between the target contrast potential Vcon01 of first patch images and the target contrast potential Vcon02 of second patch images.

Figure 41:
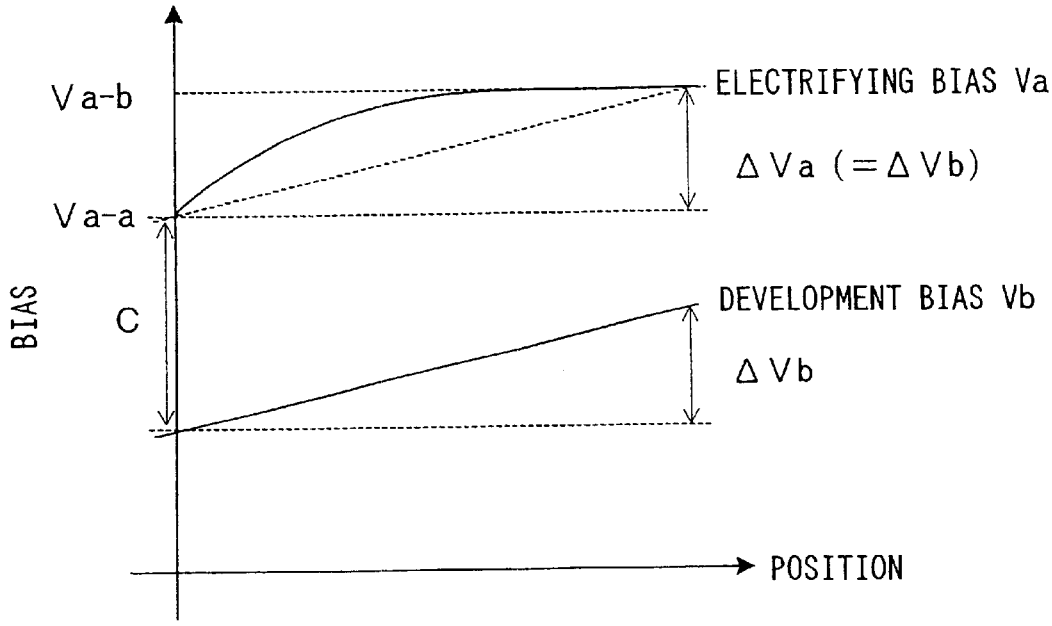
FIG. 41 is a drawing showing a relationship between the electrifying bias and the development bias in a fourth variation.

(4) Fourth variation: FIG. 41

Figure 40:
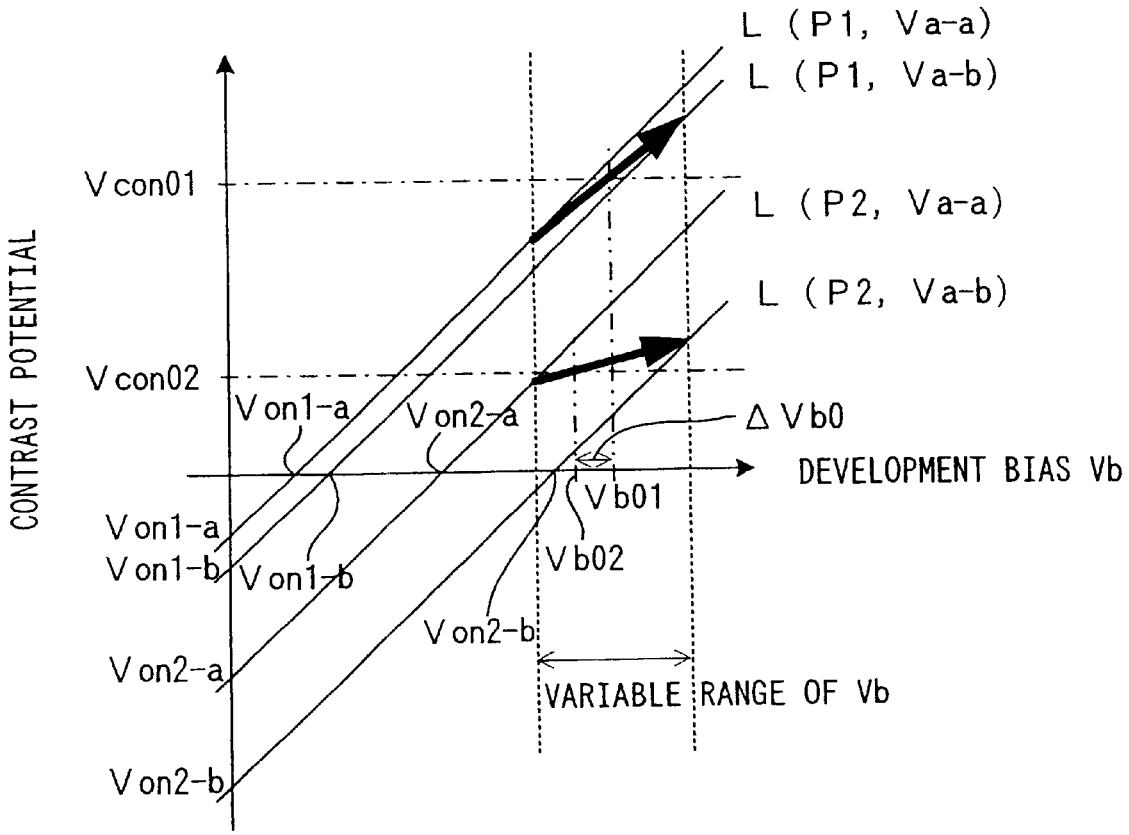
FIG. 40 is a drawing showing the relationship between the development bias and the contrast potential.
Figure 42:
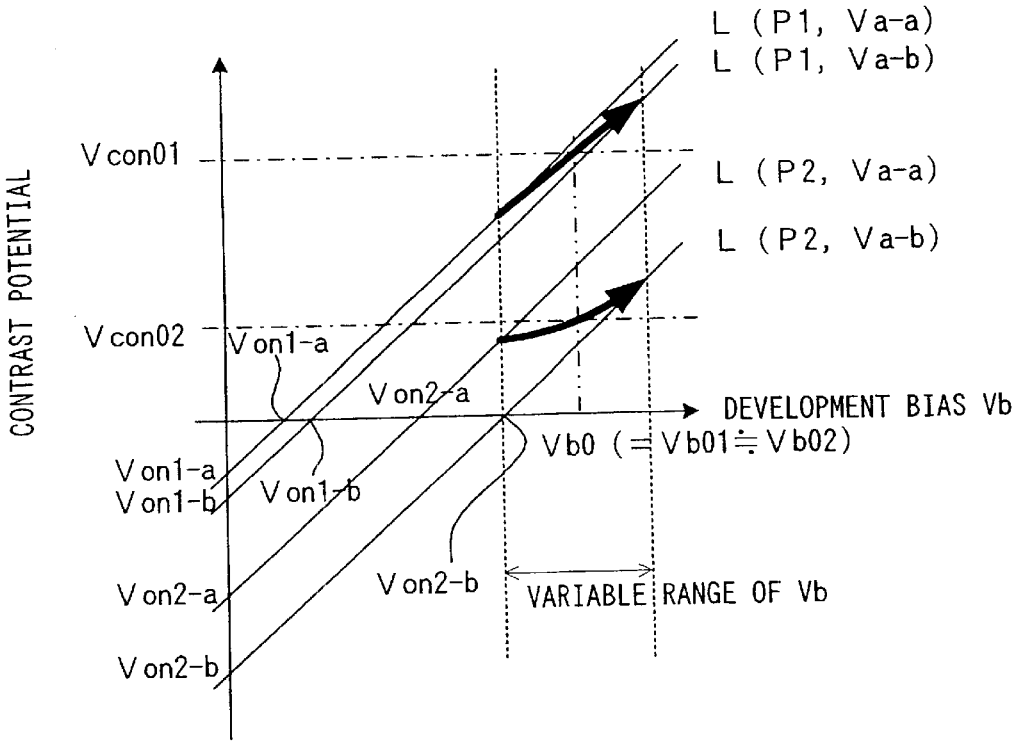
FIG. 42 is a drawing showing a relationship between the development bias and the contrast potential as the electrifying bias is set according to the fourth variation.

It is desirable to set the electrifying bias in accordance with a change in the development bias such that a development bias Vb01 satisfying the target contrast potential Vcon01 and a development bias Vb02 satisfying the target contrast potential Vcon02 become approximately equal to each other, as described above. However, depending on a process of forming images, as described earlier, it is difficult in some cases to match the development biases Vb01 and Vb02 with a linear change in the electrifying bias. For example, when the electrifying bias is changed according to the first variation (FIG. 31), the development bias Vb02 sometimes becomes smaller than the development bias Vb01 as shown in FIG. 40 to thereby create a deviation ΔVb0 to the development bias. When this occurs, the electrifying bias may be changed logarithmically as shown in FIG. 41, which moves the development bias Vb02 which satisfies the target contrast potential Vcon02 closer to the development bias Vb01 which satisfies the target contrast potential Vcon01 so that the two development biases Vb01 and Vb02 approximately match with each other (FIG. 42).

Figure 44:
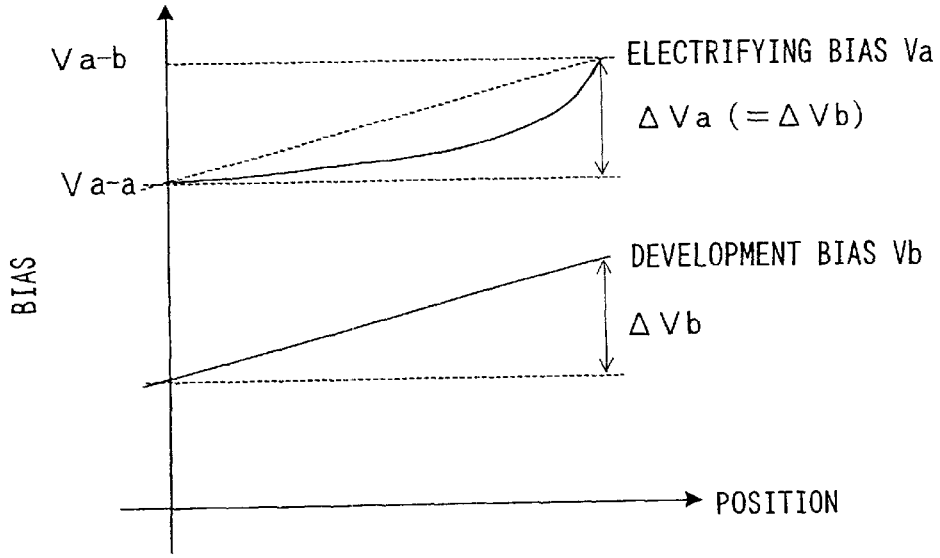
FIG. 44 is a drawing showing a relationship between the electrifying bias and the development bias in a fifth variation.

(5) Fifth variation: FIG. 44

Figure 43:
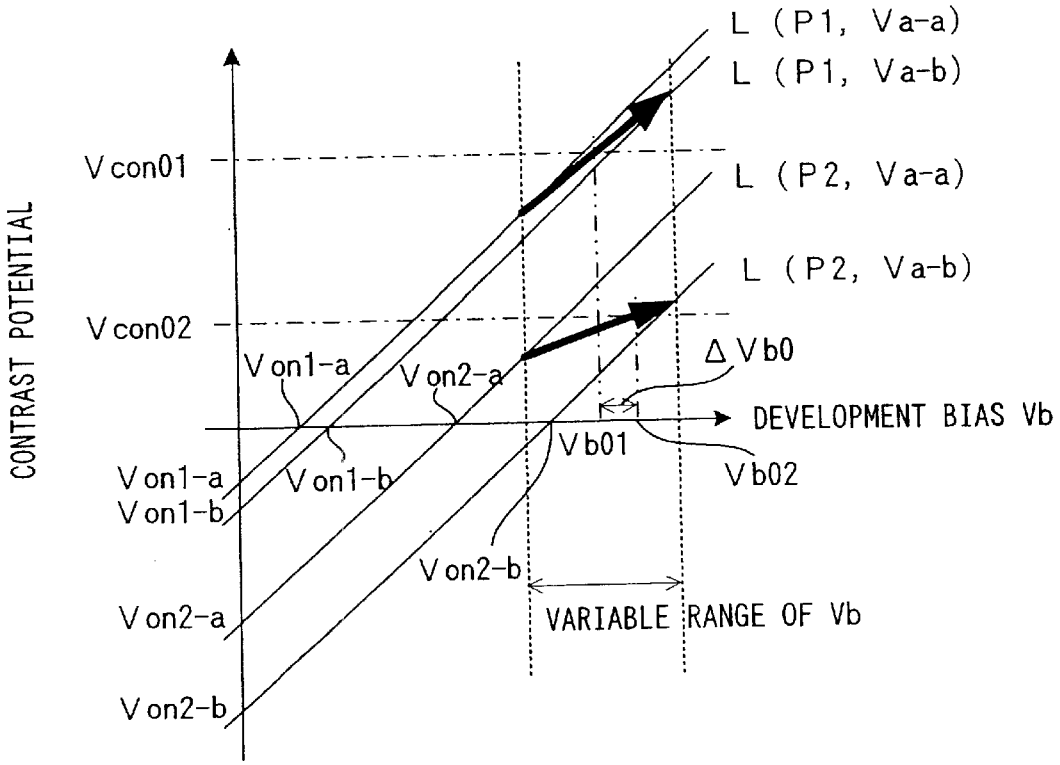
FIG. 43 is a drawing showing the relationship between the development bias and the contrast potential.
Figure 45:
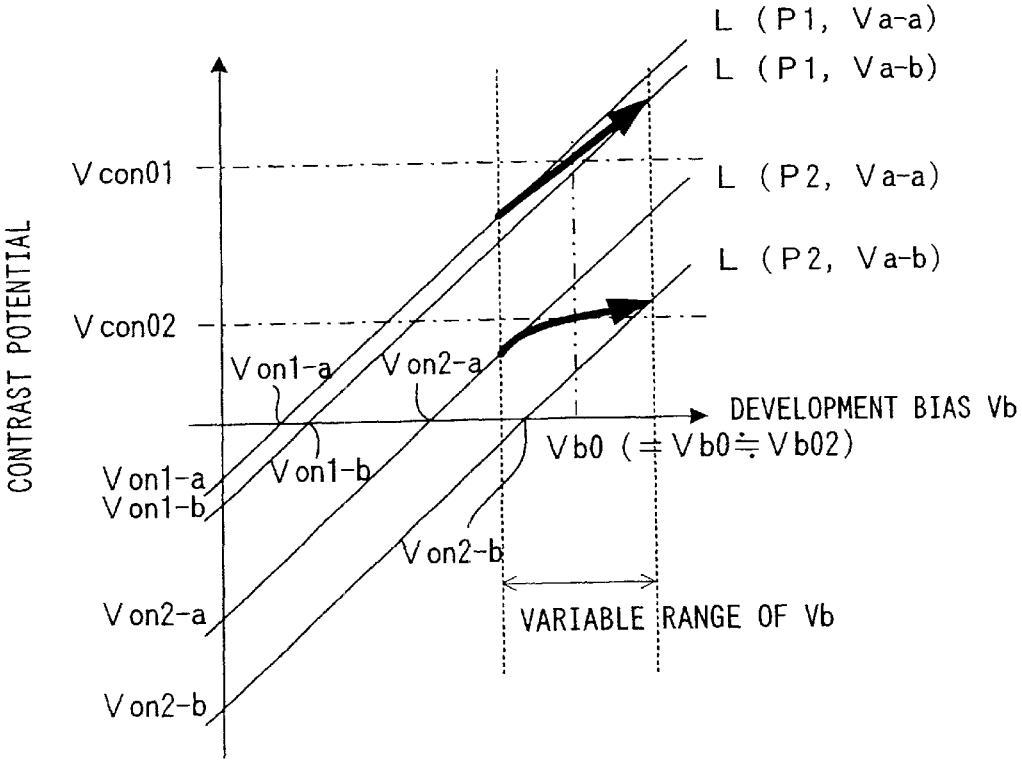
FIG. 45 is a drawing showing a relationship between the development bias and the contrast potential as the electrifying bias is set according to the fifth variation.
Figure 46A:
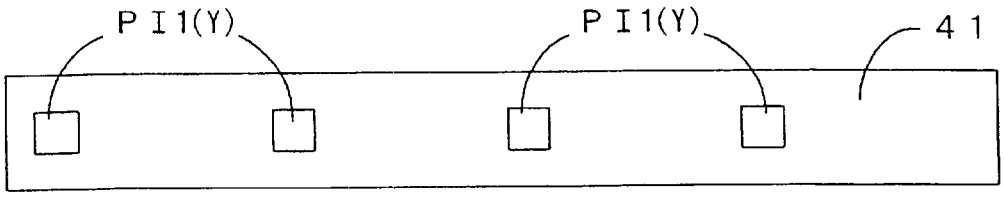
FIGS. 46A through 46D are drawings showing an order of forming patch images according to still other preferred embodiment.
Figure 46B:
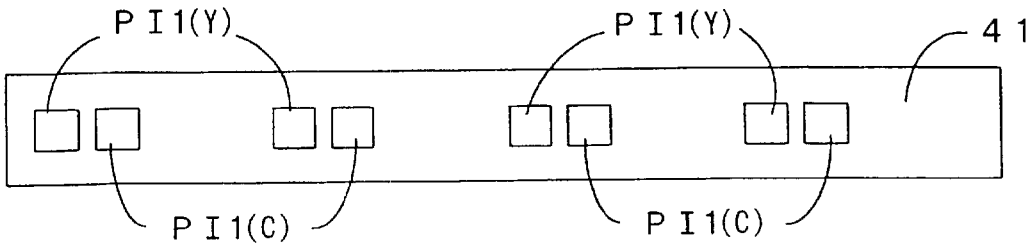
Figure 46C:
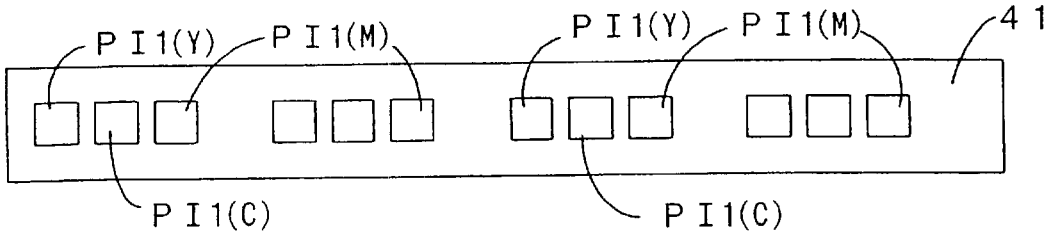
Figure 46D:
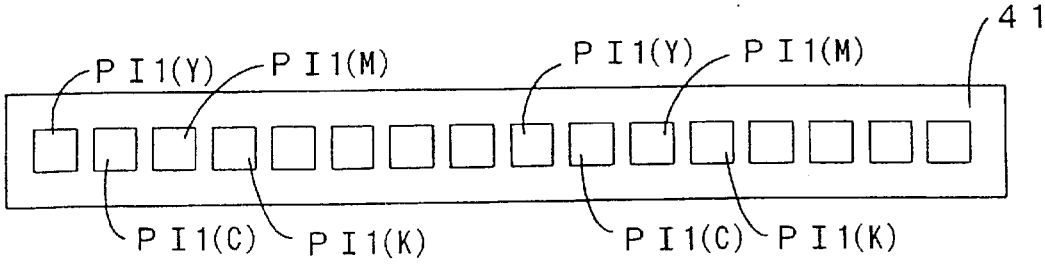

When the electrifying bias is changed according to the first variation (FIG. 31), the development bias Vb02 sometimes becomes larger than the development bias Vb01 as shown in FIG. 43, creating a deviation ΔVb0 to the development bias. When this occurs, the electrifying bias may be changed exponentially as shown in FIG. 44, which moves the development bias Vb02 which satisfies the target contrast potential Vcon02 closer to the development bias Vb01 which satisfies the target contrast potential Vcon01 so that the two development biases Vb01 and Vb02 approximately match with each other (FIG. 45).

E. The Others

The present invention is not limited to the preferred embodiment above, but can be modified in various manners other than those described above without departing from the essence of the present invention. For example, although the foregoing requires to use the electrifying roller 22 as the electrifying means, an electrifying brush may be used. The present invention is also applicable to an image forming apparatus in which non-contact electrifying means electrifies the photosensitive member 21, instead of an image forming apparatus utilizing such contact electrification in which a conductive member, such as an electrifying roller and an electrifying brush, touches a surface of a photosensitive member 21 for electrification.

Further, while the patch images PI1 are formed as clusters in each color as shown in FIGS. 8A through 8D in the preferred embodiment described above, the patch images PI1 may be formed in each color in turn as shown in FIG. 46A through 46D. More specifically, first, yellow patch images PI1(Y) are formed on the intermediately transfer belt 41 at relatively wide intervals. Next, cyan patch images PI1(C) are formed one by one, starting at a position which is shifted by one patch image and a blank between the adjacent-patch images in the sub scanning direction (the right-hand side in FIG. 46A through 46D) as viewed from the yellow patch images PI1(Y). Following this, magenta patch images PI1(M) and black patch images PI1(K) are formed in a similar manner. Where the respective patch images are thus formed at relatively wide intervals, it is possible to ensure a stabilization time for switching of the biases, and hence, to form the respective patch images at the set biases without fail. Although the description immediately above is related to first patch images, the same directly applies to second patch images as well.

Further, while the preferred embodiment above is related to an image forming apparatus which is capable of forming a color image using toners in four colors, an application of the present invention is not limited to this. The present invention is naturally applicable to an image forming apparatus which forms only a monochrome image as well. In addition, although the image forming apparatus according to the preferred embodiment above is a printer for forming an image supplied from an external apparatus such as a host computer through the interface 112 on a sheet such as a copying paper, a transfer paper, a form and a transparent sheet for an over-head projector, the present invention is applicable to image forming apparatuses of the electrophotographic method in general such as a copier machine and a facsimile machine.

Further, in the preferred embodiment above, toner images on the photosensitive member 21 are transferred onto the intermediate transfer belt 41, image densities of patch images formed by said toner images are detected, and an optimal development bias and an optimal electrifying bias are thereafter calculated based on the detected image densities. However, the present invention is also applicable to an image forming apparatus in which a toner image is transferred onto other transfer medium except for the intermediate transfer belt 41, to thereby form a patch image. The other transfer medium includes a transfer drum, a transfer belt, a transfer sheet, an intermediate transfer drum, an intermediate transfer sheet, a reflection-type recording sheet, a transmission memory sheet, etc. Further, instead of forming a patch image on a transfer medium, a patch sensor may be disposed so as to detect a density of a patch image which is formed on a photosensitive member. In this case, the patch sensor detects image densities of patch images on the photosensitive member and an optimal development bias and an optimal electrifying bias are calculated based on the detected image densities.

Further, the narrow range is defines as approximately ⅓ of the programmable range (Vb01–Vb10) of development bias in the preferred embodiment above. Although the width of the narrow range is not limited to this, if the width of the narrow range is wide, the use of the narrow range becomes less meaningful and degrades the accuracy of calculation of an optimal development bias. For this reason, it is necessary to set the narrow range as approximately ½ of or narrower than the programmable range for development bias. This also applies to the narrow range for electrifying biases as well.

Further, although the four types of biases are set in the wide and the narrow ranges in the preferred embodiment described above, the number of bias values (the number of patch images) in the range is not limited to this but may be optional to the extent that more than one types of bias values are used. Alternatively, the number of bias values may be different between the wide range and the narrow range such that the number of patch images is different between the wide range and the narrow range.

Further, while the first patch images are each a solid image whose area ration is 100% in the preferred embodiment above, an image whose area ratio is approximately 80% or more may be used instead of using a solid image. Even when such an image is used as the first patch images, a similar effect to that promised when solid images are used is obtained.

The term "area ratio" refers to a ratio of dots to the area of a patch image as a whole.

Further, although the preferred embodiment above requires to change an electrifying bias which is supplied to the electrifying roller 22 as a density controlling factor to sequentially form patch images PI2, PI2', other density controlling factor may be used, i.e., patch images of more than one one-dot lines may be formed while changing a development bias, an exposure dose, etc. In such a modification as well, as densities of the patch images are detected and an optimal value which is needed to achieve a target density is determined based on the detected image densities, it is possible to stabilize an image density of a line image.

Further, in the preferred embodiment above, after executing the development bias calculation (step S3), the electrifying bias calculation (step S5) is further executed, in order to calculate an optimal development bias and an optimal electrifying bias. However, the manner in which an optimal development bias and an optimal electrifying bias are calculated is not limited to this. For example, a plurality of patch images may be formed while changing the development bias and the electrifying bias at the same time, so that an optimal development bias and an optimal electrifying bias are calculated based on image densities of the patch images and density adjustment is executed. In this case, memory means such as a RAM and a ROM stores the development bias and the electrifying bias for every density adjustment and the memory means reads out the most recent development bias and the most recent electrifying bias in preparation for the next density adjustment. The plurality of patch images are formed while changing the development bias and the electrifying bias at the same time based on the most recent development bias and the most recent electrifying bias. This realizes a similar effect to that according to the preferred embodiment above. Still further, the present invention is applicable to where calculation of an optimal development bias is executed first and an optimal electrifying bias is thereafter calculated followed by density adjustment, in which case as well it is possible to achieve a similar effect to that described above.

Figure 47:
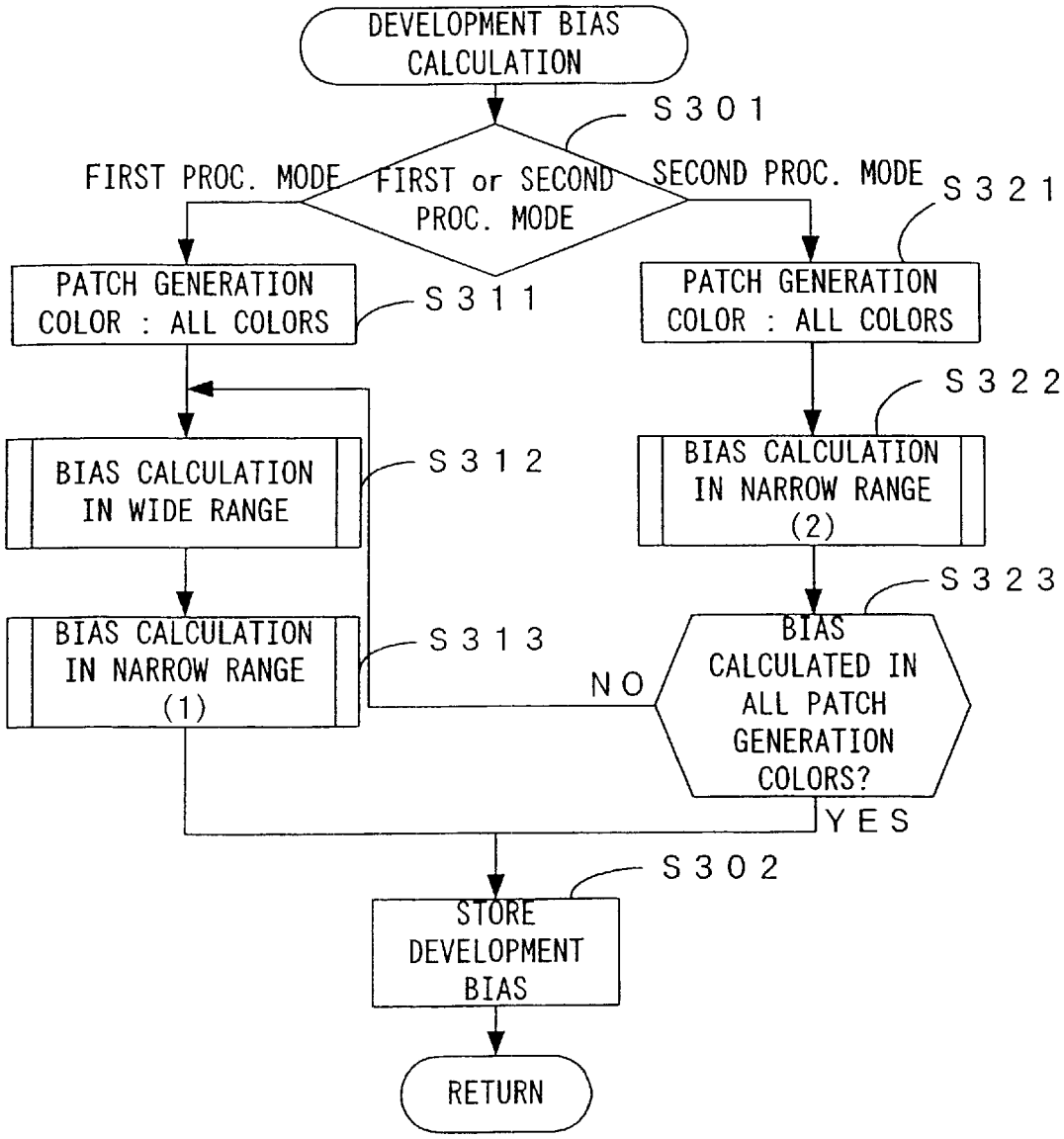
FIG. 47 is a drawing showing other preferred embodiment of an image forming method.

Further, while the second processing mode is selectively executed estimating that a change in a state of the engine part E is small when the criterion (2), (3) or (5) described earlier is met in the preferred embodiment above, it is possible that the change in the engine state is larger than expected and an optimal development bias can not be determined in the second processing mode. To appropriately deal with such a situation, as shown in FIG. 47, in the second processing mode, when it is determined that calculation of optimal development biases with respect to all of the patch generation colors failed (step S323), the sequence proceeds to the step S312 to further execute the first processing mode. In this manner, even when there is a large change in a state of the engine part E (image forming means), it is possible to flexibly deal with the situation and accurately determine an optimal development bias.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. An image forming apparatus for forming an image which has a predetermined target density, comprising:

image forming means for forming the image;

density detecting means for detecting an image density of the image which is formed by said image forming means; and control means having a plurality of processing modes, which are different from each other, for calculating at least one density controlling factor, said control means selectively executing one of said plurality of processing modes in accordance with an operation status of said apparatus, each of said plurality of processing modes being a mode in which a plurality of patch images are formed by said image forming means while changing said at least one density controlling factor, which influences the image density of the image, and an optimal value of said at least one density controlling factor, which is necessary to adjust the image density of the image to the target density, is determined based on the densities of said patch images.

2. The image forming apparatus according to claim 1, wherein said control means, when failed to determine an optimal value of said density controlling factor in a selected processing mode, selects and executes a different processing mode from said plurality of processing modes.

3. The image forming apparatus according to claim 1, further comprising memory means for storing an optimal value of said density controlling factor every time an image density of a toner image is adjusted, wherein said control means is capable of changing said density controlling factor within a predetermined programmable range and setting two ranges for changing said density controlling factor, which are a wide range and a narrow range, within said predetermined programmable range, and has a first processing mode and a second processing mode can be executed as said plurality of processing modes, said first processing mode being a mode in which a plurality of patch images are formed one after another while changing said density controlling factor stepwise at first intervals within said wide range, and after tentatively finding an interim value of said density controlling factor, which is necessary to obtain said target density, based on the densities of said patch images detected by said density detecting means, a plurality of patch images are formed one after another while changing said density controlling factor stepwise at second intervals, which are narrower than said first intervals, within said narrow range which includes said interim value, and an optimal value of said density controlling factor, which is necessary to obtain said target density, is determined based on the densities of said patch images detected by said density detecting means, said second processing mode being a mode in which a plurality of patch images are formed one after another while changing said density controlling factor within a predetermined range which includes the most recent optimal value which is stored in said memory means, and an optimal value of said density controlling factor, which is necessary to obtain said target density, is determined based on the densities of said patch images detected by said density detecting means.

4. The image forming apparatus according to claim 3, wherein said control means sets said range used in said second processing mode to said narrow range.

5. The image forming apparatus according to claim 3, wherein upon failure of determining an optimal value of said density controlling factor in said second processing mode, said first processing mode is further executed.

6. The image forming apparatus according to claim 1, wherein said image forming means comprises: a photosensitive member having a surface on which an electrostatic latent image is formed; and developing means for visualizing an electrostatic latent image with a toner to thereby form a toner image, and said control means determines an optimal value of a development bias as said density controlling factor which is to be supplied to said developing means.

7. The image forming apparatus according to claim 6, wherein said image forming means further comprises electrifying means for electrifying the surface of said photosensitive member, and said control means fixes a value of an electrifying bias, which is supplied to said electrifying means, to an approximately constant value regardless of a change in said selected processing mode.

8. The image forming apparatus according to claim 6, wherein said image forming means further comprises: electrifying means for electrifying the surface of said photosensitive member; and exposing means for forming said electrostatic latent image on the surface of said photosensitive member, and said control means changes an electrifying bias, which is supplied to said electrifying means, in accordance with a change in said development bias based on an attenuation characteristic of a surface potential of said photosensitive member caused by said exposing means during said selected processing mode.

9. The image forming apparatus according to claim 8, wherein said control means sets said electrifying bias such that said electrifying bias increases as said development bias increases during said selected processing mode.

10. The image forming apparatus according to claim 8, wherein said control means changes said electrifying bias linearly in accordance with a change in said development bias during said selected processing mode.

11. The image forming apparatus according to claim 8, wherein said control means changes said electrifying bias non-linearly in accordance with a change in said development bias in said selected processing mode.

12. The image forming apparatus according to claim 6, wherein the area ratio of said patch images is 80% or more.

13. The image forming apparatus according to claim 1, further comprising memory means for storing an optimal value of said density controlling factor every time an image density of a toner image is adjusted, wherein said control means is capable of executing a third processing mode and a fourth processing mode as said plurality of processing modes, said third processing mode being a mode in which a plurality of patch images are formed one after another while changing said density controlling factor stepwise within a range which includes a default value which is set in advance, and an optimal value of said density controlling factor, which is necessary to obtain said target density, is determined based on the densities of said patch images detected by said density detecting means, said fourth processing mode being a mode in which a plurality of patch images are formed one after another while changing said density controlling factor within a predetermined range which includes the most recent optimal value which is stored in said memory means, and an optimal value of said density controlling factor, which is necessary to obtain said target density, is determined based on the densities of said patch images detected by said density detecting means.

14. The image forming apparatus according to claim 13, wherein said image forming means comprises: a photosensitive member having a surface on which an electrostatic latent image is formed; and electrifying means for electrifying the surface of said photosensitive member, and said control means determines an optimal value of an electrifying bias as said density controlling factor which is to be supplied to said electrifying means.

15. The image forming apparatus according to claim 14, wherein said patch images are halftone images.

16. The image forming apparatus according to claim 15, wherein said patch images are formed by a plurality of one-dot lines which are apart from each other.

17. The image forming apparatus according to claim 16, wherein said plurality of one-dot lines are approximately parallel to each other, and adjacent two of said one-dot lines are apart from each other at an interval of n-lines, the line interval n being two or more.

18. The image forming apparatus according to claim 17, wherein the line interval n between adjacent two of said one-dot lines is an integer which further satisfies:

$$n \leqq (\phi \cdot R - 10)/10$$

where $\phi$ denotes a size of a detect area of said density detecting means and R denotes a resolution of said image forming apparatus.

19. The image forming apparatus according to claim 17, wherein the line interval n between adjacent two of said one-dot lines is an integer which further satisfies:

$$n \leqq (\phi \cdot R - 20)/20$$

where $\phi$ denotes a size of a detect area of said density detecting means and R denotes a resolution of said image forming apparatus.

20. The image forming apparatus according to claim 16, wherein said patch images are lattice images, each of said lattice images consisting of said plurality of one-dot lines which are arranged in the shape of a lattice.

21. The image forming apparatus according to claim 16, wherein said patch images are perpendicular lattice images, each of said perpendicular lattice images consisting of said plurality of one-dot lines which are arranged perpendicular to each other in the shape of a lattice.

22. The image forming apparatus according to claim 13, wherein said image forming means comprises: a photosensitive member having a surface on which an electrostatic latent image is formed; and electrifying means for electrifying the surface of said photosensitive member, and said control means forms said plurality of patch images while increasing said electrifying bias stepwise.

23. The image forming apparatus according to claim 13, wherein said electrifying means comprises a conductor upon which said electrifying bias is applied, and said electrifying means electrifies the surface of said photosensitive member as said conductor touches the surface of said photosensitive member.

24. The image forming apparatus according to claim 1, wherein a toner image is formed using a mono-component non-magnetic toner.

25. The image forming apparatus according to claim 1, wherein a toner image is formed using a toner which contains an external additive in the quantity of 1.5% or more.

26. An image forming method in which a plurality of patch images are formed while changing at least one density controlling factor which influences an image density of a toner image, densities of said patch images are detected, and a plurality of processing modes, which are different from each other, are used for calculating at least one density controlling factor, said plurality of processing modes being used for determining an optimal value of said at least one density controlling factor, which is necessary to adjust the image density of a toner image to a target density, based on the densities of said patch images, said method comprising a step of:

selecting and executing one of said plurality of processing modes in accordance with an operation status to thereby determine the optimal value of said at least one density controlling factor.

* * * * *

UNITED STATES PATENT AND TRADEMARK OFFICE

CERTIFICATE OF CORRECTION

PATENT NO. : 6,341,203 B1
DATED : January 22, 2002
INVENTOR(S) : Nakazato et al.

It is certified that error appears in the above-identified patent and that said Letters Patent is hereby corrected as shown below:

Title page,
Item [30], Foreign Application Priority information should read:

-- [30] Foreign Application Priority Data

Jul. 28, 1999 (JP) ..... 11-213653
Jul. 28, 1999 (JP) ..... 11-213654
Jul. 28, 1999 (JP) ..... 11-213655
Sep. 6, 1999 (JP) ..... 11-252259
Jun. 5, 2000 (JP) ..... 2000-167282 --

Signed and Sealed this

Twenty-seventh Day of August, 2002

*Attest:*

*Attesting Officer*

JAMES E. ROGAN
*Director of the United States Patent and Trademark Office*